US006039650A

United States Patent [19]

Hill

[11] Patent Number: 6,039,650

[45] **Date of Patent: *Mar. 21, 2000**

[54] CARD DISPENSING SHOE WITH SCANNER APPARATUS, SYSTEM AND METHOD THEREFOR

[75] Inventor: Otho Dale Hill, Las Vegas, Nev.

[73] Assignee: Smart Shoes, Inc., Las Vegas, Nev.

[ * ] Notice: This patent is subject to a terminal disclaimer.

[21] Appl. No.: 09/031,321

[22] Filed: Feb. 26, 1998

Related U.S. Application Data

[63] Continuation-in-part of application No. 08/543,908, Oct. 17, 1995, Pat. No. 5,722,893.

[51] Int. Cl.[7] ..... A63F 1/14

[52] U.S. Cl. ..... 463/47; 273/149 R; 463/29

[58] Field of Search ..... 463/23, 29, 46, 463/47, 11, 12; 273/292, 148 R, 149 R, 149 P, 309

[56] References Cited

U.S. PATENT DOCUMENTS

| | | | |
|---|---|---|---|
| 4,531,187 | 7/1985 | Uhland | 463/12 |
| 5,259,907 | 11/1993 | Soules et al. | 273/293 |
| 5,362,053 | 11/1994 | Miller | 273/309 |
| 5,374,061 | 12/1994 | Albrecht | 273/149 R |
| 5,377,973 | 1/1995 | Jones et al. | 463/12 |
| 5,382,024 | 1/1995 | Blaha | 273/149 R |
| 5,416,308 | 5/1995 | Hood et al. | 235/454 |
| 5,515,477 | 5/1996 | Sutherland | 395/27 |
| 5,605,334 | 2/1997 | McCrea, Jr. | 273/309 |
| 5,636,843 | 6/1997 | Roberts | 463/12 |
| 5,722,893 | 3/1998 | Hill et al. | 463/47 |
| 5,788,574 | 8/1998 | Ornstein et al. | 463/12 |
| 5,803,808 | 9/1998 | Strisower | 463/12 |

FOREIGN PATENT DOCUMENTS

| | | | |
|---|---|---|---|
| 3807127 | 9/1989 | Germany | 273/148 R |

*Primary Examiner*—Jessica J. Harrison
*Attorney, Agent, or Firm*—Flehr Hohbach Test Albritton & Herbert LLP

[57] ABSTRACT

The present invention is directed to a playing card dispensing shoe apparatus, system and method wherein the shoe has a card scanner which scans the indicia on a playing card as the card moves along and out of a chute of the shoe by operation of the dealer. The scanner comprises an optical-sensor used in combination with a neural network which is trained using error back-propagation to recognize the card suits and card values of the playing cards as they are moved past the scanner. The scanning process in combination with a central processing unit (CPU) determines the progress of the play of the game and, by identifying card counting systems or basic playing strategies in use by the players of the game, provides means to limit or prevent casino losses and calculate the Theoretical Win of the casino, thus also providing an accurate quality method of the amount of comps to be given a particular player. The shoe is also provided with additional devices which make it simple and easy to access, record and display other data relevant to the play of the game. These include means for accommodating a "customer-tracking-card" which reads each player's account information from a magnetic stripe on the card, thus providing access to the player's customer data file stored on the casino's computer system and one or more alphanumeric keyboards and LCD displays used to enter and retrieve player and game information. Also included are keyboards on the game table so that each player can individually select various playing or wagering options using their own keyboard.

99 Claims, 17 Drawing Sheets

"Call 21" Keyboard Embedded in Twenty-One Game Table Top
Coupled to Card Dispensing Shoe with Scanner & CPU

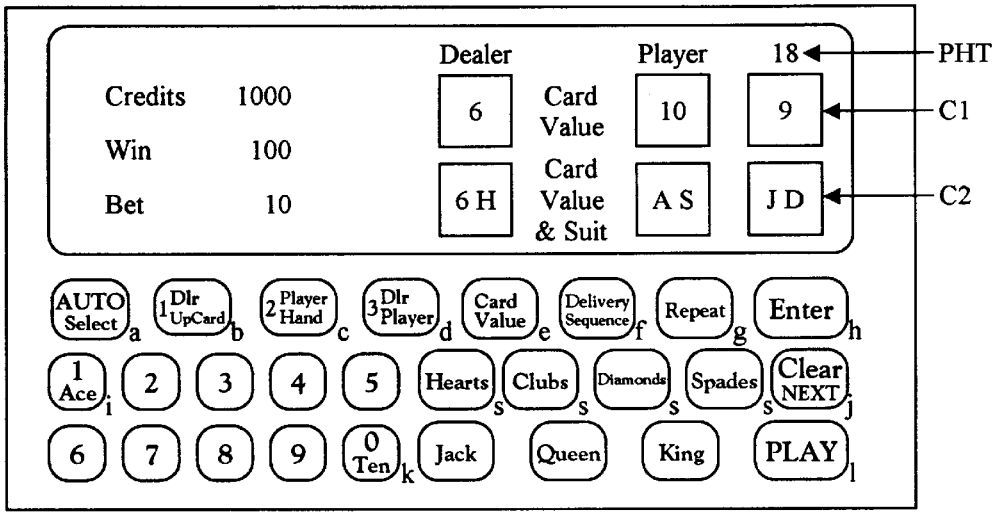

| | | |
|---|---|---|
| C1 | Card Value Display - Dealer Up-card & Player's Original Two Card Hand | |
| C2 | Card Value & Suit Display - Dealer Up-card & Player's Original Two Card Hand | |
| PHT | Players Hand Total - Original Two Card Hand Total projected for the upcoming round | |
| (a) | Auto/Select | Toggle Key - When lit the game selections will be randomly selected for the player by the game software's random number generator from the cards remaining in the shoe to be dealt to the game players. |
| (b) | 1/Dlr/Up-Card | Wager on Dealer's Up-Card |
| (c) | 2/Player/Hand | Wager on Player's Original Two Card Hand |
| (d) | 3/Dlr/Player | Wager on Dealer's Up-Card & Player's Original Two Card Hand |
| (e) | Card Value | Select Card Value for type of wager made; (b), (c) or (d) |
| (f) | Delivery Sequence | Wager Delivery Sequence of first two cards dealt to player's hand |
| (g) | Repeat | Repeat the wager(s), & game cards entered for the previous round |
| (h) | Enter | Enters the last wager & selection for the next round to be dealt |
| (i) | 1/Ace | Enter a one (1), or an Ace with the Card Value of Eleven (11) |
| (j) | Clear/Next | Clears the last wager, or calls the next LCD display screen |
| (k) | 0/Ten | Selects any game card with a Card Value of ten (10) |
| (l) | Play | Completes and activates the wagering and game card selections made by the player for the next round to be dealt from the shoe |
| (s) | Card Suits | Select suit (Hearts, Clubs, Diamonds, & Spades) of selected Card Value (e) |

Fig. 14

Keyboard 60 *** LCD Display 62

Keyboard 80

Keyboard 81 *** LCD Display 82

Keyboard 84 *** Display 87

Decks Dealt (6)

Percentage of Deck Dealt 0.17%
Card Dealt from Deck 52
Cards Remaining in Deck 260

| Card Values | Hearts | Clubs | Diamonds | Spades |
|---|---|---|---|---|
| Ace | 6 | 6 | 6 | 6 |
| Two | 4 | 4 | 4 | 4 |
| Three | 5 | 5 | 5 | 5 |
| Four | 3 | 3 | 3 | 3 |
| Five | 6 | 6 | 6 | 6 |
| Six | 6 | 6 | 6 | 6 |
| Seven | 4 | 4 | 4 | 4 |
| Eight | 5 | 5 | 5 | 5 |
| Nine | 6 | 6 | 6 | 6 |
| Ten | 5 | 5 | 5 | 5 |
| Jack | 4 | 4 | 4 | 4 |
| Queen | 6 | 6 | 6 | 6 |
| King | 5 | 5 | 5 | 5 |

Fig. 19

CARD DISPENSING SHOE WITH SCANNER APPARATUS, SYSTEM AND METHOD THEREFOR

RELATED APPLICATION

This application is a continuation-in-part application to the patent application, application Ser. No. 08/543,908, filed in the United States Patent Office on Oct. 17, 1995, entitled "CARD DISPENSING SHOE WITH SCANNER" now U.S. Pat. No. 5,722,893, disclosure of which is hereby incorporated into this patent application by reference thereto.

COPYRIGHT AUTHORIZATION

A portion of the disclosure of this patent application document contains material which is subject to copyright protection. The copyright owner has no objection to the facsimile reproduction by anyone of the patent application document or the patent disclosure, as it appears in the U.S. Patent and Trademark Office patent file or records, but otherwise reserves all copyright rights whatsoever.

BACKGROUND OF THE INVENTION

1. Field of the Invention

This invention relates to improvements in card dealing apparatus, methods and systems and, more particularly, to an apparatus method and system involving a shoe used to hold a deck of cards which allows the card values to be identified by an integral scanner as the cards are dealt one-by-one from the shoe, with the resulting information being supplied to a computer system and software which identifies card count systems or strategies employed by the players receiving cards from the shoe.

2. Description of the Related Art

Shoes used for delivering cards have been known and used for a number of years in the past. In such a shoe, one or more decks of cards are placed in an opening at the top of the shoe during the play of a particular card game such as "21" or "Blackjack" and the shoe is situated near a dealer's station at a card game table. The dealer feeds the cards for delivery to the players at the card game table by manually engaging and forcing the top card of the deck through a feed slot at the front of the shoe. The top card of the deck is then pulled from the deck and delivered or dealt to a game player. In this way, a series of cards are delivered, one-by-one, to the players of the card game at the card game table until the players all have the requisite number of cards to play the game. The shoe is in the view of the dealer and the game players, and neither the players nor the dealer are aware of any of the cards value or suit since they are placed face down in the shoe and are not observable while the cards are in the shoe.

While shoes of this type are adequate for delivering cards one-by-one to game players of a card game, there is room for improvement, especially if there are to be checks made on the play of the game to assure that the cards are not being counted or tracked by professional card count system counters, or that other activities are not being pursued which would affect the profit margin of the casino or the gaming location where the card game is being played.

In 1964, Edward O. Thorp's book; "BEAT THE DEALER—A WINNING STRATEGY FOR THE GAME OF TWENTY ONE", was published and favorably accepted by the public. This book offered the reader basic strategy and card count system decision indices for playing the game of twenty-one. Fundamentally, Mr. Thorp's "BEAT THE DEALER", proved that the game of casino blackjack or twenty-one was not merely a game of chance, but also a game of skill. Subsequent to the publication of Thorp's "BEAT THE DEALER" many other books have been written and published by other authors detailing recommended decision indices for basic strategies and/or card count systems to be used by the reader when playing the casino card game of twenty-one. Many individuals who purchased, read, studied and implemented the card count system strategies detailed in these books soon became expert enough to play and beat the game of twenty-one offered by casinos. Those individuals who became expert at one of the basic strategies were able to significantly reduce their losses. Those individual who became expert at one of the card count systems were able to not only significantly reduce their losses; but they also achieved winning results.

Prior to the publication of "BEAT THE DEALER"; one-hundred-percent of twenty-one games dealt in legalized casinos in the United States of America were one and two deck hand decks. As the number of highly skilled card counters grew; most casinos reduced the number of twenty-one games dealt from one and two decks of playing cards, dealt from the dealer's hand, and increased the number to four, six or eight decks of playing cards dealt by hand from a card dispensing shoe.

Also, to offset any advantage a skilled card counter garnered in using a card count system, casinos changed the rules of the game, so that the rules were less favorable to the players. For example, the casinos reduced the deck penetration (the percentage of the deck dealt to the players before shuffling) for twenty-one or Blackjack games, from one-hundred-percent, (100%), to as little as fifty-percent, (50%) deck penetration. Today, it is rare to see any casino using hand decks to deal the game of twenty-one on more than fifty-percent of its twenty-one games and many casino's only deal the game of twenty-one from shoes containing multiple decks of playing cards.

The advent and availability of these card count systems and basic "21" or Blackjack strategies to the gambling public has directly and indirectly resulted in the legalized gaming industry, annually, losing hundreds of millions of dollars in revenue they would otherwise earn from casino twenty-one players who previously played the game using random strategy and personal betting skills. Casino's have also experienced a further loss of revenue from their twenty-one games because the reduced deck penetration results in the dealer having to shuffle the decks of cards more frequently; thereby reducing the number of hands a dealer can deal per hour; thereby reducing the total amount of bets made at the game table on which a casino's "Theoretical Win" is based. (A casino's "Theoretical Win", or house advantage, for the game of twenty-one is normally projected at one-percent, (1%), of the total amount of money bet by the players during the course of the play.) A twenty-one player who plays one or more of the published basic strategies at a proficiency of one-hundred-percent, (100%), will reduce the casino's "Theoretical Win" to approximately one-half-percent, (0.5%), and a twenty-one player who plays one or more of the published card count systems at a proficiency of one-hundred-percent, (100%), can obliterate the casino's "Theoretical Win" by reducing it to a negative percent, or an advantage to the highly skilled card counting player that may range from approximately one-half-percent, (0.5%), to more than three percent, (3%).

Casinos use the "Theoretical Win" to calculate each casino's projected win, or earning potential, from each individual twenty-one player who, in theory, usually makes random strategy and betting decisions during the play of the game. Each player's projected earning potential is then broken down into the player's projected loss per hour, day, or trip to the casino, and each player's complimentary value or complimentary equivalency. A casino twenty-one player's or customer's complimentary equivalency is identified as a percent, usually fifty-percent (50%), of the customer's earning potential, or customer's projected loss to the casino. A casino twenty-one player or customer's complimentary equivalency is further identified as the maximum dollar value of gratuities, (free room, food, beverages, and etc.), that a casino determines it may grant to a customer and still generate a profit to the casino from that customer.

The formulae used by casino to calculate a twenty-one player's earning potential and subsequent complimentary equivalency is:

Days/Stay×Hours Played per Day×Hands Played per Hour×Average Bet per Hand=Total Amount Bet per Trip Total Amount Bet per Trip×Theoretical Win (1.0%)= Customer's Projected Loss per Trip or Earning Potential, the Casino's "Theoretical Win" per customer's trip.

Customer's Projected Loss per Trip×50.0%= Complimentary Equivalency Using values of 2 days stay, 4 hours played per day, 75 hands played per hour and $100.00 average bet per hand in the above formulae results in;

2×4×75×$100.00=$60,000.00 Total Amount Bet Per Trip $60,000,00×1.0%=$600.00 Projected Customer's Loss per Trip, Or Earning Potential, The Casino's "Theoretical Win" Per Trip $600.00×50.0%=$300 Projected Complimentary Equivalency The above Theoretical Win per trip can also be converted to an average daily or hourly value:

$600.00×8 (total hours of gambling)=$75.00 Projected Customer's Loss Per Hour, Or Earning Potential, Or The Casino's "Theoretical Win" In Dollars Per Hour $600.00/2 (days of gambling)=$300.00 Projected Customer's Loss Per Day, Or Earning Potential, Or The Casino's "Theoretical Win" In Dollars Per Day.

Over the years, in an attempt to minimize a casino's losses to skilled basic strategy and card count system players of the game of twenty-one, casinos have attempted to train their employees, and have them become expert, in one or more of the same basic strategies or card count systems. Using this expertise, the employees are expected to be able to identify those casino twenty-one customers who are expert basic strategy players or card counters during their real playing time. Empirically; and realistically casino employees have proven to be less than competent in determining each player's precise basic strategy and/or card counting decision and betting strategy skills during this real time; and subsequently implementing appropriate counter measures, if any are required, and/or providing a more accurate means of determining a skilled players earning potential or complimentary equivalency.

Recently some casinos have been using software programs to evaluate and compare casino twenty-one players strategy decision and/or betting skills to one or more card count systems or basic strategy decision indices. These evaluations are normally conducted after-the-fact by having a computer data entry operator, who observes the twenty-one game to be evaluated by means of a VCR recording made of the game when it was played, enter the cards dealt to the dealer and the players for each hand played during a round of twenty-one, record the amount bet on each players hand, when known, and record the player's playing and/or betting decisions on each hand played during a round of twenty-one. Using this method, a twenty-one players playing strategy proficiency at one or more basic strategies and card count systems programmed into the software application can be accurately determined by having the computer program compare each players playing strategy decisions to the recommended true count decision indices for each of the card count systems, and the recommended decision indices for each players hand total for each of the basic strategies programmed into the software. Each players betting proficiency for each of the card count systems programmed into the software can also be determined by comparing the players increase or decrease in his/her bets relative to each card count systems true count for the deck(s) being dealt at the beginning of each round prior to the delivery of the first card to the players for the current game round to be played. (No betting strategy proficiency is calculated for any basic strategy. A basic strategy system does not include or calculate a running or true count, or recommend a specific betting unit to be bet for any specific round during the course of the play of the game as card count systems do.)

However, it has proved to be almost impossible to accurately determine the amount of the players bets for each hand played when the amount of the bets entered for the evaluated twenty-one game are determined by viewing a VCR recording, or a casino's surveillance tapes, of the game to be evaluated. This is true because the vast majority of casino twenty-one games are recorded using an overhead camera view and the value of the bets made by each player cannot be determined with any great degree of accuracy from the overhead position when the player's bet is in the form of a vertical, (in line), stack of two or more gaming chips.

Therefore, a need exists to provide a casino, during real time, with an improved means of identifying and recording, with one-hundred-percent, (100%), accuracy, a twenty-one player's strategy skills, his/her betting skills, and the precise amounts each individual twenty-one player bets each hand during the course of a game thereby allowing the casino to use actual dollar amounts bet per player when using the "Theoretical Win" to more precisely calculate each players earning potential and complimentary equivalency.

The present invention has the advantages of allowing the dealer of the game, who has an unobstructed view of the game cards and the bets made by the game players, to record each player's playing strategy decisions: Insurance, Surrender, Stand, Double Down, and Split (Hit decisions are recorded by the CPU) and the amounts bet on each player's hand for the current round, (the dealer can, if necessary, physically reach out and count the gaming chips or cash money bet on a hand to identify and record during real time the exact amount of the bet made for each hand or seat for the current game round), and the shoe's scanner, transmitting the value of the cards dealt to each player's hand to the CPU's software program as the cards are removed from the shoe, will eliminate those errors currently experienced by "21" evaluation program data entry operators who manually input the game card values; i.e. (when the dealer of the evaluated game does not spread each players games cards in a manner that all of the game cards are not readable by the data entry operator obtaining the game data from a VCR recording of the game being evaluated), thereby generating an accurate, real time, evaluation of a twenty-one player's basic strategy, card counting, and betting skills.

Additionally, the present invention will provide a innovative means for calculating each twenty-one player's "True Worth", or real earning potential and complimentary equivalency, based on each player's advantage or disadvantage over the house when playing one or more basic strategies, or card count systems at a specific proficiency. This is done by coupling the shoe of the present invention to a software program designed to evaluate the strategy and betting skills of casino blackjack players during their actual play, and to calculate each player's earning potential and complimentary equivalency based, not on a casino's "Theoretical Win" or advantage over the player, but on a player's advantage or disadvantage over the house when playing one or more basic strategies, or card count systems at a specific proficiency.

SUMMARY OF THE INVENTION

The primary object of the present invention is to provide an improved shoe apparatus, method and system for delivery and tracking of cards from one or more decks of playing cards situated in the shoe wherein the shoe has a scanner for scanning the value and suit of the cards as they are delivered one-by-one by the dealer out of the shoe to the game players of a card game whereby the trend of the game and the skill of the players in playing the game cards, relative to a twenty-one or Blackjack basic strategy or card count system, can be sensed and determined by analyses of the cards removed from the deck and the play of the cards so that winning tactics used by one or more game players can be identified and remedied by appropriate action such as a change in the rules of the game, a reduction in the deck penetration or the amount of cards dealt from the shoe before shuffling, and/or imposing betting restrictions on individual players of the game and etc.

Another object of the present invention is to provide a casino, during real time, with an improved apparatus, method, system and means of identifying and recording, with one-hundred-percent, (100%), accuracy, a twenty-one player's strategy skills, his/her betting skills, and the precise amounts each individual twenty-one player bets each hand during the course of a game, thereby allowing the casino to use actual dollar amounts bet per player when using the "Theoretical Win", to calculate each player's earning potential and complimentary equivalency.

Still another object of the present invention is to provide an improved apparatus, method and system for calculating each twenty-one player's "True Worth", or real earning potential and complimentaiy equivalency, based on each player's advantage or disadvantage over the house when a player is identified as playing one or more basic strategies, or card count systems at a specific proficiency.

Other objects of the present invention will become apparent as the following specifications progresses, reference being had to the accompanying drawings for an illustration of the invention.

BRIEF DESCRIPTION OF THE PREFERRED EMBODIMENTS

In the present invention, an apparatus, system and method is disclosed which provides an improved shoe for delivery and tracking of cards from one or more decks of playing cards situated in the shoe wherein the shoe has a scanner for scanning the value and suit of the cards as they are delivered one-by-one by the dealer out of the shoe and to the game players of a card game. The present invention provides an apparatus, system and method whereby the trend of the game and the skills of each of the players in playing their game cards, relative to a basic strategy or card count system, can be sensed and determined by analyses of the cards removed from the deck and the play of the cards by each player so that winning tactics used by one or more game players can be ascertained and appropriately remedied.

Additionally, the present invention provides a casino, during real time, with an improved apparatus, method, system and means of identifying and recording, with one-hundred-percent, (100%), accuracy, a twenty-one player's strategy skills, his/her betting skills, and the precise amounts each individual twenty-one player bets each hand during the course of a game thereby allowing the casino to use actual dollar amounts bet per player when using the "Theoretical Win" to calculate each player's earning potential and complimentary equivalency.

And finally, the present invention provides an apparatus, method and system for also calculating each twenty-one player's "True Worth", or real earning potential and complimentary equivalency, based on each player's advantage or disadvantage over the house when playing one or more basic strategies, or card count systems at a specific proficiency.

The above features of the present invention are achieved with the improved apparatus, method and system which utilizes a card dispensing shoe with scanner and it's associated software which enable the card dealer when dealing the game from a card dispensing shoe with scanner preferably placed on a game table where the twenty-one game to be evaluated by the software is being played, to use one or more keyboard(s) and/or LCD displays coupled to the shoe to identify for the computer program the number of the active player's seats, or active players, including the dealer's position relative thereto and their active play at the game table during each game round dealt from the shoe. These keyboards and LCD displays are also used to enter other data relevant to each seat's, or player's, betting and/or decision strategies for each hand played. The data is analyzed by a computer software program designed to evaluate the strategy decisions and betting skills of casino twenty-one, or blackjack players playing the game of blackjack during real time. The evaluation software is coupled to a central processing unit (CPU) or host computer that is also coupled to the shoe's keyboard(s) and LCD displays. The dealer using one or more keyboard(s) attached to or carried by the shoe, or a keyboard(s) located near the dealer is able to see and record the exact amount bet by each player for each hand played for the game to be evaluated. The optical scanner coupled to the CPU reads the value of each card dealt to each player's hand(s) and the dealer's hand as each card is dealt to a specfic hand, seat or position and converts the game card value of each card dealt from the shoe to the players and the dealer of the game to a card count system value for one or more card count systems programmed into the evaluation software. The CPU also records each players decision(s) to hit a hand, and the dealer's decision to hit or take another card when required by the rules of the game, as the hit card is removed from the shoe. The dealer uses one or more of the keyboards and LCD displays carried by the shoe to record each player's decisions(s) to Insure, Surrender, Stand, Double Down, or Split a hand. When the dealer has an Ace or a Ten as an up-card, he/she may use one or more of the keyboards to prompt the computer system's software, since the dealer's second card, or hole-card, which is dealt face down, has been scanned and the game card value thereof has been imported into the computer systems software, to instantly inform the dealer, by means of one or more of the shoes LCDs, if his/her game cards, or hand total, constitutes a two-card "21" or "Blackjack". The accuracy of the data input to the evaluation software program by this means cannot be duplicated using any type of prior art or VCR recording of a twenty-one game previously played and recorded, or currently in progress.

In a preferred embodiment of the present invention a card delivery shoe apparatus for use in dealing playing cards to at least one player for the playing of a card game is disclosed comprising, in combination, housing means having a chute for supporting at least one deck of playing cards for permitting movement of the playing cards one at a time through the chute wherein the housing means has an outlet opening that permits the playing cards of the deck to be moved one-by-one out of the housing means during the play of a card game, card scanning means located within the housing means for scanning indicia located on each of the playing cards as each of the playing cards are moved out from the chute of the housing means and for providing an output indicative of at least one of a card value of each of these playing cards and a suit designation for each of these playing cards, and means for receiving the output of the card scanning means for identifying each of the playing cards received by each player from the shoe apparatus.

In another embodiment of the present invention, a card delivery shoe apparatus for use in dealing playing cards to at least one player for the playing of a card game is disclosed comprising, in combination, housing means having a chute for supporting at least one deck of playing cards for permitting movement of the playing cards one at a time through the chute, the housing means having an outlet opening that permits the playing cards of the deck to be moved one-by-one out of the housing means during the play of a card game, card scanning means located within the housing means for scanning indicia located on each of the playing cards as each of the playing cards are moved out from the chute of the housing means, and means for receiving the output of the card scanning means for identifying each of the playing cards received by each player from the shoe, for evaluating information relative to each player's received playing cards and their values with information as to playing tactics used by each player relative to the values of the received playing cards, and for combining all of this information for identifying each player's playing strategy.

In another embodiment of the present invention, a card delivery shoe apparatus for use in dealing playing cards to at least one player for the playing of a card game is disclosed comprising, in combination, housing means having a chute for supporting at least one deck of playing cards for permitting movement of the playing cards one at a time through the chute, the housing means having an outlet opening that permits the playing cards of the deck to be moved one-by-one out of the housing means during the play of a card game, card scanning means located within the housing means for scanning indicia located on each of the playing cards as each of the playing cards are moved out from the chute of the housing means, and means for receiving the output of the card scanning means for identifying such of the playing cards received by each player from the shoe apparatus, for evaluating information relative to each player's received playing cards and their values with information as to betting tactics used by each player relative to playing cards previously dealt out from the shoe apparatus providing card count information, and for combining all of this information for identifying each player's card count strategy.

In another embodiment of the present invention, a card delivery shoe apparatus for use in dealing playing cards to at least one player for the playing of a card game is disclosed comprising, in combination, housing means having a chute for supporting at least one deck of playing cards for permitting movement of the playing cards one at a time through the chute, the housing means having an outlet opening that permits the playing cards of the deck to be moved one-by-one out of the housing means during the play of a card game, card scanning means located within the housing means for scanning indicia located on each of the playing cards as each of the playing cards are moved out from the chute of the housing means, and means for receiving the output of the card scanning means for identifying each of the playing cards received by each player from the shoe apparatus, for evaluating information relative to each player's received playing cards and their values with information as to playing tactics used by each player relative to the values of the received playing cards, for combining use of all of this information for identifying each player's playing strategy, and for also identifying each player's card count strategy based on each player's betting tactics used by each player relative to playing cards previously dealt out from the shoe apparatus providing card count information.

In another embodiment of the present invention, a method for operating a card game which includes a card delivery shoe apparatus for use in dealing playing cards to at least one player for the playing of the card game is disclosed comprising the steps of, providing housing means having a chute for supporting at least one deck of playing cards for permitting movement of the playing cards one at a time through the chute, the housing means having an outlet opening that permits the playing cards of the deck to be moved one-by-one out of the housing means during the play of a card game, providing card scanning means located within the housing means for scanning indicia located on each of the playing cards as each of the playing cards are moved out from the chute of the housing means and for providing an output indicative of at least one of a card value of each of these playing cards and a suit designation for each of these playing cards, and providing means for receiving the output of the card scanning means for identifying each of the playing cards received by each player from the shoe apparatus.

In another embodiment of the present invention, a method for operating a card game which includes a card delivery shoe apparatus for use in dealing playing cards to at least one player for the playing of the card game is disclosed comprising the steps of, providing housing means having a chute for supporting at least one deck of playing cards for permitting movement of the playing cards one at a time through the chute, the housing means having an outlet opening that permits the playing cards of the deck to be moved one-by-one out of the housing means during the play of a card game, providing card scanning means located within the housing means for scanning indicia located on each of the playing cards as each of the playing cards are moved out from the chute of the housing means, and providing means for receiving the output of the card scanning means for identifying each of the playing cards received by each player from the shoe, for evaluating information relative to each player's received playing cards and their values with information as to playing tactics used by each player relative to the values of the received playing cards, and for combining all of this information for identifying each player's playing strategy.

In another embodiment of the present invention, a method for operating a card game which includes a card delivery shoe apparatus for use in dealing playing cards to at least one player for the playing of the card game is disclosed comprising, in combination, providing housing means having a chute for supporting at least one deck of playing cards for permitting movement of the playing cards one at a time through the chute, the housing means having an outlet opening that permits the playing cards of the deck to be moved one-by-one out of the housing means during the play of a card game, providing card scanning means located within the housing means for scanning indicia located on each of the playing cards as each of the playing cards are moved out from the chute of the housing means, and providing means for receiving the output of the card scanning means for identifying such of the playing cards received by each player from the shoe apparatus, for evaluating information relative to each player's received playing cards and their values with information as to betting tactics used by each player relative to playing cards previously dealt out from the shoe apparatus providing card count information, and for combining all of this information for identifying each player's card count strategy.

In another embodiment of the present invention, a method for operating a card game which includes a card delivery shoe apparatus for use in dealing playing cards to at least one player for the playing of the card game is disclosed comprising, in combination, providing housing means having a chute for supporting at least one deck of playing cards for permitting movement of the playing cards one at a time through the chute, the housing means having an outlet opening that permits the playing cards of the deck to be moved one-by-one out of the housing means during the play of a card game, providing card scanning means located within the housing means for scanning indicia located on each of the playing cards as each of the playing cards are moved out from the chute of the housing means, and providing means for receiving the output of the card scanning means for identifying each of the playing cards received by each player from the shoe apparatus, for evaluating information relative to each player's received playing cards and their values with information as to playing tactics used by each player relative to the values of the received playing cards, for combining use of all of this information for identifying each player's playing strategy, and for also identifying each player's card count strategy based on each player's betting tactics used by each player relative to playing cards previously dealt out from the shoe apparatus providing card count information.

In another embodiment of the present invention, a card playing system for playing a card game which includes a card delivery shoe apparatus for use in dealing playing cards to at least one player for the playing of the card game is disclosed comprising, in combination, housing means having a chute for supporting at least one deck of playing cards for permitting movement of the playing cards one at a time through the chute, the housing means having an outlet opening that permits the playing cards of the deck to be moved one-by-one out of the housing means during the play of a card game, card scanning means located within the housing means for scanning indicia located on each of the playing cards as each of the playing cards are moved out from the chute of the housing means and for providing an output indicative of at least one of a card value of each of these playing cards and a suit designation for each of these playing cards, means for receiving the output of the card scanning means for identifying each of the playing cards received by each player from the shoe apparatus, and a playing table coupled to the card delivery shoe apparatus and having at least one keypad means located thereon for permitting at least one player to select at least one of various card playing options to wager upon.

In another embodiment of the present invention, a card playing system for playing a card game which includes a card delivery shoe apparatus for use in dealing playing cards to at least one player for the playing of the card game is disclosed comprising, in combination, housing means having a chute for supporting at least one deck of playing cards for permitting movement of the playing cards one at a time through the chute, the housing means having an outlet opening that permits the playing cards of the deck to be moved one-by-one out of the housing means during the play of a card game, card scanning means located within the housing means for scanning indicia located on each of the playing cards as each of the playing cards are moved out from the chute of the housing means, means for receiving the output of the card scanning means for identifying each of the playing cards received by each player from the shoe, for evaluating information relative to each player's received playing cards and their values with information as to playing tactics used by each player relative to the values of the received playing cards, and for combining all of this information for identifying each player's playing strategy, and a playing table coupled to the card delivery shoe apparatus and having at least one keypad means located thereon for permitting at least one player to select various card playing options to wager upon.

In another embodiment of the present invention, a card playing system for playing a card game which includes a card delivery shoe apparatus for use in dealing playing cards to at least one player for the playing of the card game is disclosed comprising, in combination, housing means having a chute for supporting at least one deck of playing cards for permitting movement of the playing cards one at a time through the chute, the housing means having an outlet opening that permits the playing cards of the deck to be moved one-by-one out of the housing means during the play of a card game, card scanning means located within the housing means for scanning indicia located on each of the playing cards as each of the playing cards are moved out from the chute of the housing means, means for receiving the output of the card scanning means for identifying such of the playing cards received by each player from the shoe apparatus, for evaluating information relative to each player's received playing cards and their values with information as to betting tactics used by each player relative to playing cards previously dealt out from the shoe apparatus providing card count information, and for combining all of this information for identifying each player's card count strategy, and a playing table coupled to the card delivery shoe apparatus and having at least one keypad means located thereon for permitting the at least one player to select at least one of various card playing options to wager upon.

In a final embodiment of the present invention, a card playing system for playing a card game which includes a card delivery shoe apparatus for use in dealing playing cards to at least one player for the playing of a card game is disclosed comprising, in combination, housing means having a chute for supporting at least one deck of playing cards for permitting movement of the playing cards one at a time through the chute, the housing means having an outlet opening that permits the playing cards of the deck to be moved one-by-one out of the housing means during the play of a card game, card scanning means located within the housing means for scanning indicia located on each of the playing cards as each of the playing cards are moved out from the chute of the housing means, means for receiving the output of the card scanning means for identifying each of the playing cards received by each player from the shoe apparatus, for evaluating information relative to each player's received playing cards and their values with information as to playing tactics used by each player relative to the values of the received playing cards, for combining use of all of this information for identifying each player's playing strategy, and for also identifying each player's card count strategy based on each players betting tactics used by each player relative to playing cards previously dealt out from the shoe apparatus providing card count information, and a playing table coupled to the card delivery shoe apparatus and having at least one keypad means located thereon for permitting the at least one player to select at least one of various card playing options to wager upon.

The foregoing and other objects, features, and advantages of the invention will be apparent from the following, more particular, description of the preferred embodiments of the invention, as illustrated in the accompanying drawings.

BRIEF DESCRIPTION OF THE DRAWINGS

FIG. 14 is a detailed view of the Call-21 game keyboard embedded in the game table.

FIG. 19 is a view of the Deck Status Report printed by the software.

DESCRIPTION OF THE PREFERRED EMBODIMENTS

Card Dispensing Shoe with Scanner: Basic Embodiment

Figure 1:
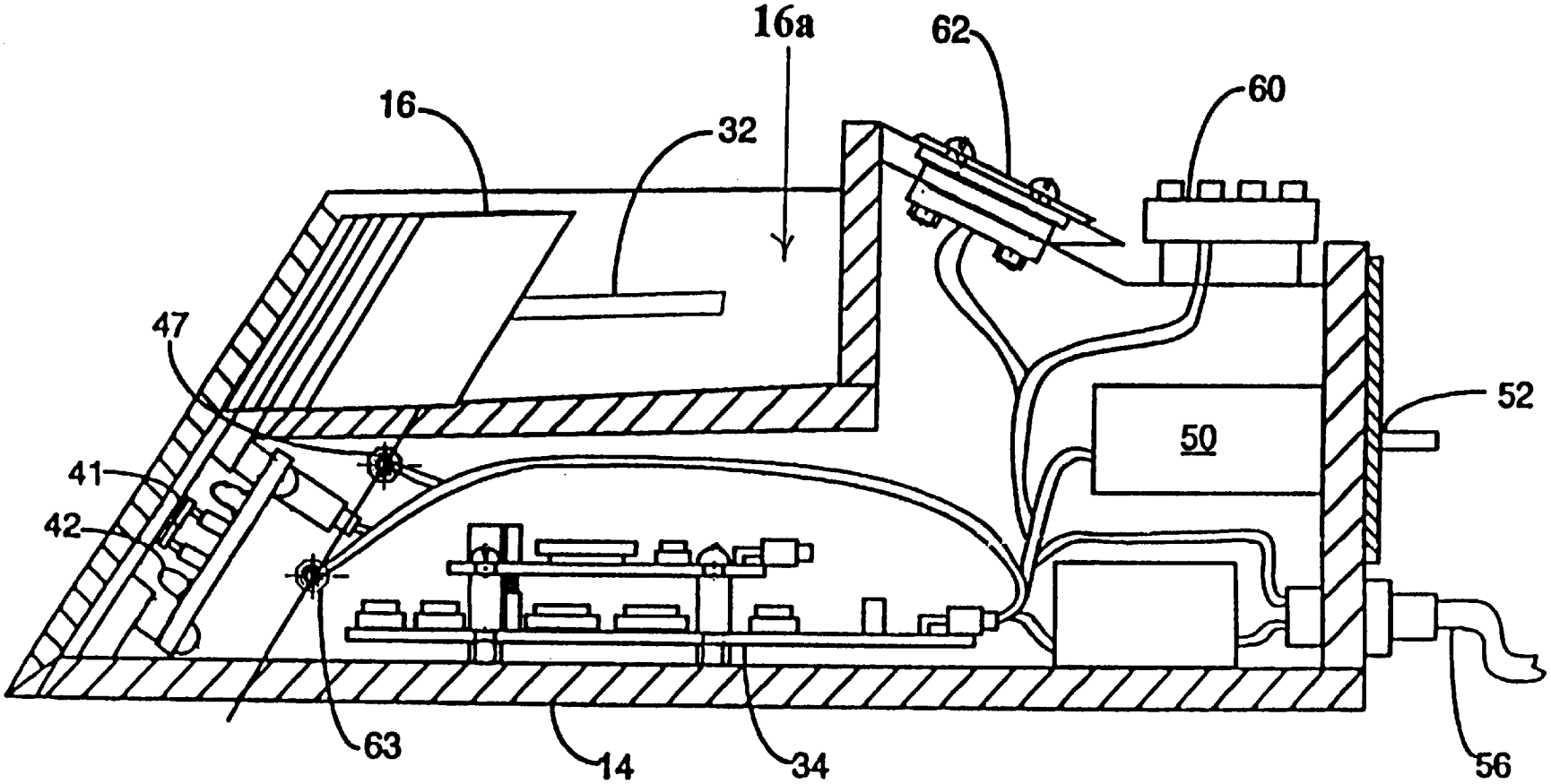
FIG. 1 is a vertical section taken along line 1—1 of FIG. 3.
Figure 2:
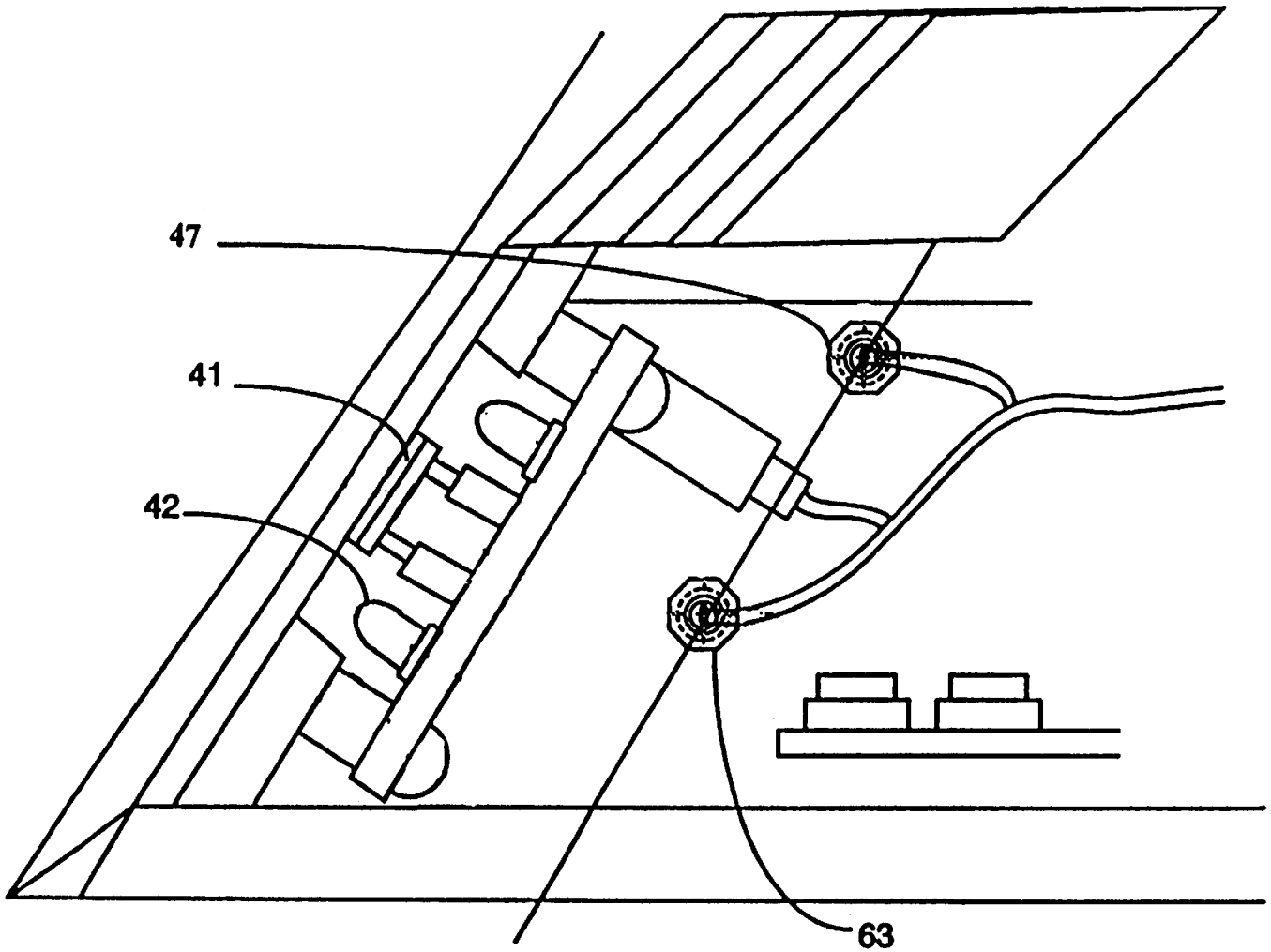
FIG. 2 is a close-up enlarged view of a portion of FIG. 1.
Figure 3:
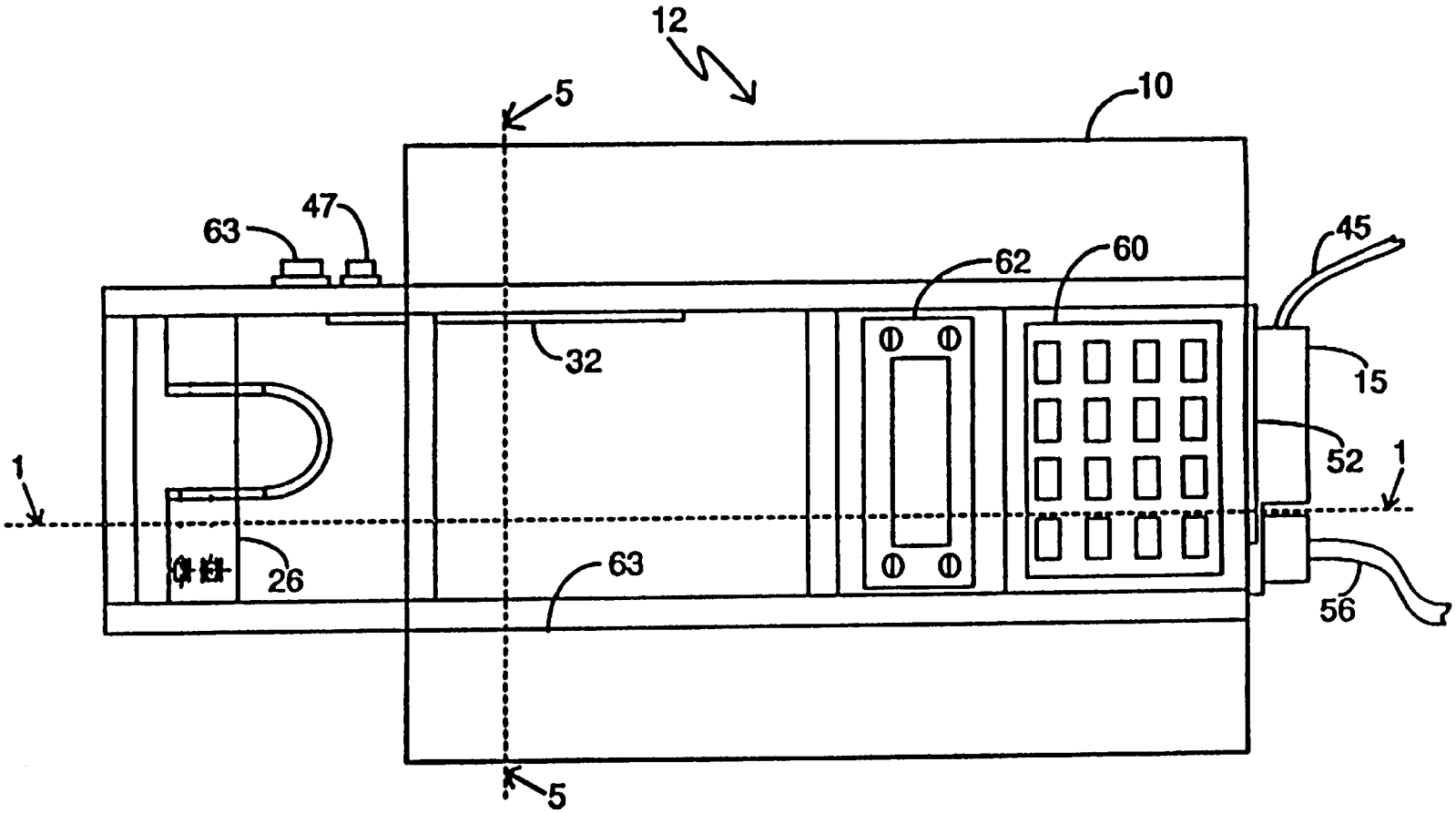
FIG. 3 is a top plan view of the Card Dispensing Shoe with Scanner of this invention.
Figure 4:
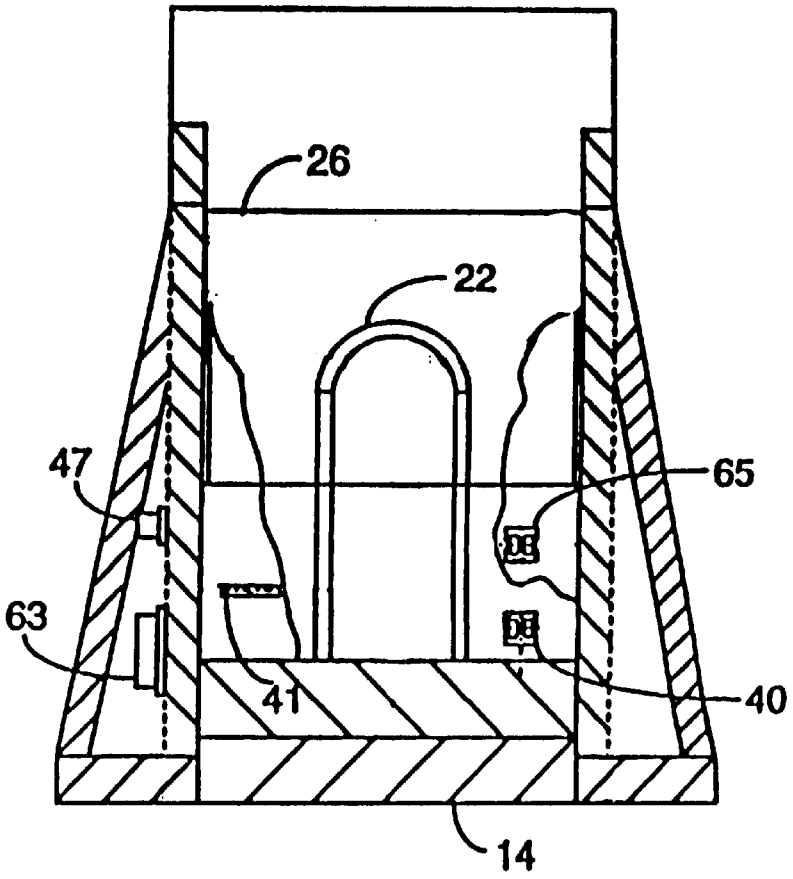
FIG. 4 is a front elevation view of the shoe of FIG. 3, showing the delivery under the shoe.
Figure 5:
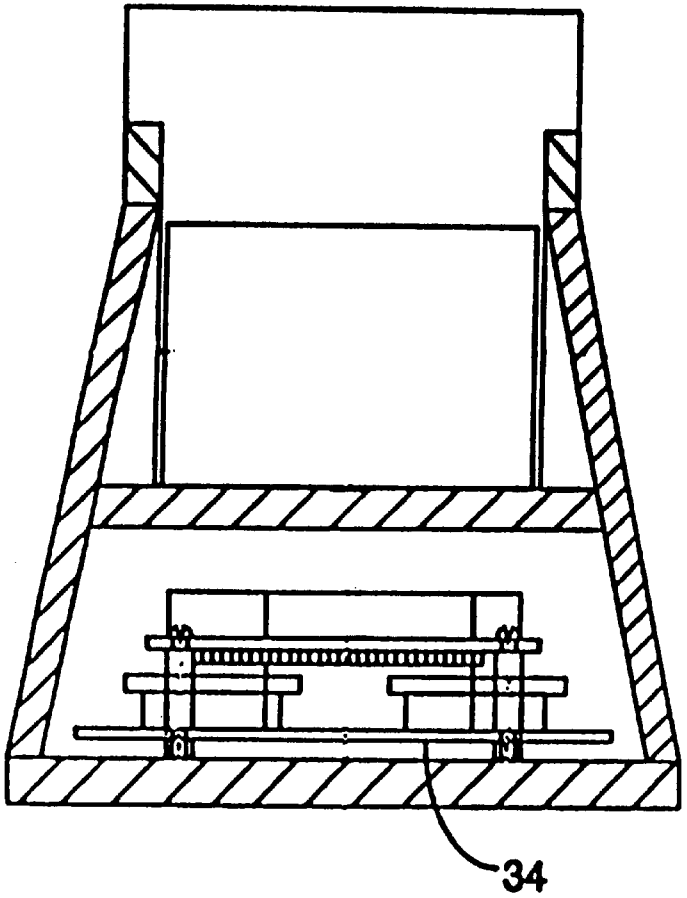
FIG. 5 is a front vertical section taken along line 5—5 of FIG. 3.

Referring generally to FIGS. 1–5, The Card Dispensing Shoe with Scanner Apparatus, System and Method is shown from different aspects and FIGS. 1, 2, and 5 are depicted in cut away views.

Figure 7:
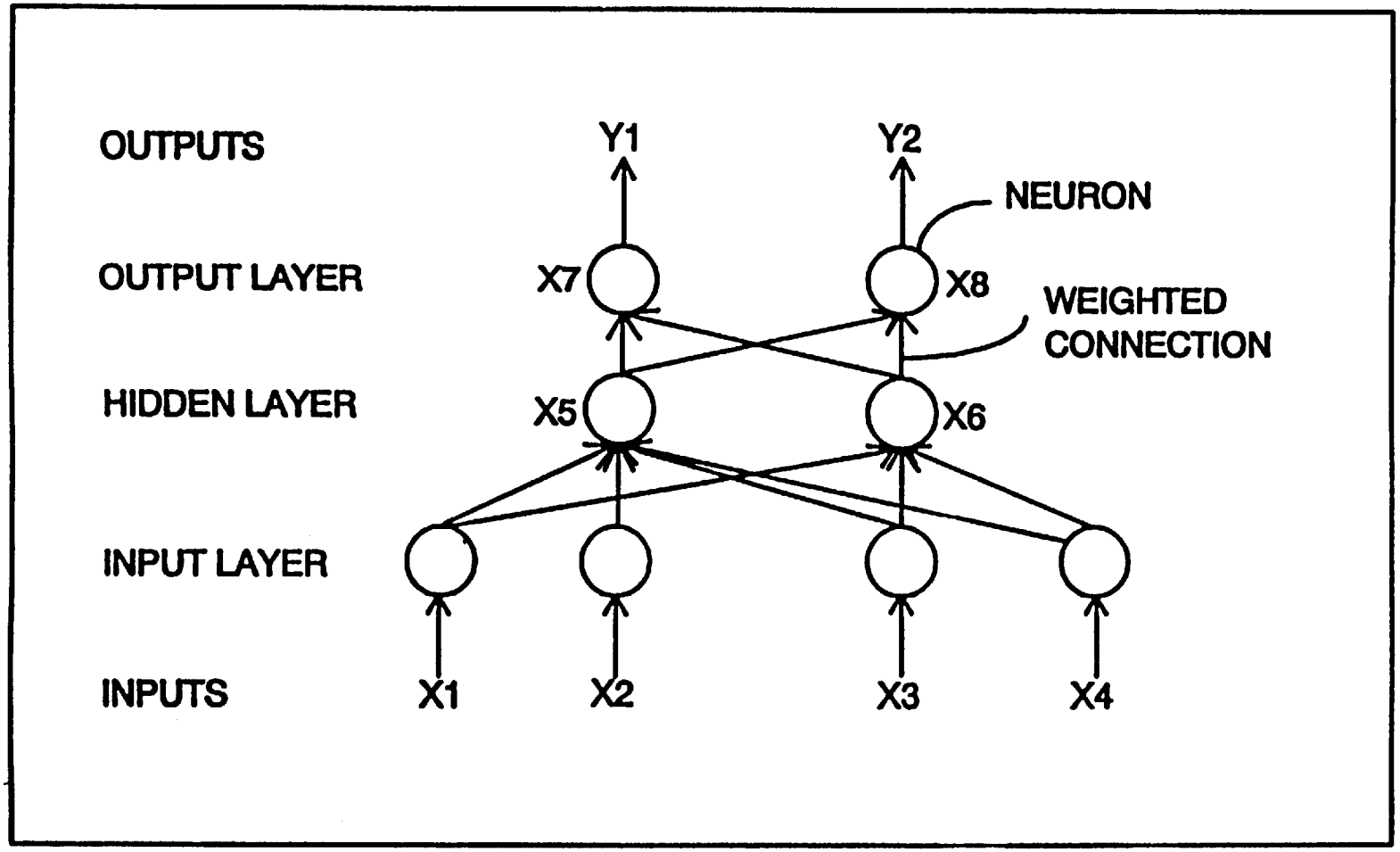
FIG. 7 is a schematic view of a 3-layer feed forward multi-layer perception.
Figure 8:
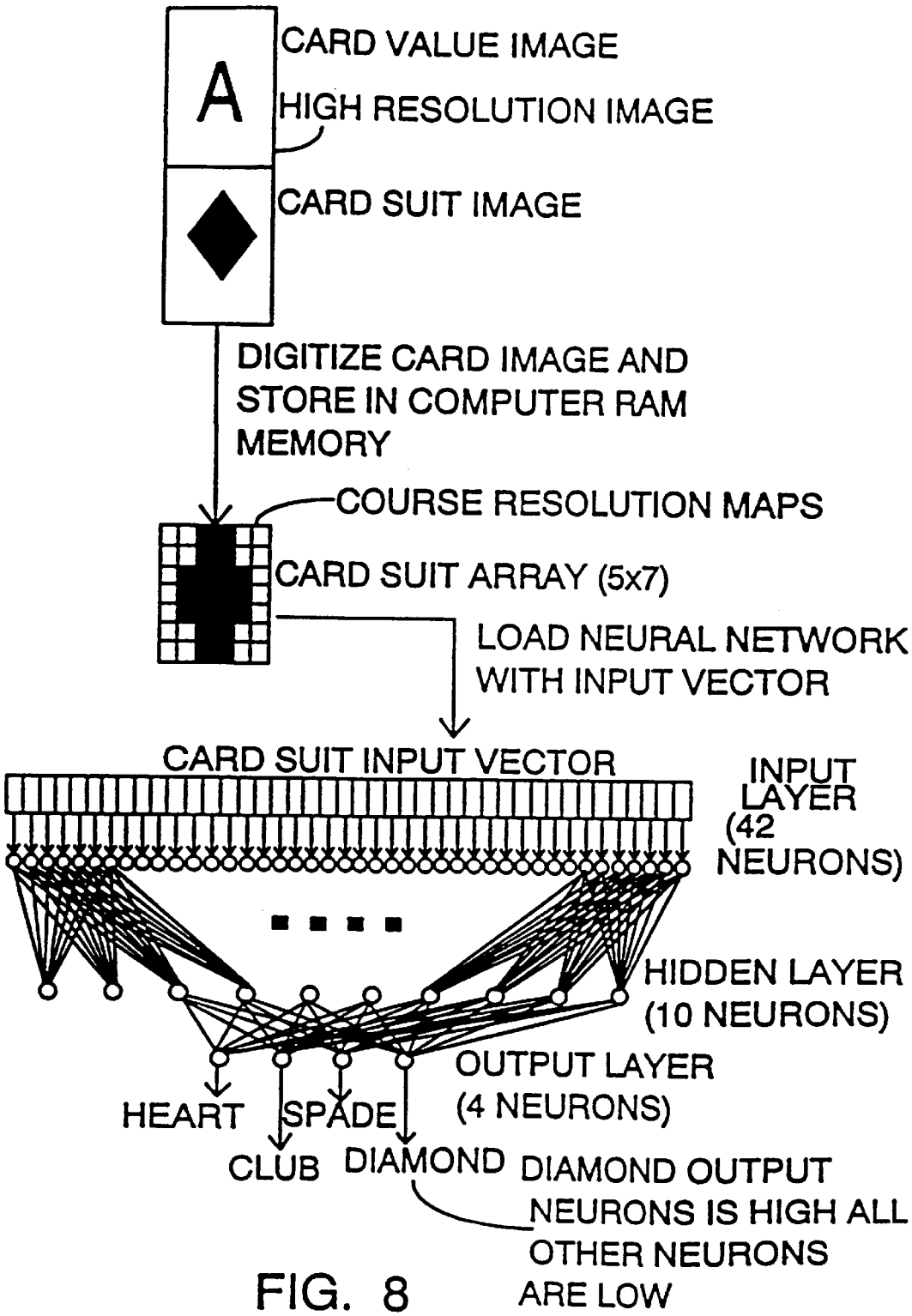
FIG. 8 is a schematic view of the feed forward neural networks for card suit identification.
Figure 9:
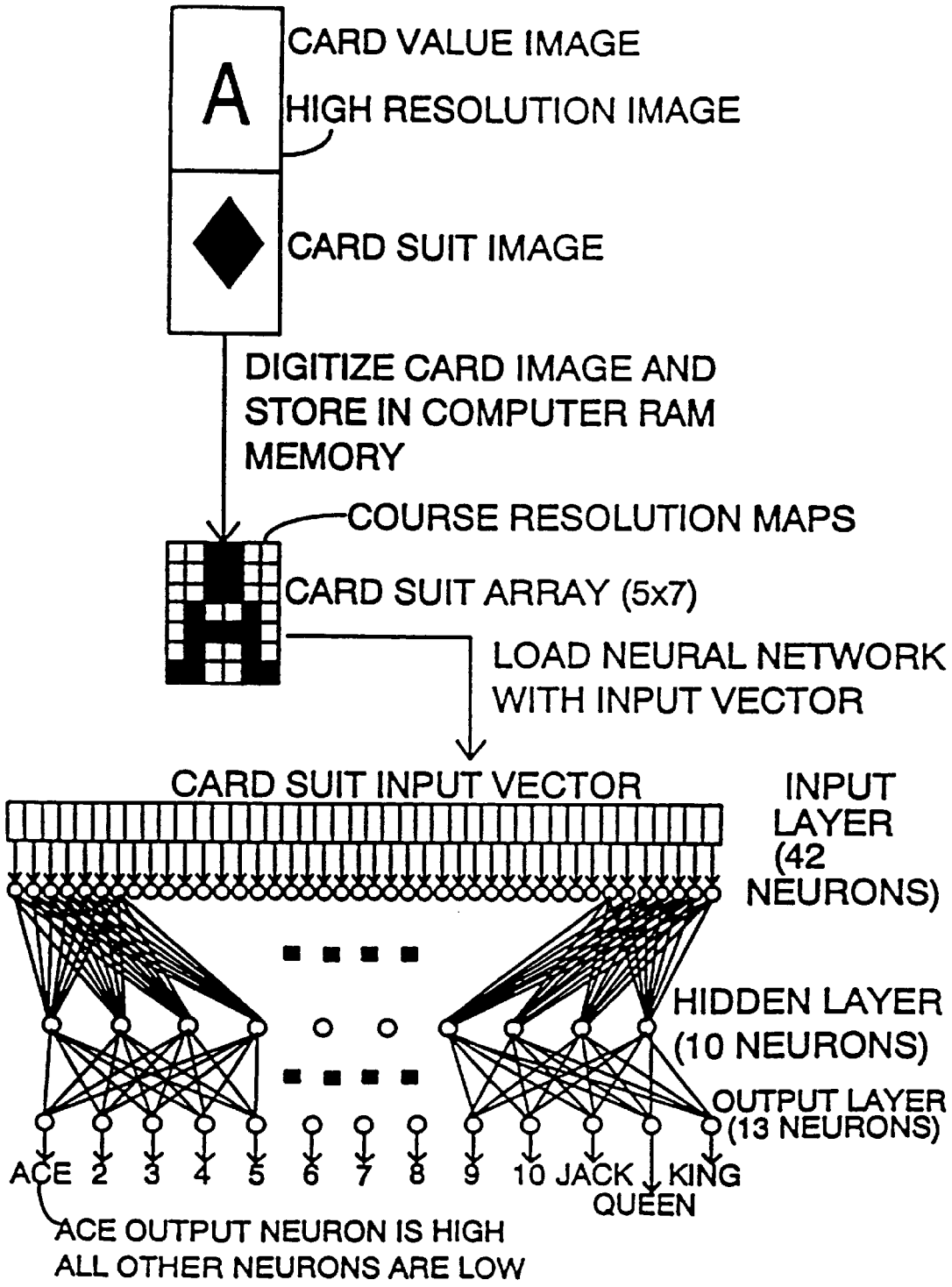
FIG. 9 is a schematic view of the feed forward neural networks for card value identification.

Referring to FIG. 3, the card delivery shoe (shoe 10 hereinafter) is formed of a container or housing 12 which has a lower surface 14 (FIGS. 1 & 4) designed to rest and be supported on a game table or other flat surface. The shoe 10 is a conventional card game shoe in that it has a means for supporting a deck or decks of playing cards (deck 16 hereafter) (FIG. 1) in a chute 16*a* (FIGS. 1 & 3). The shoe 10 has an optical sensor or scanner 41 (FIGS. 1, 2 & 4) which is adapted and positioned to determine the card value and the suit of each card as the card dealer slides each card down and out of the chute 16*a* through the slot 22 (FIG. 5) at the front of the shoe 10. The optical sensor 41 (FIGS. 1, 2 & 4) is illuminated with a lamp or bulb 42 (FIGS. 1, 2). A typical optical sensor to be used as a scanner is a "charge mode" 128×1 integrated opto-sensor made by Texas Instruments, part no. TSL215. The optical sensor 41 (FIGS. 1, 2 & 4) used to scan the images of the playing cards is coupled to a neural network (FIGS. 7, 8 & 9) trained to recognize and identify the suit and game card value of each of the playing cards from the deck 16 that are scanned by the optical sensor 41 (FIGS. 1, 2 & 4).

Figure 6:
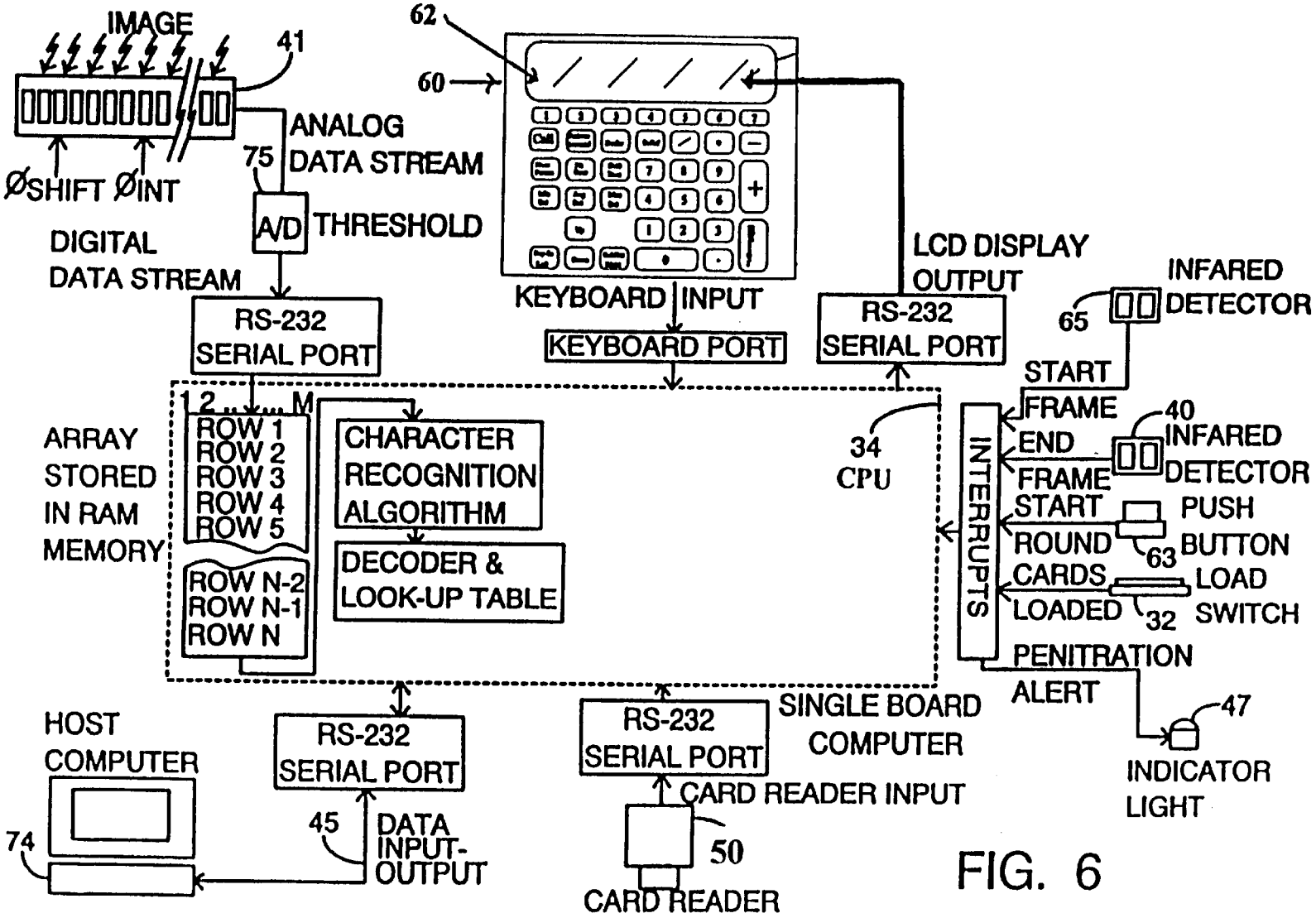
FIG. 6 is one embodiment of the system block diagram of the shoe electronics.

Referring to FIG. 1, the shoe 10 can be made to hold many decks 16 of playing cards, though typically the number of decks 16 is between one to eight decks 16 of playing cards. A transparent window (not shown) can be provided on the right side of the shoe 10 along the chute 16*a* to provide a visual indication of the approximate amount of cards left in the deck 16 being dealt from the shoe 10. Each card deck 16 is placed face down into the open top of the shoe 10 on a 45 degree chute 16*a* which slopes forwardly. A hollow wedge-shaped block housing containing a heavy stainless steel roller (not shown), measuring the full width of the chute 16*a*, is placed behind the decks of cards 16 to force the cards forwardly down the chute 16*a* and flush against a retainer 26 (FIGS. 3 & 4) that forms an opening at the slot 22 (FIGS. 3 & 4) of the shoe 10. The top card of the deck of cards 16 placed in the chute 16*a* is held flush against the retainer 26 (FIGS. 3 & 4) with a portion of its back exposed at the slot 22 (FIGS. 3 & 4) of the shoe 10. The slot 22 (FIGS. 3 & 4) may or may not be covered by a door or brush (not shown) located in the slot 22 (FIGS. 3 & 4). Above and to the far right of the optical sensor 41 (FIGS. 1, 2 & 4) is a start frame sensor 65 (FIG. 4). Also located in the slot 22, below and to the far right of the optical sensor 41 (FIG. 4) is a stop frame sensor 40 (FIG. 4). Also located on the shoe 10 is a game-round, start button 63 (FIGS. 1, 3 & 4) and a deck 16 load switch 32 (FIGS. 1 & 3). Located adjacent to the game-round, start button 63 is a deck penetration alert light 47 (FIGS. 1, 2, 3 & 4). On the rear of the shoe 10 is located a magnetic card reader 50 (FIG. 1) having a slot 52 (FIGS. 1 & 3). A customer-tracking-card 15 (FIGS. 1 & 3) may be utilized with the magnetic card reader 50 (FIGS. 1 & 6). Also at the rear of the shoe is a main power cable 56 (FIGS. 1 & 3), and a Local Area Network (LAN) Port 45 (FIG. 6).

Figure 15:
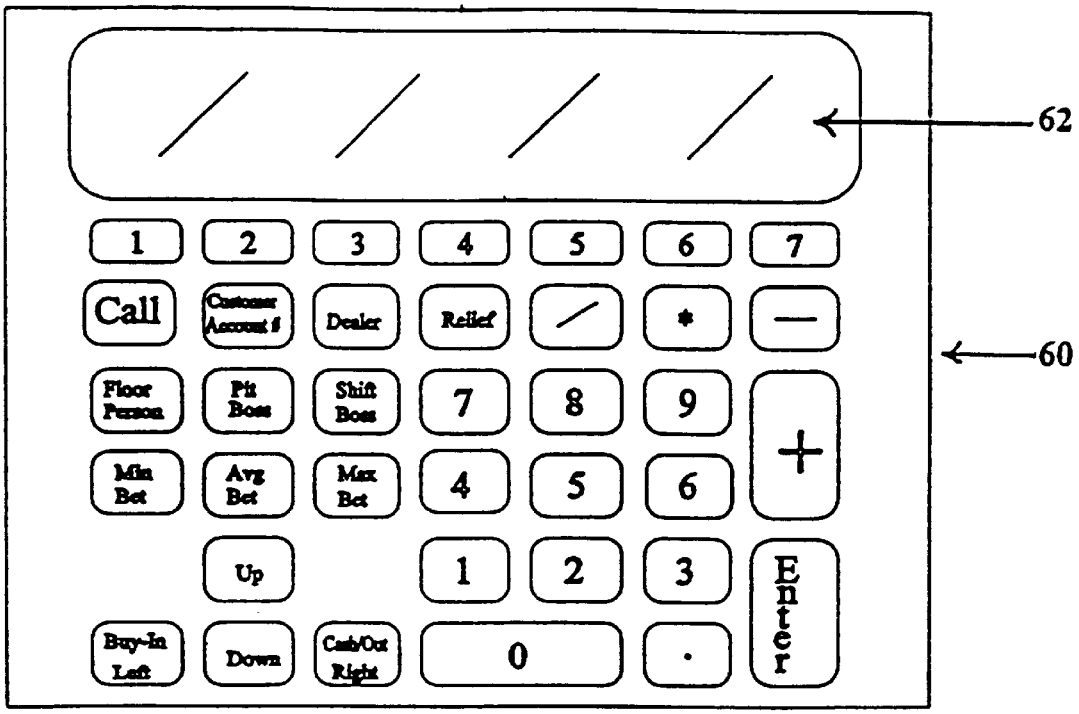
FIG. 15 is a detailed enlarged view of the keyboard 60 and LCD display 62 shown in FIGS. 1, 3 and 6.

On the top of shoe 10 is a LCD (liquid crystal display) display 62 (FIGS. 1 & 3), and a keyboard 60 (FIGS. 1 & 3). Details of the layout of the keyboard 60 and LCD display 62 combination are shown in FIG. 15.

In this embodiment of the present invention, located in the empty space in the base of the shoe 10 is a Central Processing Unit or CPU 34 (FIGS. 1 & 5). The bottom 14 (FIGS. 1 & 4) of the shoe 10 may be transparent to allow visual inspection of the internals. The CPU 34 (FIGS. 1 & 5) is coupled to and interacts with the following: the optical sensor 41 (FIGS. 1, 2 & 4), the start frame sensor 65 (FIG.

4), the stop frame sensor 40 (FIG. 4), the game-round, start button 63 (FIGS. 1, 3 & 4), the load switch 32 (FIGS. 1 & 3), the deck penetration light 47 (FIGS. 1, 2, 3, & 4), the magnetic card reader 50 (FIG. 1), the LCD (liquid crystal display) keyboard display 62 (FIGS. 1 & 3), and the alpha-numeric keyboard 60 (FIGS. 1 & 3).

Referring to FIG. 6, a system block diagram of the shoe electronics in this embodiment is depicted. Central to the diagram is the Central Processing Unit or CPU 34. As shown, the CPU 34 is coupled to the following: the optical sensor 41 via an analog-to-digital converter (A/D) 75, the start frame sensor 65, the stop or end frame sensor 40, the game-round, start button 63, the load switch 32, the deck penetration light 47 (FIGS. 1, 2, 3, & 4), the magnetic card reader 50, the magnetic card reader input 52 the magnetic card reader slot, the LCD (liquid crystal display) keyboard display 62, and the alpha-numeric keyboard 60. Additionally, the CPU 34 is also coupled to a host computer 74. The host computer 74 is coupled via a Local Area Network (LAN) Port 45 to the CPU 34. The term host computer is used in a generic sense herein. Those skilled in the art will recognize that the host computer 74 may be a single computer coupled to the CPU 34 via standard LAN technology, but may also be a computer network comprised of one or more computer network servers or computers, ranging from personal computers up to and including main frame systems.

The CPU 34 processes the input/output data to and from the keyboards, LCD displays and other components that make up the present invention's system's hardware. The CPU 34 operation is controlled and monitored by any desired custom designed computer software. The CPU 34 may call the software from an attached hard drive unit (not shown), or if coupled to a LAN system may call the software from the LAN servers or host computer 74.

Card Dispensing Shoe with Scanner: Alternate Embodiment

Figure 10:
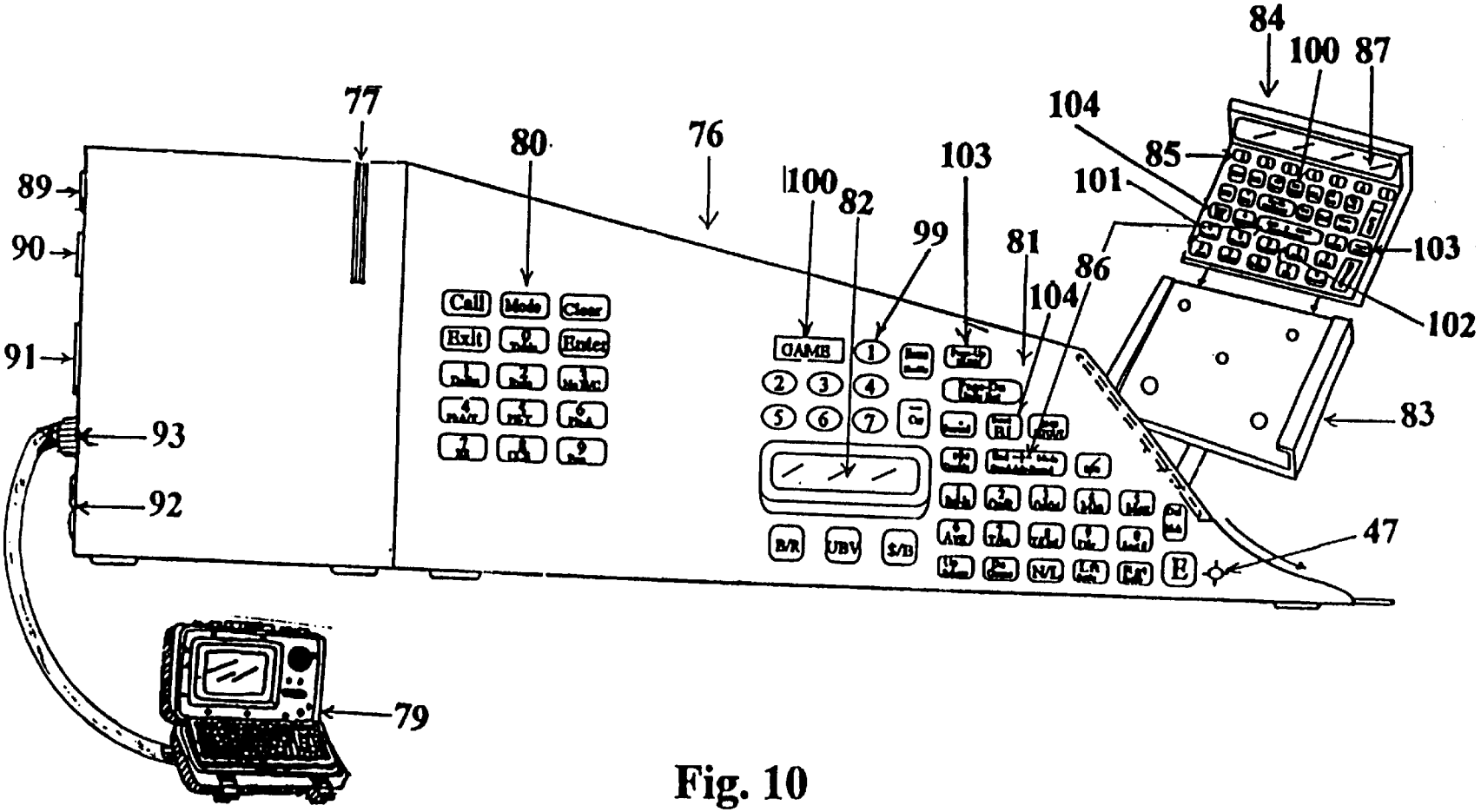
FIG. 10 is a side view of another embodiment of the shoe with an external CPU, and alternative keyboards and LCD displays.
Figure 11:
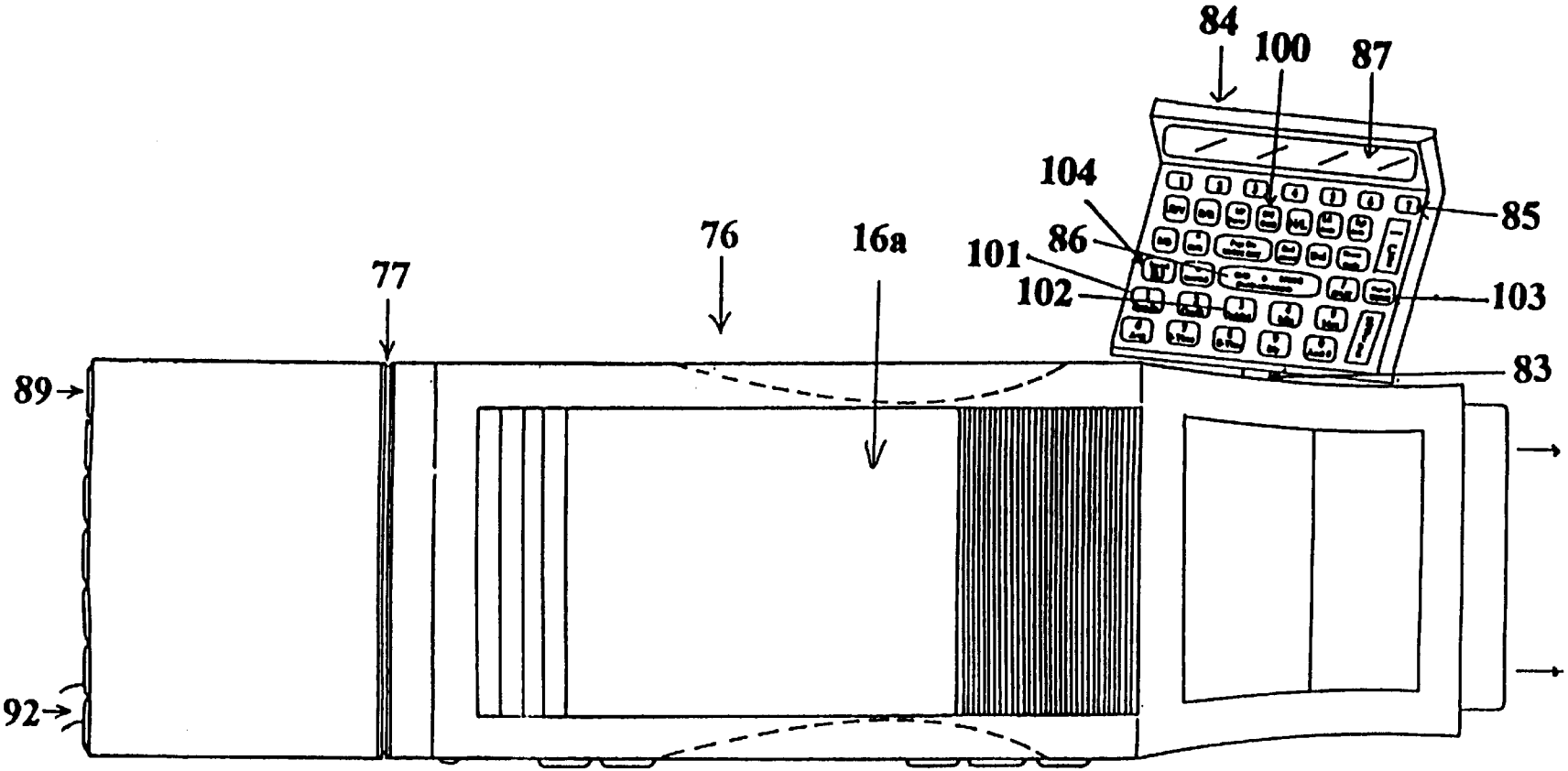
FIG. 11 is a top view of the alternative shoe of FIG. 10.
Figure 12:
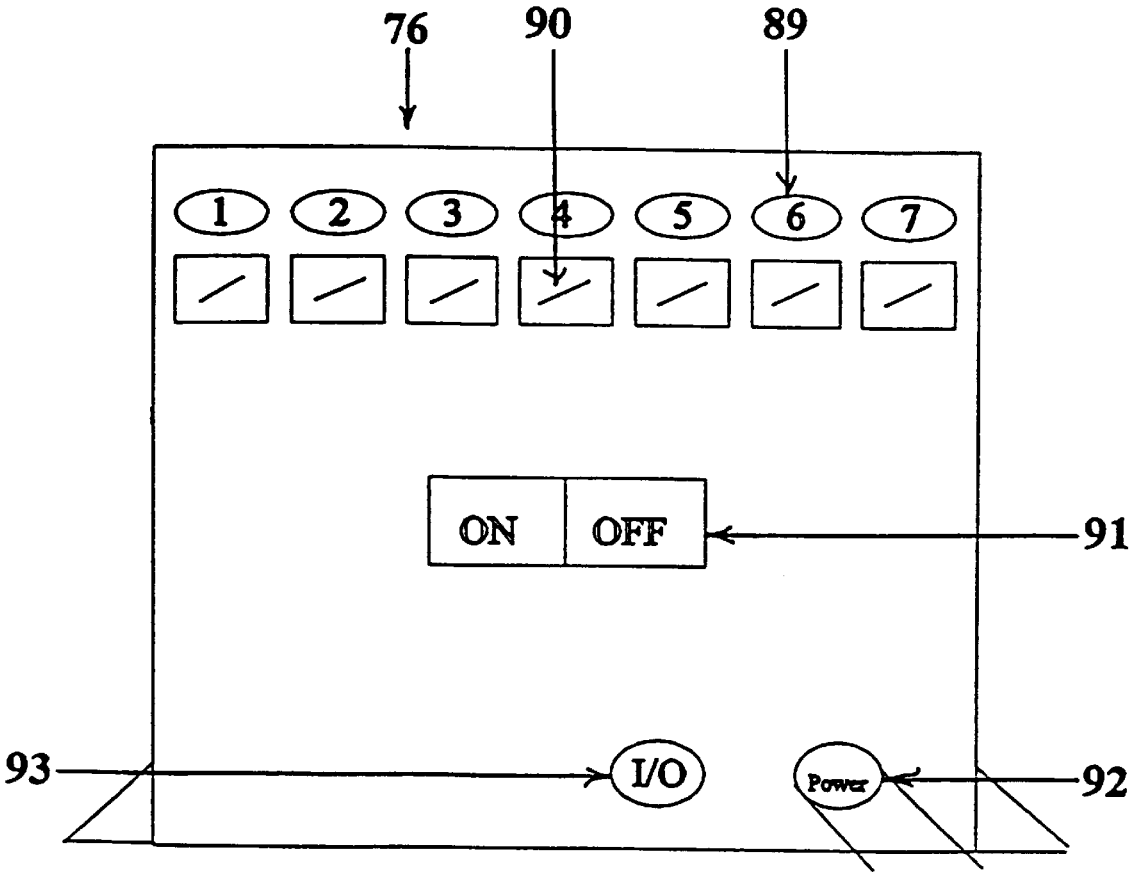
FIG. 12 is a rear end elevational view of the alternative shoe of FIG. 10.

Another embodiment of the present invention, the card dispensing shoe with scanner, apparatus, system and method, is shown in FIGS. 10, 11 & 12 and is broadly denoted by the numeral 76.

Referring to FIG. 10, in this embodiment of the invention, a CPU (such as CPU 34 in FIGS. 1, 5 & 6) may be internal to shoe 76 (internal CPU not shown) or may be an external CPU 79 as shown. The external CPU 79 may be either a custom designed CPU, or an off-the-shelf CPU may be utilized. The external CPU 79 is coupled to the shoe 76 via an Input/Output Port (I/O Port) 93 (FIG. 12) which in turn couples the external CPU 79 to the shoes components as sub-systems or function blocks previously discussed. As also previously mentioned in the first embodiment, this embodiment may also have the CPU (internal or external) connected to a LAN network and/or server system.

Figure 16:
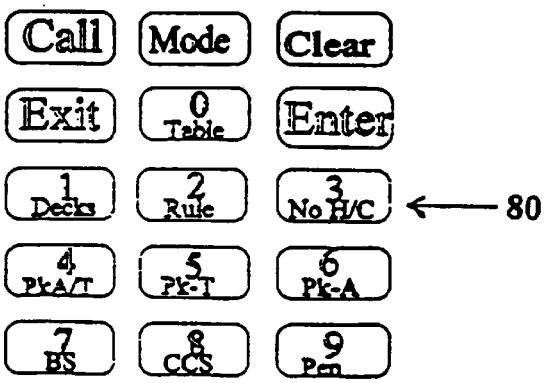
FIG. 16 is a detailed enlarged view of the keyboard 80 shown in FIG. 10.
Figure 17:
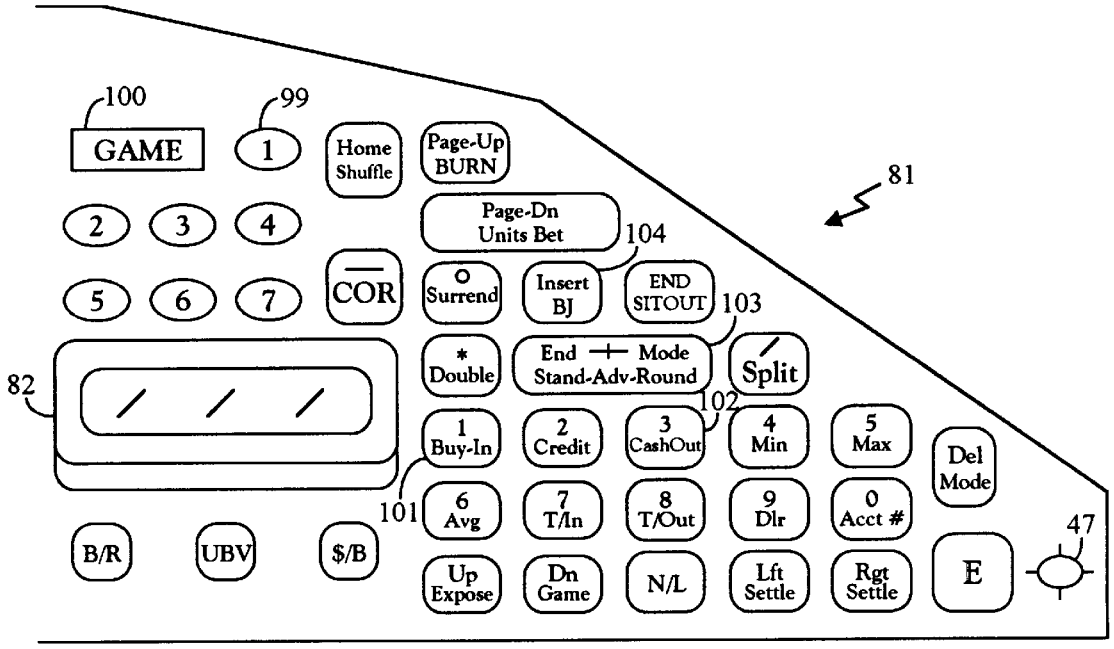
FIG. 17 is a detailed enlarged view of the keyboard 81 and LCD display 82 shown in FIG. 10.

The keyboard 60 and keyboard LCD display 62 (FIGS. 1 & 3) at the rear of the shoe 10 (FIGS. 1 & 3) in the first embodiment of the card dispensing shoe with scanner have been removed and replaced with expanded function keyboards and LCD displays as described below. These expanded keyboards and LCD displays provide more diverse functions to be performed with the present invention. These expanded function keyboards and LCD displays include: keyboard 89 (FIGS. 10, 11 & 12) and the segmented LCD displays 90 (FIG. 12) on the rear of the shoe 76; detachable keyboard 81 (FIGS. 10 & 17), LCD display 82 (FIGS. 10 & 17), and detachable keyboard 80 (FIGS. 10 & 16) all on the right side of the shoe 76; and on the another side of the shoe 76 (FIGS. 10, 11 & 18) a detachable keyboard 84 and LCD display 87 (FIGS. 10, 11 & 18) combination preferably held upon a rack 83 (FIGS. 10 & 11) preferably attached to the bottom of the outside wall of the shoe 76, extending upward at an angle. Again, as previously discussed, the additional keyboards and LCD displays are coupled to either the internal CPU (not shown) or the external CPU 79.

A customer-tracking-card as previously mentioned is preferably utilized in this embodiment of the present invention, and is inserted into the magnetic strip reader slot 77 (FIGS. 10 & 11). The game-round start button 63 (FIGS. 1, 3 & 4) has been repositioned in the embodiment of FIGS. 10 and 11 to become a part of keyboard 81 (FIGS. 10 & 17), and Keyboard 84 (FIGS. 10, 11, and 18) as depicted by the End-Mode-Stand-Advance-Round key 86. The penetration light 47 (FIG. 10) of the first embodiment (FIGS. 1, 2, 3, 4 & 11) is also used in the embodiment of FIGS. 10, 11, and 12, but has been moved to the forward end of a side of the shoe 76.

Additionally, a standard 101 key personal computer keyboard (as shown in FIG. 10) such as is supplied with a standard off-the-shelf personal computer such as CPU 79 may be coupled directly to CPU 79 and used in combination with the shoe 76, and keyboard 80 (FIGS. 10 & 16), keyboard 81 (FIGS. 10 & 17), keyboard 84 (FIGS. 10, 11 and 18), and keyboard 89 (FIG. 12).

The CPU 79 processes the input/output data to and from the keyboards, LCD displays and other components that make up the present invention's system hardware. The CPU 79 operation is controlled and monitored by any desired custom designed computer software. The CPU 79 may call the software from an attached hard drive unit (not shown), or if coupled to a LAN system may call the software from the LAN servers or host computer.

Figure 13:
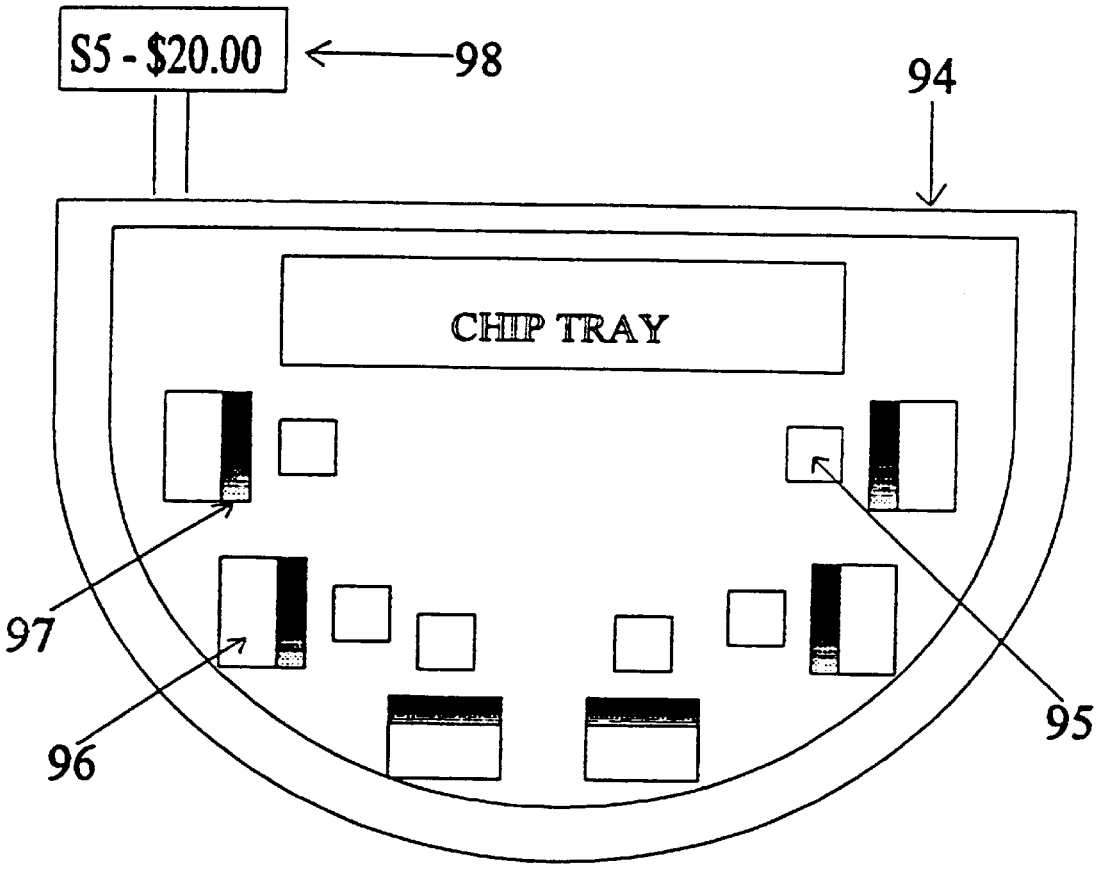
FIG. 13 is a top view of a game table with embedded game keyboards illustrating an additional embodiment of the present invention.

Card Dispensing Shoe with Scanner Apparatus, System and Method: Alternate Embodiment With Game Table Player Keyboards Another embodiment of a card dispensing shoe with scanner apparatus, system and method in accordance with the present invention comprises additional components as follows:

Referring to FIG. 13, a typical six player game table 94 as used for playing the games of Blackjack or Twenty-One is depicted. Set at each players seat is a keyboard/LCD display combination embedded in the game table surface. These keyboard/LCD displays are used to play an interactive computer game at the same time, and in conjunction with the main game of twenty-one being played at the table 94. These keyboard/display combinations are each referred to as "Call 21" keyboards 96. A large electronic digital display 98 is placed near the dealer's station at the game table 94 in such a position as to display the dollar amount of any "Call 21" game credits purchased or cashed out to the "Call 21" game players and to the game supervisors; and other information relevant to the play of the game. Referring to FIG. 14, the key layout of each "Call 21" keyboard 96 is depicted. The "Call 21" keyboards 96 and the digital display 98 are coupled to the internal or external CPU 79 as discussed previously with respect to the embodiment of FIGS. 10, 11 and 12.

The CPU 79 (FIG. 10) (or CPU 34 of FIGS. 1 & 6) processes the input/output data to and from the keyboards, LCD displays and other components that make up the embodiment of the present invention's system comprising the "Call 21" hardware, see FIGS. 1–6. The CPU 79 (FIG. 10) operation is controlled and monitored by any desired custom designed "Call 21" computer software. The CPU 79 (FIG. 10) may call the "Call 21" software from an attached hard drive unit (not shown), or if coupled to a LAN system may call the "Call 21" software from the LAN servers or a host computer.

Those skilled in the art will recognize that additional computers, computer monitors, LCD display units, magnetic card readers, scanners, etc. may be coupled via LAN systems or other means, and with programming well known to those skilled in the art other computer games and computer software, may interact with the Card Dispensing Shoe with Scanner Apparatus, Systems and Methods of this invention including it's various embodiments.

Although the invention has been particularly shown and described with reference to the disclosed preferred embodiments thereof, it will be understood by those skilled in the art that changes in form and detail may be made therein without departing from ithe spirit and scope of the invention.

OPERATION

Overview

The present invention, a card dispensing shoe with scanner apparatus, system and method includes a software program designed to evaluate the strategy and betting skills of casino blackjack players and to calculate each players earning potential and complimentary equivalency based, in addition to a casino's "Theoretical Win" or advantage over the player, but also on each individual player's advantage or disadvantage over the house or casino when playing one or more basic strategies, or card count systems designed for the game of twenty-one at a specific playing proficiency.

Programmed into the twenty-one evaluation software program to be used with the subject invention are the results of computer simulated runs of 5,000,000 hands of twenty-one dealt from a deck of cards comprised of one to eight standard decks of fifty-two playing cards. Each deck is dealt to a specific deck penetration of 50%, 65%, 75% or etc., and each simulated run plays one hand against the dealer. The computer is programmed to play perfectly each simulated hand dealt to the simulated player by referencing a selected basic strategy or card count system's strategy decision indices, or recommended decisions, to be used with a selected number of decks, and a selected set of rules programmed into the software.

For the simulated run using basic strategies decision indices, the bets made for each hand played during the run are the same or a "flat bet". For the simulated run using a card count systems decision indices, a specific bet range will be set for this simulated run. Using the set bet range for each specific simulated run, the program bets one or more betting units, for each hand played, relative to the selected card count systems true count for the deck(s) being dealt at the beginning of each game round to be dealt. The results of these computer simulated runs of the game of twenty-one, programmed into the software, are identified as "Count System Advantage" files, or CSA files.

When the present invention is used to evaluate the strategy skills of twenty-one players, the program will select and identify, from those basic strategy systems programmed into the software, the basic strategy for which each evaluated player has achieved the highest basic strategy proficiency for the current evaluation, and the program will also select and identify, from those card count systems programmed into the software, the card count system for which each evaluated player has achieved the highest card count system strategy proficiency for the current evaluation.

When a round of twenty-one has ended, or the current evaluation of the game being played has terminated, the computer program, knowing the factors required for proficiency calculations (i.e. the number of decks dealt and the deck penetration, the rule set used for each player's bet range and strategy proficiency, etc.) will search the CSA files to find a simulated run matching the basic strategy where the player has attained the highest proficiency in for the current game, and also find a simulated run matching the card count system where the player has attained the highest proficiency for the current game that matches the required factors. (e.g. the number of decks, the deck penetration, etc.) When the matching CSA file is found, it will contain the percent advantage or disadvantage a player has when playing that basic strategy or card count system perfectly, or at a proficiency of 100%, against those specific factors of the same number of decks, deck penetration, rule set and specific bet range.

The software will then multiply the player advantage or disadvantage for the CSA file, (corresponding to the basic strategy or card count system the player has attained the highest proficiency in), by the players individual specific proficiency at the identified basic strategy or card count system for the evaluated game thus obtaining the players individual specific advantage or disadvantage when playing the game of twenty-one against a specific set of rules or parameters established by the casino.

Using this information, a players earning potential or complimentary equivalency will no longer be theoretical, but will be a twenty-one players real earning potential or complimentary equivalency based on the basic strategy and card count system in which the player has attained the highest proficiency when compared to other basic strategy and card count systems programmed into the software for the current evaluation of the game played.

The information required for the above evaluation of the current game is input by the card dealer during the process of dealing the game of twenty-one from the card dispensing shoe with scanner apparatus or system that is placed on the game table where the twenty-one game to be evaluated by the software is being played. A scanner of the type described above coupled to the CPU automatically allows the determination of the value of each card dealt to each player's hand and the dealer and provides an input of this data to the CPU and software program. The dealer will also use one or more keyboard(s) and/or LCD displays of the type described above coupled to the shoe to identify for the computer program the number of the seats, or players (including the dealer's position relative to the position of each of the players) engaged in active play at the game table during each game round dealt. These keyboard(s) and/or LCD displays used by the dealer are used to enter other data relevant to each seat's, or player's, betting and/or decision strategies for each hand played resulting in a 100% accurate evaluation of a players blackjack strategy skills during the course of the game played.

The accuracy of the data input to the evaluation software program by this means cannot be duplicated using any prior art or VCR recording of a twenty-one game previously played and recorded, or currently in progress.

Card Dispensing Shoe with Scanner Apparatus, System and Method: Basic Embodiment Operation The Card Dispensing Shoe with Scanner Apparatus, system and Method (FIGS. 1–6) Basic Embodiment operation is as follows: At it's most basic level, a dealer operates the shoe 10 (FIG. 1) in the typical fashion of shoes used in card games. A desired number of decks 16 (FIG. 1) of playing cards is place in the chute 16*a* (FIG. 1). The shoe 10 (FIG. 1) can hold many decks of playing cards 16 (FIG. 1), though typically the number is between one and eight decks of playing cards. Each deck (FIG. 1) is placed edge down into the open chute 16*a* (FIG. 1) of the shoe 10 (FIG. 1). The chute 16*a* (FIG. 1) slopes forwardly at an approximately 45 degree angle. A hollow wedge-shaped block housing mounted on a heavy stainless steel roller (not shown), provides the force required to push the cards forwardly down the chute 16*a* (FIG. 1), holding them flush against a retainer 26 (FIG. 4), ready for the cards to be pushed through the slot 22 (FIG. 4) of the shoe 10 by the dealer. To deal the cards, the dealer will manually remove a single card from the shoe by pushing a door (not shown) covering the slot 22 (FIG. 4) out of the way or by reaching through a brush (not shown) which prevents players from viewing the back of the next playing card and possibly seeing any identifying marks on the playing cards. Then the dealer pushes the next card down and out of the opening of the slot 22 (FIG. 4) of the shoe 10 (FIG. 1) by pressing downwardly on the top card of the deck 16 (FIG. 1) in the shoe 10 (FIG. 1) such that the top card is forced through the slot 22 (FIG. 4) and onto a playing surface of a game table such as shown in FIG. 13. In this manner the cards of the deck 16 (FIG. 1) are dealt to the players of the card game.

Other components of the shoe 10 (FIG. 1) include a game-round start button 63 (FIGS. 1, 3 & 4) which is pressed to record the start of a particular round of cards to be dealt from the deck 16 (FIG. 1) within the shoe 10 (FIG. 1). A load switch 32 (FIGS. 1 & 3) senses the presence or absence of cards in the shoe and activates or deactivates the operation of the software. A transparent window (not shown) is preferably provided on a side of the shoe 10 (FIG. 1) to allow the dealer and casino personnel to see approximately how many cards remain for the decks 16 (FIG. 1) in the shoe 10 (FIG. 1). A penetration light 47 (FIGS. 1, 3, 4 & 6) is a light that is turned on by the software operating the CPU 34 (FIGS. 1 & 6) to notify the dealer that a selected deck penetration (cards to be dealt before shuffling) has been reached and that this is to be the last round dealt from the shoe 10 (FIG. 1) before shuffling the playing cards and reloading the shoe 10 (FIG. 1).

At the end of each game round, the dealer will press the beginning of game-round button 63 (FIGS. 1, 2, 3 & 4), to cause the software to record in the CPU that a new game round is about to begin and to display the true count of the card count system the software is using to monitor the true count of decks 16 (FIG. 1) of playing cards being dealt from the shoe 10 (Fig.) at that time on remote computer monitor connected to the host computer 74 (FIG. 6). The load switch 32 (FIGS. 1 & 6) will provide a signal that the remaining playing cards of the deck 16 have been removed from the chute 16*a* (FIG. 1) of the shoe 10 (FIG. 1) and that a new deal is about to begin. The running and true counts are always zero or reset to zero at the beginning of a new deal. Until the load switch 32 (FIGS. 1 & 6) is activated and the first "burn" card is passed over the optical scanner 41 (FIGS. 1 & 6), the beginning of game-round button 63 (FIGS. 1 & 6) will not be enabled by the software. When the deck 16 (FIG. 1) is placed in the chute 16*a* (FIG. 1) of the shoe 10 (FIG. 1), the wedge-shaped block (not shown) will be placed behind the deck 16 (FIG. 1) and both the deck 16 (FIG. 1) and the wedge-shaped block will press against the load switch 32 (FIGS. 1 & 6). When the chute 16*a* (FIG. 1) is empty of all playing cards, the wedge-shaped block will be forward of the load switch 32 (FIG. 1) which will then be fully extended causing the load switch 32 (FIG. 1) to be in the open contact position thus causing the software to end its calculations for the current deck 16 (FIG. 1) of playing cards most recently dealt from the shoe 76. The load switch 32 (FIGS. 1 & 6) will not signal the software that the deck 16 (FIG. 1) has been loaded into the chute 16*a* (FIG. 1) until the load switch 32 (FIGS. 1 & 6) has been recessed for three seconds.

As each playing card is pushed down the chute 16*a* (FIG. 1) and out the opening of the slot 22 (FIG. 4) of the shoe 10 (FIG. 1), each playing card will come into physical contact with a start frame sensor 65 (FIG. 4) which results in the activation of the shoe 10 optical sensor 41 (FIGS. 1, 2 & 4). The face of each card is illuminated with a bulb 42 (FIGS. 1 & 2) to allow scanning by the optical sensor 41 (FIGS. 1, 2 & 4). The optical sensor 41 (FIGS. 1, 2 & 4) is coupled to a neural network (FIGS. 7, 8, & 9) that has been trained to recognize the images printed on the face of the cards as they pass from the chute 16*a* (FIG. 1) and through the slot 22 (FIG. 4) and over or past the optical sensor 41 (FIG. 1) of the shoe 10 (FIG. 1). As the card slides down the front surface of the shoe, the start frame sensor 65 (FIG. 4) detects the leading edge of the playing card and generates a frame-read interrupt to the CPU 34 (FIGS. 1, 5 & 6). The interrupt will start sending the serial data from the optical sensor 41 (FIG. 1) via a serial data port to RAM memory located on the CPU 34 (FIGS. 1, 5 & 6). Prior to the data reaching the serial data port, the serial output data of the analog optical sensor 41 (FIG. 6) is thresholded or transformed to a binary value by an analog-to-digital converter 75 (FIG. 6). As long as the frame-read interrupt line is at a logic high, the serial image bit stream will continue to be written into the memory of the CPU 34 (FIG. 1). The software running on the CPU 34 (FIG. 6) creates a two dimensional bit-mapped image of the card suit and value of the particular card being scanned from the serial image bit stream input into the CPU 34 (FIG. 1) from the scanner or sensor 41 (FIGS. 1, 2 & 6).

Shoe 10 (FIG. 1) further includes a frame-stop sensor 40 (FIG. 4) which senses the leading edge of the playing card being fed through the slot 22 (FIG. 4). When the frame-stop sensor 40 (FIG. 4) senses the leading edge of a playing card, it will cause the frame-read to go to a logic low and stop the writing of the serial-bit stream. At this point, the entire bit-mapped card image will be stored in the RAM memory of the CPU 34. Next, this bit-mapped image will be used as an input vector for a feed forward neural network (FIGS. 7, 8 & 9) to be run on the CPU 34 (FIGS. 1 & 6) The neural network (FIGS. 7, 8 & 9) has been trained using error back-propagation to recognize all the possible suits and values of the cards passing through the shoe 10 (FIG. 1)

Shoe 10 (FIG. 1) accommodates the use of "customer-tracking-card(s)" 15 (FIG. 3) of a particular player or players. To this end, a magnetic card reader 50 (FIG. 1) having a slot 52 (FIGS. 1 & 3) is provided on the shoe 10 (FIG. 1) at the rear end thereof adjacent to and below the alpha-numeric keyboard 60 (FIGS. 1 & 3). As a player plays the game, the player's account information recorded in the magnetic stripe of the "customer-tracking-card" 15 (FIG. 3) will cause the player's customer data file stored upon the host computer 74 (FIG. 6) to be transferred to the memory of the CPU 34 (FIGS. 1 & 6). As the player continues to play, the customer data file of the player will be updated by the CPU 34 (FIG. 6). When a player quits the game, casino personnel will log the player out of the game using the alpha-numeric keyboard 60, the customer data file will be updated, transferred to the host computer 74 (FIG. 6), and closed until it is opened once again by the insertion of the specific "customer-tracking-card" 15 into a magnetic stripe reader slot of a magnetic card reader 50 (FIG. 1) within the casino's system, or by using keyboard 60 to enter the customer's file number to open the customer's file. For the basic embodiment, the magnetic stripe reader 50 (FIGS. 1 & 6) is built into the shoe 10 (FIG. 1). The host computer 74 (FIG. 6) may be connected or coupled to the shoe 10 (FIG. 1) CPU 34 in a variety of methods well known in the art. This could include any coupling via a LAN connection 45 (FIG. 6). When a customer's "customer-tracking-card" 15 (FIG. 1) embedded with, or containing the customer account number is inserted within the magnetic card reader 50 (FIGS. 1 & 6), the customer's data file stored on the host computer 74 (FIG. 6) will be called. (As previously discussed, those skilled in the art will recognize that the host computer 74 (FIG. 6) may be a single computer coupled to the CPU 34 (FIG. 6) via standard LAN technology, but may also be a computer network comprised of one or more computer network servers or computers, ranging from personal computers up to and including main frame systems.)

The customer account information such as their name and account number embedded in the magnetic stripe of the "customer-tracking-card" 15 (FIG. 1) will be displayed on the LCD (liquid crystal display) keyboard display 62 (FIGS. 1 & 3). Casino personnel can then verify the customers' identification by using specific keyboard key functions that can be used to sequentially access specific fields within the customer's data file and to enter information to or retrieve information from the file as deemed necessary or desirable. Such typical information can be as follows:

1. Address
2. Date of birth
3. Social Security number
4. Credit line
5. Cash on deposit
6. Win
7. Loss
8. Average Bet
9. Start/Stop Time
10. Length of Play
11. Default Basic Strategy Proficiency
12. Default Card Count Strategy Proficiency
13. ID Basic Strategy Proficiency
14. ID Card Count Strategy Proficiency
15. CSA Basis Strategy Advantage/Disadvantage
16. CSA Card Count System Advantage/Disadvantage
17. Comp Equivalency/Recommendations
18. Cash Transaction Reporting Following the transfer of the customer data file from the host computer 74 (FIG. 6) to the CPU 34 (FIG. 6), the keyboard 60 (FIG. 6) is used by the dealer or casino personnel to then log in that customer as playing in a specific seat at the game table 94 (FIG. 13). Once the customer is logged to a specific seat at the game table (FIG. 13) 94, the "customer-tracking-card" 15 (FIG. 3) is removed from the magnetic card reader slot 52 (FIGS. 1 & 3), the seat number being played by the customer, when entered by the casino personnel, will light up on the keyboard 60 (FIG. 6) and remain lit until such time as the casino personnel enter the customer's minimum, maximum and average bets.

When a "customer-tracking-card" 15 (FIG. 3) assigned to a specific casino customer is used to log that customer in at a particular gaming table, the last date and the time and the code number for any complimentary room, food, or beverage given to that customer can be displayed by means of the LCD display 62 (FIG. 6). Casino personnel can then use this information to base their decisions to honor any requests by the customer for complimentary items (comps). If granted, those comps will be entered by the casino personnel and the comp information file and customer data file will be immediately updated on the host computer 74 (FIG. 6). If a customer attempts to get duplicate or unauthorized comps from other casino personnel, that information will immediately be available. The account number or identification number of the person authorizing the comps will be added to the customer's customer data file by means of the keyboard 60 (FIG. 6). The keyboard 60 (FIG. 6) and the LCD display 62 (FIG. 6) are used respectively to input and display information to and from the CPU 34 (FIG. 6) or the host computer 74 (FIG. 6). The keyboard 60 (FIG. 6) and the LCD display 62 (FIG. 6) can also be used to log in dealers and casino pit personnel associated with the games.

Stand alone magnetic stripe readers (not shown) coupled with their own microprocessors (not shown) linked to the host computer 74 (FIG. 6) can also be placed on all the other game tables, in all restaurants and at the hotel desks associated with the casino. When a customer uses his or her comp authorization, their "customer-tracking-card" 15 (FIG. 3) is placed in a magnetic stripe reader and the amount of the comp and the department to which it is charged will be assigned to the appropriate customer data file on the host computer 74 (FIG. 6).

It should be noted that some form of encryption is to be installed in the CPU 34 (FIG. 6). The purpose of this strategy is to protect the confidentiality of the data and prevent its unauthorized interception.

Operating power is supplied by the cable 56 (FIGS. 1 & 3) to the CPU 34 (FIG. 1), and to all associated components.

Feed Forward Neural Network Operation

The following is a description of how the feed forward neural network will identify playing card suit and values:

The high resolution array stored in the memory of the CPU 34 (FIG. 6) is reduced to a course image that is an array size of preferable 6 columns by 7 rows. This is accomplished by sectioning the larger high resolution array into, for example, a 6 by 7 grid and assigning the course array a gray scale value that is based on the number of black pixels in each grid. If all of the pixels in a grid are black, the gray scale will be 1005 (black), if all of the pixels are white the gray scale will be 0% (white), and if half of the pixels are black the gray scale will be 50% (gray). The 6 by 7 course array that is stored in memory is preferably converted into two 42 word vectors. One for the card value input vector and one for the card suit vector. These vectors are used as inputs to the neural network's input layer.

The type of neural network (FIGS. 7, 8 & 9) used, as an example, in this application is a feed forward multi-layer perception (MLP) that is trained for image recognition using back-propagation. The neural network consists of neurons and "weighted" connections between the neurons.

The equations used to describe the operation of the basic 3-layer feed forward multi-layer perception are as follows:

for $i=m+1$ to N+1

$$net_i=\Sigma_{j<i}W_{ij}*X_j$$

$$X_i=\text{logsigmoid}(net_i)$$

$$Y_i=X_{i+N}(X_0=1)$$

Since the neural network used in this application for card suit identification (FIG. 8) will map a 42 pixel image to one of four card suits, the neural network will need 42 inputs to represent the image grid, and 4 neurons in its output layer. The neural network used in this application for card value identification (FIG. 9) will map a 42 pixel image to one of 13 card values and this neural network will need 42 inputs to represent the image grid, and 13 neurons in its output layer. Both neural networks will have a hidden layer to improve the function approximation capabilities.

The neural network is trained to identify card suits and values using back-propagation. The back-propagation technique adjusts the weights ($W_{ij}$) of each neuron connection until the output vector is correct for the input vector sets that would represent a given card value or suit. After training, the values of the weights will be fixed and the network will be able to identify card suit and values for any card presented to the neural network.

The networks are trained to output a 1 in the correct position of the output vector and fill the rest of the output vector with Os. An example would be if the neural network identified an ACE input vector 1 then the first position of the output vector would be 1 and all other positions would be 0.

Figure 18:
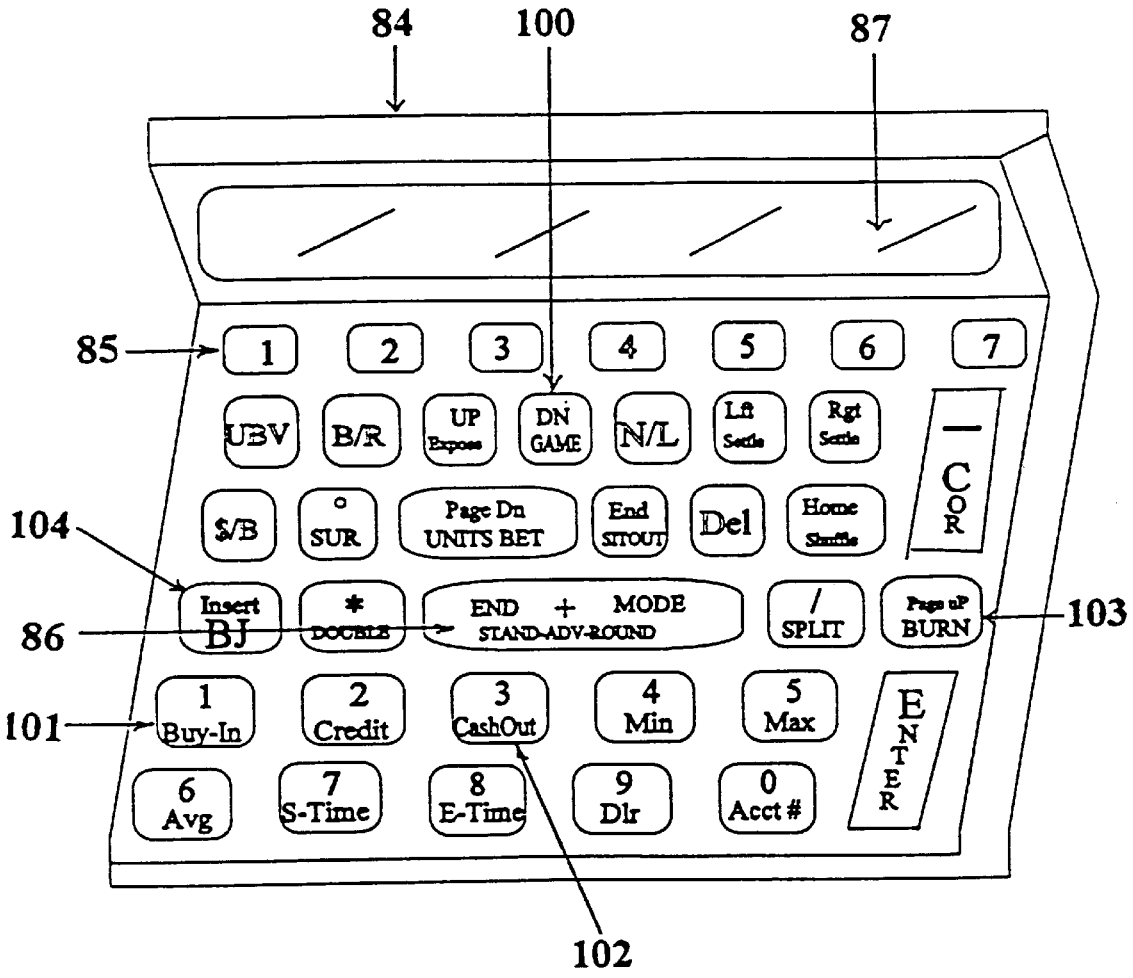
FIG. 18 is a detailed enlarged view of the keyboard 84 and LCD display 87 shown in FIG. 10.

Card Dispensing Shoe with Scanner Apparatus, System and Method: Alternate Embodiment Operation Referring to FIGS. 10 & 11 (unless otherwise noted), an alternative embodiment of a card dispensing shoe with scanner (shoe 76 hereafter) in accordance with the present invention is shown. (Only the differing details from the previous embodiments are discussed, all other functions and components such as the optical scanner 41 (FIG. 6) details are the same unless otherwise noted.) In this embodiment of the invention, the CPU 34 shown in FIGS. 1, 5 & 6 can either be carried internally by the shoe 76, or may be an external CPU 79 coupled via an I/O port 93 (FIG. 12) to the shoe 76 and coupled in turn to the optical scanner 41 (FIG. 1) and the other components of the present invention, the shoe 76 including all keyboards and LCD displays. As previously discussed, the CPU 79 can function as an independent CPU, or it can be coupled to and function with or as part of a LAN, server network, or mainframe system. The keyboard 60 (FIGS. 1 & 3) and LCD display 62 (FIGS. 1 & 3) at the rear of the shoe 10 (FIGS. 1 & 3) in the previously discussed embodiment of the present invention have been removed and replaced with additional or enhanced keyboards and LCD displays which can be used in different combinations. These keyboards and LCD displays are: preferably at the rear of the shoe 76, numeric keyboard 89 (FIGS. 10, 11 & 12) and LCD display 90 (FIGS. 10 & 12); alpha-numeric keyboard 81 (FIGS. 10 & 17) and LCD display 82 (FIGS. 10 & 17) attached to the shoe 76 on preferably one side of the shoe 76 (FIG. 10), and alpha-numeric keyboard 80 (FIG. 10) attached to another portion of the shoe 76. On one side portion of the shoe 76, a detachable rack 83 (FIG. 10) has been attached preferably to the bottom of the outside wall of the shoe 76, preferably extending upward at an angle to receive a detachable alpha-numeric keyboard 84 (FIGS. 10, 11 & 18), and LCD display 87 (FIGS. 10, 11 & 18). And, as a separate unit coupled to the shoe 76 and the CPU (either internal or external) a standard 101 key keyboard for use with CPU's such as portable or desktop personal computers, and a standard computer monitor display coupled to the CPU (either internally or externally).

All keyboards and LCD displays attached to the shoe 76 can function independently of the others, or interact with the other keyboards and LCD displays, and all keyboard and LCD displays are coupled to either an internal CPU (not shown) or the external CPU 79. CPU 79 may be either a custom CPU or an off the shelf portable or desktop personal computer coupled to the shoe 76 via the I/O port 93 (FIG. 12).

The load switch 32 (FIGS. 1 & 6) of the basic embodiment is not carried by the alternate embodiments of the shoe 76. The load switch 32 (FIGS. 1 & 6) is replaced by the shuffle key 103 (FIGS. 10, 11, 17 & 18). When the playing cards are removed from the chute 16*a*, to be shuffled by the dealer, or when they are shuffled and then replaced in the card chute 16*a* of the shoe 76 the Shuffle key 103 located on either keyboard 81 (FIGS. 10 and 17) or keyboard 84 (FIGS. 10, 11 and 18) is pressed to provide a signal that a fresh deck has been shuffled and placed in chute 16*a* (FIG. 1) and a new deal is about to begin. The running and true counts are always zero or reset to zero at the beginning of a new deal. Pressing the shuffle key 103 will reset the running and true counts for the newly shuffled deck to zero.

At the beginning of a new deal, before any cards are dealt to the players of the game, one or more cards are removed from the deck placed in the chute 16*a* and "burned". To record the burn card(s) the dealer will press the Burn key 104 located on either keyboard 81 (FIGS. 10 and 17) or keyboard 84 (FIGS. 10, 11 and 18). When the last burn-card his been removed from the shoe 76 by the dealer the dealer will press the End-Mod-Stand-Advance-Round key (86) of keyboard 81 (FIGS. 10 & 17) or a identical key on keyboard 84 (FIGS. 10, 11 & 18). The game card and card count values of any burn-card will not be considered by the software when calculating the running and true counts for the deck(s) being dealt from the shoe 10. The software is now prepared to begin it's calculations for the game cards dealt to the game players for the newly shuffled deck contained within the chute 16*a* (FIG. 1) of the shoe 76. When the selected deck penetration has been achieved and the last round has been dealt from the deck contained in the shoe 76, the remainder of the deck is to be removed from the shoe 76 to be shuffled with the cards previously dealt from the shoe and placed in the game card discard rack (not shown) the shuffle key 103 of either keyboard 81 (FIGS. 10 & 17) or keyboard 84 (FIGS. 10, 11 & 18) is pressed to end the software's calculations for the deck 16 (FIG. 1) of playing cards most recently dealt from the shoe 76.

Again, as previously mentioned, the optical scanner 41 (FIG. 1) and other components of the present invention discussed in the previous embodiments are included within this embodiment unless otherwise noted, and function as previously discussed.

The keyboard 80 (FIGS. 10 & 16) keys are used to open and close one or more software programs that have been installed in the CPU 79, or that reside on the host computer network (not shown), to access specific screens of the software programs on call, and to enter the setup game information for the twenty-one game evaluation software.

The primary purpose of keyboard 89 (FIG. 12) is to signal one or more computer programs that a designated game table seat, i.e. numbered one through six, (FIG. 13), (a typical casino blackjack game table has either five, six or seven seats), is active or not active and/or is or is not being played by any player playing the game in progress that is to be evaluated by the present invention's software program. (All keyboards and LCD displays carried by the shoe 76 have means for signaling one or more computer programs that a designated game table seat, for example, numbered one through seven, (1–7), is active or not active and/or is or is not being played by any customer playing the game in progress.)

When any one of the keyboards carried by the shoe is used to designate a seat as active or as being played by a customer during a current game round, the corresponding seat number 99 (FIG. 10) of keyboard 81 (FIGS. 10 & 17) is preferably illuminated, as is the corresponding seat number on keyboard 84 (top row of keys 85 keyboard 84 (FIGS. 10, 11 & 18), and on keyboard 89 (FIG. 12). When keyboard 89 (FIG. 12) is used to designate a seat as not being active or as not being played by a game player during the current game round it is not illuminated, nor does the corresponding seat number on keyboard 84 (FIGS. 10, 11 & 18), or keyboard 81 (FIGS. 10 & 17) remain illuminated. If a customer tracking card is inserted into the magnetic strip's reader slot 77 (formerly slot 52 and magnetic card reader 50 (FIG. 1), but now incorporated preferably in the rear portion of the shoe 76 (FIGS. 10 & 11) and identified as magnetic card reader slot 77), the activated seat will be assigned to the customer identified by the customer tracking card 15 (FIG. 3) and the corresponding customer data file for the current software application in use will be opened. If any keyboard's designated seat key is illuminated, the illuminated key is pressed and the active seat designation will be terminated and the key will go dark. If the terminated seat was assigned to a customer using a customer tracking card 15 (FIG. 3) the data entered to the card holders customer data file will be saved and the card holder's customer data file for the current software application in use will be closed and transferred to the host computer (not shown).

When the data entry operator (DEO) selects "Rotate" from the Operator Data Entry Options screen during set-up of the twenty-one evaluation software each of the LCD display segments 90 (FIG. 12), one segment each being assigned to display selected game data for the numeric seat designation keys 89 (FIG. 12) immediately above for the evaluation in progress, will alternate the segmented data display for all active seats at the end and the beginning of each round when the plus (+) key, the End-Mode-Stand-Advance-Round key 86 is pressed. The segmented display will rotate in this order: (a) the total strategy decisions for the current evaluation; (b) the player's strategy proficiency for a selected default basic strategy for the current evaluation, (c) the player's strategy proficiency for a selected default card count system for the current evaluation, (d) the player's ID Count or strategy proficiency for the basic strategy or card count system programmed into the software in which the program has identified the player as having attained the highest strategy proficiency for the current evaluation, (e) the player's betting proficiency for a selected default card count system for the current evaluation, (f) the player's count system advantage (CSA) for the ID Count or the basic strategy or card count system programmed into the software in which the program has identified the player as having attained the highest strategy proficiency for the current evaluation, (g) the seat or players actual decisions made for a hand played during the round currently in progress, and etc. Any one of the above display options can be individually selected by the data entry operator from the "Operator Data Entry Options" screen for permanent display on the display segments of LCD display 90 (FIG. 12) for all designated active seats during the course of an evaluation, or a "Blank" segmented display option may be selected by the DEO.

The detachable, keyboard 84 and LCD display 87 (FIGS. 10, 11 & 18), held by the detachable keyboard rack 83 (FIGS. 10 & 11) have been added to the alternative embodiment of the present invention. The keyboard and display rack 83 (carries a female plug (not show) in which the male plug of (not shown) keyboard 84 is inserted when keyboard 84 is placed into the keyboard and display rack 83) is preferably attached to the base of the outside wall of the shoe 76, with preferably the mouth of the shoe facing forward, by means of a moveable bracket that preferably angles outward and up from the base of the shoe 76 so that the keyboard 84 and LCD display 87 (FIGS. 10, 11 & 18) is preferably positioned at or near the top of the shoe 76, horizontal to, above and to the side of the mouth of the shoe 76. The keyboard 84 and the LCD display 87 (FIGS. 10, 11 & 18) may be removed without hindering the operation of the shoe 76 as data may be inputted or displayed via the other keyboards and displays. When provided or present, the primary functions of the keyboard 84 and LCD display 87 (FIGS. 10, 11 & 18) will be to:

- identify the active game table seats 99 (FIGS. 10 & 17), or game table seats 85 (FIGS. 10, 11 15 & 18), or game table seats 89 (FIG. 12) at the game table;
- access or call a customer data file using the account number of the customer playing a active game table seat either by direct input or by use of the customer tracking card 15 (FIG. 3);
- open a new customer data file when the name or account number of the customer playing the active game table seat is unknown or the customer is new,
- initiate the transfer and recording of pertinent game data, for each customer, known or unknown, being evaluated by the software program to the customer data file or other data files; and/or
- enter and or cause to be displayed on one or more of the displays coupled to the shoe 76, (FIG. 10) the game data entered for each active seat in sequence (the first active seat first) which includes game data such as:
  - a players buy-in; credit issued; the amounts bet on each hand played, minimum bet, maximum bet, average bet, cash-out; a specific player or seats card values, hand totals, decisions made for the current hand being played; and the player's or seat's decision strategy and betting proficiency for all hands played during the course of the play of the game currently being evaluated, etc.

A detachable, decision keyboard 81 and LCD display 82 (FIGS. 10 & 17) are mounted on one side of the shoe 76 (FIG. 10) as the mouth of the shoe 76 faces forward. This keyboard 81 and LCD display 82 (FIGS. 10 & 17) permits or allows one handed data entry by the dealer during the course of the game play. The decision keyboard 81 and LCD display 82 primary functions are to record and display the each player's different game play or strategy decisions, (Surrender, Insurance, Stand, Double Down or Split), that a player may make on any hand played during the course of the game. Additionally, when the dealer has a Ace or Ten or picture card which has a value of ten (10) as his/her up-card, keyboard 81 and LCD display 82 (FIGS. 10 & 17) are to be used to inform the dealer when his/her hole-card constitutes a two-card-hand total of "21", or a "Blackjack". The game-round start button 63 (FIGS. 1, 3 & 4) is repositioned within keyboard 81 as key 86 (FIGS. 10 & 17) on the embodiment of FIG. 10.

Any data or information that can be entered, or retrieved from the software or data files by using the keyboard 89 (FIG. 12), or keyboard 84 and LCD display 87 (FIGS. 10, 11 & 18) can be entered and retrieved using the keyboard 81 and LCD display 82 (FIGS. 10 & 17) unit. Conversely, any data entered into or retrieved from the software or data files using keyboard 81 and LCD display 82 (FIGS. 10 & 17) can also be entered using keyboard 84 and LCD display 87 (FIGS. 10, 11 & 18).

An additional keyboard and display can be used in the alternate embodiment by the use of a standard 101-key keyboard and a standard computer monitor which are coupled to the CPU (the internal CPU of the shoe 76 or the external CPU 79). This additional keyboard and monitor combination can enter and display all information or data that could be handled by the other previously described keyboards and displays. Furthermore, the additional 101-key keyboard may be used to enter additional information acceptable by the software such as new customers names, account numbers, and to edit the date/time data files of unknown customers who have been previously evaluated, and who's have subsequently been identified by casino personnel, and etc.

The explanation of the software and is discussed in the software operation section below.

The penetration light 47 of FIGS. 1, 2, 3 & 6 is also carried by the shoe 76 (FIG. 10), but has been positioned just forward of keyboard 81 (still denoted as 47 (FIG. 10)).

Card Dispensing Shoe with Scanner Apparatus, System and Method: Alternate Embodiment With Personal Game Table Player Keyboard Operation The operation of an additional alternate embodiment of a card dispensing shoe with scanner in accordance with the present invention (as shown in FIGS. 10 & 11, broadly denoted by the numeral 76) is explained herein.

All keyboards, displays, components and functions of the previous embodiments are present herein unless specifically mentioned and changed.

Additionally, (referring to FIGS. 13 and 14), the keyboard/display combination (keyboard 96 hereafter) is preferably added to the present invention to enable each player at the card table 94 (FIG. 13) to participate in the playing of the "Call 21" game. The keyboards 96 are embedded in the top of the game table 94 (FIG. 13) just below each of the game table's betting boxes 97 (FIG. 13) that are printed onto the game table's layout. Further added is the electronic digital display 98 attached to the game table 94. Each keyboard 96 is duplicated at each player's station and each keyboard 96 is coupled to the CPU 79 (FIG. 10). The game table 94 will also support the shoe 76 (FIG. 10) to be operated by the dealer for the play of the game. When the optical scanner 41 (FIGS. 1, 2, 4, and 6), the keyboards shown in (FIGS. 10, 11, 17 & 18), displays shown in (FIGS. 10, 11, 17 & 18) and other components of the shoe apparatus or system 76 (FIGS. 10 & 11) are coupled to the keyboards 96 and electronic digital display 98 of the game table 94 (FIG. 13) are coupled to the CPU (internal or external CPU 79), the players of the twenty-one game seated at the table 94 may, at their discretion, use the keyboards 96 and electronic digital display 98 carried by the game table 94 to interact with a computer program that will offer the twenty-one game player the opportunity to play an additional casino game called "Call 21" that is directly related to the standard game of twenty-one or blackjack being dealt at the game table 94. The "Call 21" game offered by the computer program allows each of the players to use their individual keyboard 96 (FIG. 13) to select, and wager on the order and sequence of the game card's, the value of the cards and the suits of the cards that are to be dealt to the game players and the dealer during an upcoming round of twenty-one to be dealt from the shoe (76) (FIG. 10) by the dealer such as; (a) the game card value of the dealers up-card; (b) the game card value and suit of the dealer's up-card; (c) the hand total of the player's original two-card-hand; (d) the game card value of each card comprising the player's original two-card-hand; (e) the game card value and suit of the player's original two-card-hand; (f) the order and sequence that the selected game card values and the suits of the cards will be dealt from the shoe to the player and the dealer, by the dealer; (g) and one or more combinations of the above wagers for both the dealer and the player as to the sequence, card value, card suit, and etc. of the cards to be dealt from the shoe 76 to each player of the game of twenty-one, and/or the dealer, by the dealer, during the next game round.

The detailed explanation of the "Call 21" software and a use example is discussed below in the "Call 21" software operation section.

Operation of the Software

The following describes how the software utilized within the present invention can be used to evaluate, during real time, the strategy and betting skills of all players seated and playing the game of casino twenty-one or blackjack at a game table on which the Card Dispensing Shoe with Scanner has been placed. As each card image is scanned by the optical sensor of the present invention, the neural network recognizes the images printed on the face of the cards and the resultant vector will be processed by the software operating within the CPU. The (PU and software combination will:

1. Assign a specific numeric value, card suit and card count value to each card passed over and identified by the optical scanner;
2. Keep track of the number of cards played from and remaining in the deck and the number of cards played and remaining in each suit of the deck;
3. Calculate a selected card count system's running count and true count for the deck(s) being dealt as each card is removed from the deck by the dealer and at the beginning of each round;
4. Calculate the maximum, minimum and average running and true counts set at the beginning of each round for all decks dealt or issued by the dealer during the round;
5. Activate an alert display on the shoe to inform the dealer that the house deck penetration has been achieved and this will be ithe last round dealt from the deck(s) in the shoe before the deck is shuffled by the dealer;
6. Calculate and display on one or more LCD displays attached to the shoe, the seat number and the total of the game cards comprising the hand(s) dealt to each seat or player and the dealer, in sequence, as they are dealt by the dealer for each game round;
7. Calculate and display on one or more LCD displays attached to the shoe, each player's decision or strategy proficiency at the selected card count system by comparing, for example, each player's actual decisions on the hands played by the player to the decision indices, or decisions recommended by the selected card count system when the cards comprising a player's hand have a specific total, and the dealer's up-card has a specific game card value, and the true count for the shoe or the deck being dealt has a specific true count value; and the players are playing against or with a specific set of game rules;

8. Calculate and display on one or more LCD displays attached to the shoe, and/or on one or more remote computer monitors, during real time, each player's betting strategy, or betting proficiency when the bets a player makes for each hand of twenty-one played during the play of the game are made relative to the selected card count systems true count at the beginning of a round to be dealt for the specific shoe or decks being dealt;
9. Allow the dealer when he/she possess a Ace or a Ten or a picture card (having a value of ten) as an up-card, to use one or more of the shoe's keyboards to prompt the software to inform the dealer if his/her hand constitutes a two-card "21", or a "Blackjack" by displaying a symbol for a blackjack on one or more of the LCD displays attached to the shoe.
10. Calculate and display the card count system advantage (CSA), for a player who has been identified by the CPU's evaluation software as being most proficient at one of several basic strategies programmed into the software when the player is playing against or with a specific number of deck(s), a specific deck penetration, and a specific set of game rules.
11. Calculate and display the card count system advantage (CSA), for a player who has been identified by the CPU's evaluations software as being most proficient at one of several card count systems programmed into the software when the player is playing against or with a specific number of deck(s), a specific deck penetration, and a specific set of game rules.
12. Identify the active seats and the dealer's position during the course of the play of the game to signal the CPU software program which player or dealer position each card dealt from the shoe is assigned to.

The software functions described above are within a software program designated herein as ""Skill Check"" software to differentiate it from the ""Call 21"" software, or other software programs including networking or operating system software.

The Card Dispensing Shoe with Scanner Apparatus, System and Method (referring to FIG. 10 unless otherwise noted) of the present invention is coupled to the CPU, (internal or external CPU 79) that is coupled to a LAN server CPU or mainframe computer system. For this example, the alternate embodiment consisting of the additional keyboards and displays, including a standard 101-key keyboard and computer monitor coupled to the CPU 79 and present at the game table 94 (FIG. 13) will be used in order to adequately describe all functions. The CPU 79 in a typical installation at a game table 94 could be positioned on a moveable platform or drawer (not shown) attached to the underside of the game table 94. When the CPU 79 and its monitor and keyboard (not shown) are needed, the dealer will pull the drawer from beneath the game table 94 (FIG. 13) to access the monitor and keyboard. It should be noted that modern technology permits a portable notebook style computer to very easily be incorporated into the present invention's game table 94 (FIG. 13) and the cover to the notebook could be closed, if desired, to avoid distraction or information being displayed to non-casino personnel.

In this example evaluation, the assumption is made that when the ""Skill Check"" software is originally installed on the casino's CPU 79, all of the set up menus (i.e. Operator Data Entry Options, Casino Staff Program Users, Game Entry Options, Game Set Up, Comps Default Options, Tables, Rules, Password, and Comps, etc.) were called and the data relevant to the casino's staff and the parameters of the twenty-one games offered by the casino to its twenty-one customers were entered. Also, in this example evaluation "Rotate" has been selected from the Operator Data Entry Options as the display mode for the shoe's segmented LCD display 90 (FIG. 12), and/or as the game data display of the "Skill Check" software's data entry screen. When the "Rotate" display mode is selected the current evaluation's game data (total strategy decisions for the evaluation in progress, default basic strategy proficiency, default card count system proficiency, ID card count system proficiency, betting proficiency relative to the default card count system's true count for the deck(s) being dealt from the shoe, each type of strategy decisions made by each player during the current round and etc.), for each active seat or player, during and at the end of each game round dealt from the shoe. In the interests of expediency during the example evaluation detailed below the segmented display will change when each active seat makes it's final decision on the hand instead of when the End-Mode-Stand-Advance-Round key 86 (FIGS. 10, 11, 17 & 18) is pressed.

In the original program "set up", the casino's default Rule (number) 26 was entered. Rule 26 offers:

1) Insurance 2) Late Surrender, 3) Dealer Stands on Soft Seventeen, 4) Player can Double Down After Splitting, 5) Player can Split Aces Three Times, 6) Player can Split Other cards of equal value Three Times. Deck Penetration is seventy-five percent (75%).

First the dealer or operator, (DEO hereafter) will turn on the CPU 79. Next the DEO will turn on the electrical components of the shoe 76 coupled to the CPU 79 by pressing the On button 91 (FIG. 12). The DEO will then use the standard 101 keyboard of the CPU 79 to call the ""Skill Check"" evaluation software installed on the CPU 79, (or alternately installed on a host computer (not shown) coupled via a network to the CPU 79). The DEO will go to the "Sign On Screen" and enter his/her name and then his/her password and then press the ENTER key. If the correct name and password have been entered the programs "Main Screen" will be called. If the DEO wishes to check or edit any of the programs "set up" options he/she may do so at this time.

When the "Main Screen" is called by the DEO using the CPU's 79 standard keyboard, the LCD displays, 82 (FIG. 10) & 87 (FIGS. 10, 11) displayed the "Main Screen" bar menu selection, or message—"Enter Games"—. To start the "Skill-Check" software evaluation, the DEO presses the ENTER key on either keyboard 81 or keyboard 84. The message "Enter Game Data" is displayed on the LCD displays, 82 & 87. The DEO again presses the ENTER key using either keyboard 81 or keyboard 84. (The Game Data Entry screen, not visible to the DEO unless the DEO decided to not close the CPU's cover, or store the CPU beneath the top of the game table, is now on call.) The LCD displays, 82 & 87, display the message "Press ENTER to begin". The DEO presses the ENTER key. The display message is "Game Set Up". In the event the DEO wishes to check all of the "Game Set Up" menus options game settings before starting an evaluation of the game table's players, the DEO will press the "Function Keyboard's" (Keyboard 80 FIG. 16) CALL key. The "Game Set Up" menu's first option "Table" or—"Table 23" will appear on the LCD displays, 82 & 87. If the table number is correct the DEO will press the "Dn" key of keyboard 81 or keyboard 84 to call the next "Game Set Up" field, or Deck(s). "Decks 8" will appear on the LCD displays, 82 & 87. However, the DEO sees that the current game is being dealt with six (6) decks. To change the number of decks being dealt from eight (8) to six (6) decks as far as the CPU 79 is concerned the DEO will press the Decks key of keyboard 80 and the six (6) key on keyboard 81 or 84, simultaneously. "Decks 6" will appear on the LCD displays, 82 & 87. Press the Enter key to assign "Decks 6" to Table 23. To continue to scroll the "Game Set Up" fields, (Table, Decks, Rule Number, No Hole Card, default Basic Strategy, default Card Count System, and the Deck Penetration) the DEO will use the Up and Dn keys of keyboards 81 & 84. To end the "Game Set Up" check the DEO presses the EXIT key of keyboard 80.

If the DEO desires to change the default Card Count System from the Hi Opt I, (CCS #2), to the Hi Opt II, (CCS #6) Card Count System, the DEO presses the CALL key and the CCS key of keyboard 80, simultaneously. The LCD displays, 82 & 87 will read "CCS #2". To change the number of the default CCS from two (2) to CCS six (6), the DEO will press the CCS key of keyboard 80 and the six (6) key on keyboard 81 or 84, simultaneously and then press the Enter key to assign CCS six (6) to the current evaluation or press the EXIT key to return to the "Enter Seat Designation" message. The LCD displays, 82 & 87 will now read "Enter Seat Designation".

During this example evaluation, we assume that we have a game table that seats six players and there are five players who have been playing at the table for some time. To begin the evaluation, we must first designate the seats as either an active Date & Time file seat played by a player who's name is unknown (a customer or player not possessing a customer tracking card, or a customer who has walked in from the street and is a total stranger to the casino staff), or as a active Date & Time file seat played by a player who is known (a customer or player possessing a customer tracking card, or who's name and customer account number is know by the casino staff).

The deck of playing cards will have been shuffled and placed in the card dispensing shoe with scanner, (shoe 76)

The following is an illustration of how this example evaluation is implemented:

Seat 1—The customer is unknown.

The DEO presses the Seat-1 key from the seat designation keys 99 on either keyboard 81 or the seat designation keys 85 of keyboard 84, (FIG. 10) or keyboard 89 (FIG. 12) to designate Seat-1 as being active for the current evaluation. The Seat-1 designation keys on keyboards 81, and 84 (FIG. 10), and keyboard 89 (FIG. 12) are now all illuminated. The LCD displays of the apparatus or system disclosed in FIG. 10 read "S-1". While previously playing at the current game table, this customer was observed to either make a bet of $25.00, $50.00, or $75.00 for each hand played. The DEO presses one of the keyboards UBV keys, followed by numeric key two (2) and five (5) and the ENTER key to assign this player a unit bet value, (UBV), of $25.00. As each keystroke is entered by the DEO, the keystrokes are added to the LCD displays 82 & 87 resulting in - - S-1 UBV $25 - -. Since this player was previously observed by the DEO to never make a bet less than $25.00, or a bet larger than $75.00, the DEO presses one of the keyboards betting range (B/R) keys followed by the numeric key three (3) and then the ENTER key. The DEO has thus assigned the Seat-1 player a betting range of 1–3 betting units. The LCD displays 82 and 87 (FIG. 10) read - - S-1 B/R 3 - -.

During the course of the evaluation when the selected Card Count System (CCS) true count for the deck being dealt is plus one, (+1), or less than plus one, (+1), the software will automatically bet one betting unit or $25.00 for Seat-1. When the selected CCS true count for the deck being dealt is plus two, (+2), the software will automatically bet two betting units or $50.00 for Seat-1. When the selected CCS true count for the deck being dealt is plus three, (+3), or greater than plus three, (+3), the software will automatically bet three betting units or $75.00 for Seat-1. Such is true for the betting range assigned to the other active seats being evaluated by the software.

To end the seat designation mode for Seat-1 the DEO presses another seat designation key on either keyboard 81 or 84 (FIG. 10) or keyboard 89 (FIG. 12), or the End-Mode-Stand-Advance-Round key 86 (FIGS. 10, 11, 17 & 18). To designate Seat-2 as an open seat the DEO presses the numeric key zero (0) of keyboard 81 or 84. (or the DEO could designate the remainder of the seats, seat two (2) through seat six (6), as open seats the DEO would press the advance key 86 of keyboard 81 or 84)

Seat-2 is not being played.

The DEO presses the zero (0) key on either keyboard 81. or keyboard 84 to designate Seat-2 as an open, or inactive seat for the current evaluation. The Seat-2 designation keys on keyboard 81, and 84, (FIG. 10) and keyboard 89 (FIG. 12) are all dark. The LCD displays 82 & 87 (FIG. 10) read - - S-2 Open - -.

Seat-3 is occupied by an unknown player.

The DEO presses the three (3) key from the seat designation keys 99 on keyboard 81 or the three (3) key from the seat designation keys 85 of keyboard 84 (FIG. 10) or keyboard 89 (FIG. 12) to activate Seat-3 for the current evaluation. The Seat-3 designation keys on keyboard 81, and 84 (FIG. 10) and keyboard 89 (FIG. 12) are all illuminated. The LCD displays 82 & 87 read - -"S-3" - -. The DEO presses one of the unit bet value (UBV) keys on keyboard 81 or 84, followed by numeric keys one (1), zero (0), and zero (0) and the ENTER key to assign this player a unit bet value, (UBV), of $100.00. The LCD displays 82 & 87 (FIG. 10) read - - S-I UBV $100 - -. This player was previously observed by the DEO to never make a bet less than $100.00, or a bet greater than $1,000.00. The DEO presses one of the keyboard's betting range B/R keys followed by the numeric key zero (0) and then the ENTER key. The DEO has thus assigned the Seat-3 player a betting range of one to ten (1–10) betting units. The LCD displays 82 and 87 (FIG. 10) read - - S-3 B/R 10 - -. To end the seat designation mode for Seat-3 the DEO presses another seat designation key on either keyboard 81 or 84 (FIG. 10) or keyboard 89 (FIG. 12), or the End-Mode-Stand-Advance-Round key 86 (FIGS. 10, 10 11, 17 & 18).

Seat 4 is occupied by an unknown player.

The DEO presses the four (4) key of the seat designation keys 99 on keyboard 81 or the four (4) key of the seat designation key 85 of keyboard 84, (FIG. 10) or keyboard 89 (FIG. 12) to activate Seat 4 for the current evaluation. The Seat-4 designation keys on keyboards 81, 84 (FIG. 10) and keyboard 89 (FIG. 12) are all illuminated. The LCD displays 82 & 87 read - -"S-4" - -. The DEO presses one of the unit bet value (UBV) keys on keyboard 81 or 84, followed by a 1 and a 0 and the ENTER key to assign this player a unit bet value of $10.00. The LCD displays read - - S-4 UBV $10 - -. To end the seat designation mode for Seat-4 the DEO presses another seat designation key on either keyboard 81 or 84 (FIG. 10) or keyboard 89 (FIG. 12), the End-Mode-Stand-Advance-Round key 86 (FIGS. 10, 11, 17 & 18). Because the Seat-4 player is new to the game and his/her betting range is not known to the DEO; when the DEO presses the End Mode key 86, the software program will automatically assign Seat-4, a pre-selected default betting range (B/R) of one (1) to twenty (1–20) betting units. The LCD displays 82 and 87 (FIG. 10) read - - S-4 B/R 20 - -

Seat-5 and Seat-6 are being played at the same time by one person, a known player, i.e. Mr. Jones, who has a "Player Tracking Card" with him. The DEO asks Mr. Jones for his "Player Tracking Card" and then the DEO places the card into the magnetic strip reader slot 77. With the "Player Tracking Card" placed in the magnetic strip reader slot 77 the DEO presses the five (5) key of the seat designation keys 99 on keyboard 81, or keyboard 84 (FIG. 10) or keyboard 89 (FIG. 12); followed by the nine (9) key of either keyboard 81 or 84 (FIG. 10) to assign both seats five (5) and six (6) to Mr. Jones. The data entered for Seat-5 and Seat-6 during the current evaluation will be joined as if the player was playing only one seat. The LCD displays read - - S-5 Jones - -. Mr. Jones is a regular customer and the DEO knows that Mr. Jones minimum bet is $500.00 and his maximum bet is $2,500.00. The DEO assigns Mr. Jones a unit bet value (UBV) of $500.00 and a betting range (B/R) of five (5). To begin the evaluation, the DEO presses the (End-Mode-Stand-Advance-Round) key 86 of keyboard 81 or 84 (FIG. 10).

Since Seat-6 is the last seat to be designated, the next message immediately on the LCD displays read - - Seat-1 BURN CARD—The DEO presses the Page-Up/Burn key 103 of keyboard 81 (FIGS. 10 & 17) or keyboard 84 (FIGS. 10, 11, & 18) and removes one or more "burn cards" to be placed in the discard rack (not shown) mounted on the game table 94 (FIG. 13). (each burn card that is removed from the shoe is read by the shoe's scanner. However, since the player's do not see the value of the burn card, the selected card count systems (CCS) "card count value" of the burn cards are not considered by the program when calculating the running and true counts for the deck(s) being dealt from the shoe.) To end the "Burn Card mode" the DEO presses the plus, (+) key, (End-Mode-Stand-Advance-Round) key 86 of keyboard 81 (FIGS. 10 & 17) or keyboard 84 (FIGS. 10, 11, & 18) and the LCD displays 82 and 87 (FIG. 10) read: - - S-1 Enter Card or Decision - -.

After the above described procedure for entering the above noted pertinent data for each player, the following describes the game play:

Round 1.

As the DEO deals the cards from the card dispensing shoe with scanner 76 that is coupled to the "Skill-Check" software program, each card value is read and assigned to a designated active seat or the dealer's position and the LCD displays 81 and 87 change: - - S-1 T- -, followed by - - S-3 T- -, - - S-4 4 - -, - - S-5 8 - -, - - S-6 5 - -, and - - Dlr 1 (Ace) - -.

The second card for the players is then dealt from the shoe by the DEO to the players: - S-1 T T *20 - -, followed by - - S-3 T 2*12 - - S-4 4 7*11 - -, - - S-5 8 8 *16 - -, and - - S-6 5 T * 15 - -, and - - Dlr 1 (Ace) - -. (the dealers hole card value is not displayed at this time for security reasons)

After the dealer's hole card is dealt by the DEO to the dealer from the shoe the LCD display reads; - - Insurance - -. The dealer asks the players if they want insurance. Only Seat-4 takes insurance. The DEO presses the four (4) key on either keyboard 81 or 84 (FIG. 10) to record the insurance bet for Seat-4. The LCD displays read; - - S-4 4 7 * 11. Directly beneath the "S" of the LCD display for Seat-4, on a second line, will be a "I" to record Seat-4's decision to insure his/her hand. Seat-4 changes his/her mind and takes back the insurance bet. When in the Insurance Mode the numeric keys one through seven of keyboards 81 and 84 (FIG. 10) act as toggle keys. The DEO presses the four (4) key once again to record that Seat-4 had a change of mind and did not take insurance. The LCD displays read; - - S-4 4 7* 11. The "I" or the recorded insurance decision displayed directly beneath the "S" of the LCD display for Seat-4, on a second line, is removed and replaced with a "R" to record the fact that Seat-4 refused to insure his/her hand. Seat-5 now takes insurance. The DEO presses the five (5) key on either keyboard 81 or 84 to record the insurance bet for Seat-S. The LCD displays read; - - S-5 8 8 * 16. Directly beneath the "S" of the LCD display for Seat-5, on a second line, will be a "T" to record the fact that Seat-5 took insurance. None of the other players take insurance.

Before proceeding with the game, the dealer, (DEO), needs to know if he/she has a two-card twenty-one or blackjack. The DEO presses the Insert/BJ key 104 on keyboard 81 (FIGS. 10 & 17) or 84 (FIGS. 10. 11 & 18). The CPU program signals the dealer that he/she does not have a ten-card, or a picture card, as a hole card by causing the LCD displays 82 & 87 (FIG. 10) to momentarily flash on and off with a designated color, i.e. green, while displaying the data for the first active Seat-1: - - S-1 T T *20 - -.

(in the event the dealer did have a ten-card or a picture card in the hole, when the DEO pressed the Insert/BJ key (FIGS. 17 & 18) the LCD displays 82 & 87 (FIG. 10) would momentarily flash on and off with a designated color, i.e. red, while displaying: - - BJ End of Round - -)

In this case, the dealer does not have a blackjack.

Seat-1 is the first active seat. The LCD displays 82 & 87 (FIG. 10) are - S-1 T T *20 - -

Seat-1 stands.

The DEO presses the plus, (+) key, (End-Mode-Stand-Advance-Round) key 86 on either keyboard 81 or 84 (FIG. 10) to record Seat-1's Stand decision, and the LCD displays 82 & 87 (FIG. 10) are that of the next active seat and the displays read: - - S-3 T 2 * 12 - -. The Stand decision S is recorded on a second line beneath the "S" of S-1. In the event the Rotate display mode has been selected from the Operator Data Entry Options; the segmented LCD display 90 located directly beneath numeric key one (1) of keyboard 89 (FIG. 12) will display, for example, "1", or the total number of strategy decisions made by the player in Seat-1 for the current evaluation.

Seat-3 is the next active seat. The LCD Displays 82 and 87 (FIG. 10) are - - S-3 T 2*12 -

Seat-3 hits.

The DEO deals a third card, a hit card, from the shoe and delivers the third card to Seat-3. Since the DEO did not use any of the keys carried by keyboards 81 and 84 (FIG. 10) to record a Stand, Double-Down or Split decision for Seat-3, when the third card for Seat-3 passes over the shoe's 76 scanner 41 (FIGS. 1, 2, 4, & 6) as it is being removed from the shoe to be delivered to Seat-3, the software recognizes and automatically records that game card's value as being a hit card for Seat-3. The third game card's value, or the hit card, for Seat-3 is ten (10). Seat-3, having a hand total of twenty-two, breaks the hand and the software automatically advances to Seat-4. The Hit decision H is recorded on a second line beneath the "S" of S-3. If the third card, the hit card, was a nine (9) and did not bust the Seat-3 hand the LCD display would be: - - S-3 T 2 9 *21 - - and the dealer would have to press the stand key 86 (FIG. 10) to advance to Seat-4. The Hit and Stand decisions would be recorded on a second line beneath the "S" of S-3. The H first, followed by the S, or i.e. HS. The segmented LCD display 90 located directly beneath numeric key three (3) of keyboard 89 (FIG. 12) will display, for example, "CS-100", Cr the selected default Basic Strategy proficiency attained by Seat-3 on the hand(s) played.

Seat-4 is the next active seat. The LCD displays 82 and 87 (FIG. 10) are S-4 4 7 *11 - -, Seat-4 doubles down.

The DEO presses the asterisk, (*), or double-down key on keyboard 81 or 84, to record Seat-4's decision to Double-down, and then removes the double-down card for Seat-4 for delivery to the Seat-4 player, from the shoe. The Double-down decision D is recorded on a second line beneath the "S" of S-4. The software automatically advances to Seat-5. The LCD displays 82 & 87 (FIG. 10) read: - - S-5 8 8 * 16 - - The segmented LCD display 90 located directly beneath numeric key four (4) of keyboard 89 (FIG. 12) will display, for example, "CS-100", or the selected default Card Count System proficiency attained by Seat-4 on the hand(s) played.

Seat-5 is the next active seat. The LCD displays read: - - S-5 8 8 * 16.

Seat-5 splits the two (2) eights (8).

The DEO presses the backslash, (/), or split-key on keyboard 81 or 84 (FIG. 10). The LCD displays 82 & 87 (FIG. 10) read: S-5/1 8 and S-5/2 8. The Split decision P is recorded on a second line beneath the "S" of S-5/1 8. The dealer removes a card from the shoe for delivery to Seat-5 and places it as the second card for the first split hand of Seat-5, or S-5/1 8. The second card for the first split hand is a tencard and the LCD displays for the first split hand is S-5/1*18. Seat-5 stands on the first split hand. The Split decision P and Stand decision S are recorded on a second line beneath the "S" of S-5/1, i.e. PS. The LCD displays 82 & 87 (FIG. 10) is now S-5/2 8. The DEO deals a second card, having a game card value of seven (7), to the second split hand of Seat-5. The LCD displays 82 & 87 (FIG. 10) for Seat-5 is now S-5/2 *15. The DEO removes another card from the shoe for delivery to Seat-5 and hits seats the two-card hand total of fifteen (15) for Seat-5's second split hand, with a third card, or a ten-card. The hit or ten-card busts the Seat 5/2 hand of fifteen (15). The Hit decision H is recorded on a second line beneath the "S" of S-5/2. The segmented LCD display 90 located directly beneath numeric key five (5) of keyboard 89 (FIG. 12) will display, for example, "6–100", or the number (6) assigned to a specific Basic Strategy (BS) or Card Count System (CCS) by the software, and the player's proficiency (100%) at that BS or CCS which the software has identified the player in Seat-5 as having attained the highest proficiency, and this display is know as the player's or seat's ID Count proficiency. When the player achieves the identical proficiency in more than one BS or CCS the programs sorts through the count system advantage (CSA) files and selects the BS or CCS that provides the player with the greatest advantage over the house or casino. The program automatically advances to the next active seat; Seat 6. The LCD displays read: - - S-6 5 T*15 - -. The game rules for the current evaluation offer Late Surrender.

Seat-6 is the next active seat. The LCD displays 82 & 87 (FIG. 10) read: - - S-6 5 T *15 - -

Seat-6 Late Surrenders the hand totaling fifteen (15).

The DEO presses the period, (.), or surrender key on keyboard 81 or 84 (FIG. 10) to surrender Seat-6's hand. The Surrender decision G is recorded on a second line beneath the "S" of S-6. Seat-6 is the last active seat. The program automatically advances to the dealer's position or hand. The dealer exposes his/her hole-card. The dealer has an eight-card (8) as his/her hole-card. The rules of the game specify that the dealer must stand on all hands totaling seventeen (17) or more and the dealer must hit all hands totaling less than seventeen. No Stand or Hit decisions are recorded for the dealer. The game card values comprising the dealer's hand, and the dealer's hand total are automatically recorded by the software as they are removed from the shoe 76 and delivered to the dealer's position on the game table. The LCD display reads: - - Dlr 1 8*19 EOR - -. (EOR=End of Round). Before or after the dealer has settled the remaining hands for the active seats he/she will press the plus, (+), End-Mode-Stand-Advance-Round) key 86 (FIG. 10) to store the data for round one (1) to a data file in preparation for the data to be entered for round two (2).

The player playing seats five (5) and six (6) bet one (1) betting unit for Seat-5 and three (3) betting units for Seat-6 for round 1. At the end of round one (1) the segmented LCD display 90 located directly beneath numeric keys five (5) and six (6) of keyboard 89 (FIG. 12) will display, for example, "BP-50", or Seat-5 and Seat-6's combined betting proficiency relative to default card count system's true count for the deck(s) being dealt from the shoe for the current evaluation.

Round 2.

The DEO is not required to burn any cards before dealing any rounds from the deck other than the initial round, round one (1), dealt from a freshly shuffled deck(s). The LCD displays read: - - S-1 - -. Before any cards are dealt from the shoe for round two (2); the player in Seat-1 quits. The dealer presses the one key (1) of the seat designation keys 99 on keyboard 81 or keyboard 84 (FIG. 10) or keyboard 89 (FIG. 12) to designate Seat-1 as not being played during the current round of the current evaluation. The illuminated seat designation key one (1) on keyboard 81, and 84, (FIG. 10) and keyboard 89 (FIG. 12) now go dark. The LCD displays 82 and 87 (FIG. 10) read: - - S-3 - -.

Seat-3 is the first active seat.

Seat-3 decides to also play Seat-2 during round two (2).

The dealer presses the two-key (2) of the seat designation keys 99 of keyboard 81, or keyboard 84 (FIG. 10) or keyboard 89 (FIG. 12); followed by pressing the eight (8) key, on either keyboard 81 or keyboard 84 (FIG. 10) to activate Seat-2 and assign Seat-2 to the same player that is playing Seat-3; thereby compiling the game data for Seat-2 & Seat-3 for the current evaluation. The Seat-2 seat designation key on keyboards 81, and 84 (FIG. 10) and keyboard 89 (FIG. 12) are now all illuminated. The segmented data display for Seat-2 will now be identical to that of Seat-3, or, for example, "CS-50". The LCD displays 82 and 87 (FIG. 10) read: - - S-2 - -.

Seat-2 is now the first active seat.

A new player now sits down in Seat-1. The DEO activates Seat-1 by pressing the Seat-1 key of the seat designation keys 99 on keyboard 81 or the Seat-1 key of the seat designation keys 85 of keyboard 84 (FIG. 10), or the Seat-1 key of the seat designation keys of keyboard 89 (FIG. 12). The Seat-1 designation keys on keyboards 81, and 84 (FIG. 10) and keyboard 89 (FIG. 12) are now illuminated.

The software is now ready to record the cards to be dealt from the shoe to each active seat, and the game decisions of the players for each of the active seats for round two (2).

When the CPU 79, and CPU monitor remain exposed to the DEO, the results of an evaluation in progress and all data entered to the "Skill-Check"—Data Entry Screen can be viewed by the casino floor supervisor(s): the number of decks being dealt, the current deck penetration, the current running and true counts for the deck(s) being dealt from the shoe 76 and the compiled results of the data entered generating each player's, default Basic Strategy proficiency, default Card Count System proficiency, ID Count proficiency, ID Count System Advantage, (CSA), Betting Proficiency and etc. for all rounds dealt to the players for the current evaluation are displayed on the Data Entry Screen and can be viewed during real time. Also, each player's Unit Bet Value (UBV) Betting Range (B/R) number of Rounds played, number of Hands played, and Win/Loss figures for the current evaluation are available to the DEO on an individual basis by means of the Active Seat mode during real time. The default Active Seat is the first active seat at the game table being evaluated. The Active Seat mode for another active seat can be activated at any time during data entry by pressing the Enter key of keyboard 81 (FIG. 10) or keyboard 84 (FIG. 11) followed by pressing a seat designation key 99 on keyboard 81 or a seat designation key 85 on keyboard 84 (FIG. 10), or keyboard 89 (FIG. 12) of any active seat or player who's individual game data is to be displayed for viewing. The Active Seat mode display remains constant for all subsequent rounds for the designated Active Seat. The Active Seat mode for a designated seat is terminated by pressing the Enter key followed by another active seat number selected from one of the seat designation keyboards.

In the event that the "Skill-Check" software is installed on, or connected to, a LAN a remotely located casino staff person using a remote keyboard and monitor connected to the LAN can select any game table 94 in the casino that is being evaluated by means of the card dispensing shoe with scanner apparatus or system of this invention that is connected to the LAN and will be able to view all data entered to the "Skill-Check"—Data Entry Screen and the compiled results for the desired table game selected and evaluated during real time.

When the DEO no longer wishes to use the "Skill-Check" program, the DEO will press the EXIT key of keyboard 80. To call another independent software program installed on the CPU 79, the DEO will press the CALL button of keyboard 80 and the appropriate number of the desired program. The two (2) key, for example will call the software program designated as program two (2). To exit this new program press the EXIT key of keyboard 80.

In summary, the ""Skill Check"" software is designed to enable the dealer or other casino personnel to use one or more of the keyboards carried by the shoe 76 to set the parameters, (number of decks, deck penetration rule, game rules, default betting range, default basic strategy, default card count system and etc.) by which the players of the game are to be evaluated, and to signal the CPU 79 which game table 94 seats are active, during a game round, including the dealers position, and record the game card values dealt to each active seat or player; record the hand total of the game cards comprising a active seat or player's hand; and the strategy decision made by each seat's player (excluding the hit decisions which are automatically recorded by the CPU 79) on each hand played; and record the game card values dealt to the dealer and the dealer's hand total, for all rounds dealt during the current evaluation.

The values of the cards that are dealt from the deck, passing over the shoe's optical scanner, are automatically assigned to the correct game players or the dealer, and the cards that are "burned", or "exposed", and not dealt to the players are recorded and included in the "Skill Check" software's calculations. The shoes optical scanner will work in concert with the DEO's actions to record the disposition of all cards and card values dealt to the players and the dealer, or removed from the shoe during the course of the game. The "Skill-Check" software provides a means of tracking all players who sit in-and-out of a twenty-one game in progress that is being evaluated by the software during real time. Any decision or action that can be taken on a hand by the players of the game, within the parameters of the rules of the game set by the casino, can be duplicated and recorded jointly by the scanner and the DEO using the keyboards and displays coupled to the CPU and the ""Skill Check"" software.

Software Calculations

True Count Formula

True Count=Running Count divided by the ratio of the number of cards remaining in the shoe to the total number of cards in the game.

As one illustrative example:

If the running count (RC)=3 in a particular card count system, (if the RC is positive, the deck is considered favorable to the player(s), whereas if the RC is negative the deck is considered favorable to the dealer or house), and the number of cards in the game=52, and the remaining cards=32, then the true count (TC) would be

TC=3/(32/52)=4.875

Count System Advantage Calculation

Examples of a count system advantage (CSA) file calculation by the software is as follows:

1. A simulated run for a game of twenty-one using these parameters:

Basic Strategy: Zen Basic Strategy

Bet Range: 1-1 (a flat bet)

Rules: Insurance, Dealer Hits Soft Seventeen, Double Down on Original Two Cards Only, Split Aces Three Times, and Split Other Card Values Three Times Deck(s) Dealt: One (1)

Deck Penetration: Seventy-five-percent (75%)

Simulated Runs Count System Advantage (CSA) at one-hundred-percent proficiency: <0.2683%>

A player's strategy skills are evaluated and the player is identified as attaining his/her highest proficiency, (97%), in the Zen Basic Strategy, selected from those basic strategies programmed into the software, when playing against the parameters listed above for the simulated run using the Zen Basic Strategy. The software program then multiplies the simulated run's CSA of <0.2683%> by 1.03% to get the player CSA, of <0.2763%> for the player's game that is currently evaluated.

2. A simulated run for a game of twenty-one using these parameters is illustrated below;

Card Count System: Hi Opt I

Bet Range: 1–3

Rules: Insurance, Dealer Hits Soft Seventeen, Double Down on Original Two Cards Only, Split Aces Three Times, Split Other Card Values Three Times Deck(s) Dealt: One (1)

Deck Penetration: Seventy-five-percent (75%)

Simulated Runs Count System Advantage (CSA) at one-hundred-percent proficiency: 1.0344%

A player's strategy skills are evaluated and the player is identified as attaining his/her highest proficiency, (92%) in the Hi Opt I card count system, selected from those card count systems programmed into the software, when playing against the parameters listed above for the simulated run using the Hi Opt I card count system. The software program then multiplies the simulated run's CSA of 1.0344% by 92% to get the player CSA, of 95.07% for the player's evaluated game played. The resulting card count system advantage (CSA) is in fact the player's real earning potential for the game evaluated.

Many of the card counting, betting strategy, etc. capabilities that are provided by at least one of the computers disclosed herein is separately provided in a computer software package known as "Counter-Measures" that is presently being licensed by Infinity Software Inc. of Las Vegas, Nev. Adaptation of this computer software with changes and/or additions thereto to carry out all of the above noted functions described with reference to the apparatus, system and method of this invention can be implemented by any computer programmer having reasonable skill in this technology.

Decision or Strategy Proficiency Calculation

An example of how the program calculates a player's decision or strategy proficiency at a selected card count system is as follows:

A player plays ten hands during the play of the game. Each of the ten hands played is comprised of two cards; one card having a game card value often (10) and the other a game card value of two (2). The two game cards having a game hand total of twelve (12). For all ten hands, the dealer has a up-card with a game card value of six (6), and the true count for the selected card count system for the deck being dealt is 3.0. The player must consider both the value of the dealer's up-card and the deck true count each time it is the player's turn to act on each of the ten hands dealt to the player.

The selected card count system's decision index for a hand to be played with a total of, (12), when the dealers up-card is a six, (6), and the card count system's true count is 3.0; recommends the player stand on the hand when playing against the above set of rules. For the first nine hands the player played, he/she chose to stand on the game hand total of twelve. The tenth hand the player chose to ignore the card count system's recommended decision indices to stand and hit the hand totaling twelve and busted. The player made ten strategy decisions on ten hands during the course of the play. Nine of those strategy decisions were identical to the selected card count system's decision index, or recommended strategy decision for a hand total of twelve, (12), against a dealer up-card of six, (6), when the selected card count system's true count for the shoe or deck being dealt was positive, or 3.0. The player's decision on the tenth hand did not match the selected card count system's decision index, or recommended strategy decision for a hand total of twelve, (12), when the dealer has a dealer up-card of six, (6), and the true count for the selected card count system and the shoe or deck being dealt was a positive 3.0.

The players actual decisions on the hands played were identical to the selected card count system's decision index recommendations nine out of ten times. Therefore, this players proficiency at the selected card count system, or decision indices, is nine (9) divided by (10), or ninety-percent, (90%).

(Note: A player's basic strategy proficiency is calculated in the same manner as is a player's card count system proficiency except; no true count is generated when using only a basic strategy, the game cards have no card count values, and therefore a true count is not factored into a basic strategy's proficiency calculations.)

Betting Proficiency Calculation

Those persons skilled in the art use more than one way to calculate a twenty-one players betting proficiency when the sum of the player's bets, for each hand(s) played during each round of the game, vary in direct relationship to a selected card count system's true count at the beginning of the round to be dealt. One such way to calculate a player's betting proficiency is described below:

a. The minimum bet allowed at a twenty-one table is $100.00; and the maximum bet allowed is $1,000.00.

b. A players unit bet value (UBV) is $100.00. If a player bets $300.00 on a hand; the player has bet three UBV on the hand. If a player bets $200.00 on a hand; the player has bet two UBV, etc.

c. The selected card count system (CCS) recommends that the player always bet the table minimum, or one UBV, for any hand(s) to be played during the first round to be dealt from a freshly shuffled deck as the true count is always zero, (0.0).

d. At the beginning of each succeeding round to be dealt from the same deck; the selected CCS recommends that the player's bet, for each hand to be played during that round, is one UBV for each increment of a rounded positive true count as illustrated below.

EXAMPLE

| | |
|---|---|
| If the True Count = 0 | Then bet 1 (UBV) |
| If the True Count = 1 | Then bet 1 (UBV) |
| If the True Count = 1.5 | Then bet 2 (UBV) |
| If the True Count = 2 | Then bet 2 (UBV) |
| If the True Count = 2.5 | Then bet 3 (UBV) |
| If the True Count = 3 | Then bet 3 (UBV) |
| If the True Count = 10 | Then bet 10 (UBV) |
| If the True Count = 12 | Then bet 10 (UBV) |

e. At the beginning of each succeeding round to be dealt from the same deck; the selected CCS recommends that the player's bet, for each hand to be played during that round, is one UBV whenever the deck true count is negative as illustrated below.

EXAMPLE

| | |
|---|---|
| If the True Count = −0.7 | Then bet 1 (UBV) |
| If the True Count = −10 | Then bet 1 (UBV) |

f. A player's betting proficiency for the following rounds to be dealt, starting with round one, from a newly shuffled deck would be calculated as:

BEGINNING of ROUND:

(True Count=TC)

| | | | |
|---|---|---|---|
| Round 1 | TC = 0.0 | 1 (UBV) BET: | Betting Proficiency = 100% |
| Round 2 | TC = +2.0 | 2 (UBV) BET: | Betting Proficiency = 100% |
| Round 3 | TC = +4.0 | 4 (UBV) BET: | Betting Proficiency = 100% |
| Round 4 | TC = −3.0 | 1 (UBV) BET: | Betting Proficiency = 100% |
| Round 5 | TC = −2.0 | 2 (UBV) BET: | Betting Proficiency = 80% |
| Round 6 | TC = 0.0 | 1 (UBV) BET: | Betting Proficiency = 83% |
| Round 7 | TC = +5.0 | 5 (UBV) BET: | Betting Proficiency = 86% |
| Round 8 | TC = +12.0 | 10 (UBV) BET: | Betting Proficiency = 87% |
| Round 9 | TC = +6.0 | 6 (UBV) BET: | Betting Proficiency = 89% |
| Round 10 | TC = 0.0 | 6 (UBV) BET: | Betting Proficiency = 80% |

Operation of the "Call 21" Software

The keyboard(s) 96 (Referring to FIGS. 13 & 14 unless otherwise indicated) are embedded in the game table top 94 adjacent to each player's seat or betting box 95 and are coupled to the 15. previously discussed electronic components of the apparatus and system of the present invention. The keyboard(s) 96 are used by each player, at their option, to interact with an independent computer software game program called "Call 21" that is installed in the CPU (internal or external CPU), the host computer, or the LAN network computers/servers coupled to the shoe 76 (FIG. 10). (The computer software game program "Call 21" may also be incorporated in the "Skill-Check" software program and run concurrently therewith.)

The keyboard(s) 96 allow each of the game players to interact with the "Call 21" computer game by signaling the "Call 21" software that the player is making a "proposition bet", or wager as to what the cards that will be dealt to the players of the game of twenty-one in the upcoming round to be dealt from the shoe 76 will possibly be.

In using the keyboards (96) embedded in the top of the game table (94) to make a "Call 21" wager, the player must first have "Call 21" game credits displayed on the keyboard (96) display. The dealer of a game of twenty-one being dealt from the present invention will use the shoe 76 (FIG. 10) keyboards to interact with the "Call 21" game software by recording both the purchase of "Call 21" game credits and the cashing out of "Call 21" game credits by the players of the game at the game table 94. The value of the game credits can be any dollar amount designated by the software programmer. For the purpose of the below illustration, we will value the game credits at $1.00 each.

EXAMPLE

A player seated at the game table 94 at Seat-5 wishes to purchase $20.00 of "Call 21" game credits. This player tenders to the dealer $20.00 in cash, or casino's gaming chips valued at $20.00. The dealer presses the "Game" key 100 on keyboard 81, or keyboard 84 (FIG. 10) followed by the player's seat number (5) on one of the seat designation keys 99 of keyboard 81 (FIGS. 10 & 17), or the seat designation keys 85 of keyboard 84 (FIGS. 10, 11 & 18), or keyboard 89 (FIG. 12) follow by the "Buy-In" key 101 of either keyboard 81 (FIGS. 10 & 17), or keyboard 84 of (FIGS. 10, 11, & 18), followed by numeric keys two (2) and zero (0), followed by the ENTER key. This sequence of keystrokes will assign $20.00 in "Call 21" game credits to the purchasing player in Seat-5 which will be reflected on that player's "Call 21" LED display 97 positioned and embedded in the game table 94 at Seat-5.

Additionally, when one of the shoe's 76 (FIG. 10) "Buy-In" keys 101 of keyboard 81 (FIGS. 10 & 17), or keyboard 84 (FIGS. 10, 11 & 18) is pressed, the electronic digital display 98 (FIG. 13) that is attached to the game table 94 will display the transaction for all to see. i.e. - - S5 - $20.00 - -. The color of the digital "Buy-In" display 98 (FIG. 13) is preferably green. The "Call 21" program's accounting software will be updated and record the "Buy-In" transaction for Seat-5.

A player seated at the game table at Seat-6 has been playing "Call 21", has won, and now informs the dealer that he/she wishes to cash-out his/her "Call 21" game credits totaling 200, or $200.00. The dealer presses the "Game" key 100 on keyboard 81 (FIGS. 10 & 17), or keyboard 84 (FIGS. 10, 11 & 18) followed by the six-key (6) of the seat designation keys 99 located on keyboard 81 (FIGS. 10 & 17), or the six-key (6) of the seat designation keys 85 located on keyboard 84 (FIGS. 10, 11 & 18), or keyboard 89 (FIG. 12) followed by the "Cash-Out" key 102 located on keyboard 81 (FIGS. 10 & 17), or keyboard 84 of (FIGS. 10, 11 & 18), followed by numeric keys two (2), zero (0) and zero (0), followed by the ENTER key. This sequence of keystrokes will activate the digital display 98 (FIG. 13) which will display (not shown) the seat number of the player, and the amount of game credits the player is cashing out. i.e. S6–$200. The color of the digital cash-out display 98 (FIG. 13) is preferably red. When the player's game credits are cashed out, the 200 game credits will be cleared from seat six's "Call 21" keyboard's 96 LED display 97 positioned and embedded in the game table 94 at Seat-6. The "Call 21" programs accounting software will be updated and record the cash-out transaction for Seat-6. The dealer will cash out the 200 game credits by paying the player in Seat-6 with the casino's gaming chips valued at $200.00.

There are seven (7) types of "Call 21" game options the player(s) may select and wager on by means of the "Call 21" keyboard 96 and LED display 97 (FIGS. 13 & 14) for any upcoming round of twenty-one to be dealt from the shoe 76. The player can make any number of "Call 21" game wagers for any one upcoming round to be dealt from the shoe 76. For example, a "Call 21" game player may wager on one or more of the following game options: (1) the hand total of the original two-card-hand dealt to each player; (2) the card value of the dealer's up-card; (3) the card value and suit of the dealer's up-card; (4) the card values of the original two cards dealt to the player as the player's hand; (5) the card values and suit of the original two cards dealt to the player as the player's hand; (6) the delivery sequence of the card values of the original two cards dealt to the player as the player's hand; and (7) the delivery sequence of the card values and suit of the original two cards dealt to the player as the player's hand for the upcoming round to be dealt from the shoe 76. Each of these options when wagered is treated as a separate wager. More than one wager may be made for a specific type of wager (i.e. the card value of the dealer's up-card) for the same round to be dealt from the shoe 76.

"Call 21" game option one (1): AUTO/Select key is dark.

The player can only bet game option (1), the possible hand total of the player's original two-card-hand to be dealt to the player, by manually inputting his/her possible hand total into the CPU's 79 game software for any upcoming round by means of the numeric keys carried by the keyboard 96 (FIGS. 13 & 14), when the AUTO/Select key (FIG. 14) is dark. Next, the player presses the 2/Player/Hand key (c) (FIG. 14), followed by two of the ten numeric keys carried by the "Call 21" keyboard (FIG. 14), i.e. the one (1) key and the eight (8) key, and then the Enter Key (h) (FIG. 14.) to wager that the projected player's hand total for the upcoming round will consist of any two cards totaling eighteen (18). In the game of blackjack and in "Call 21" a Ace card will be valued at one or eleven. If a two-card "Call 21" hand contains one Ace the Ace will be valued at eleven. If a two-card "Call 21" hand contains two Aces one Ace will be valued at eleven (11), and the other Ace will be valued at one (1) thereby providing the player with a hand total of twelve (12).

The player can enter game options (2), (3), (4), (5), (6) and (7) into the CPU's 79 game software, when the "Call 21" keyboard's AUTO/Select key (FIG. 14) is dark, by manually pressing all of the keys required to enter a specific game option; or the player can enter game options (2), (3), (4), (5), (6) and (7) into the CPU's 79 game software by pressing the dark AUTO/Select key (FIG. 14) to illuminate it, and then manually selecting the game option for the current wager from the "Call 21" keyboard (FIGS. 13 & 14) and then allowing the CPU to automatically select the actual game card values and suit(s) of the game cards for the game option wagered on for the upcoming round to be dealt to the player from the shoe 76.

A "Call 21" game player may have the CPU 76 (FIG. 10) use a random number generator to select the card values, card values & suits, and delivery sequence of all game options offered by the "Call 21" game software with the exception of game option one (1).

"Call 21" game option (2); the card value of the dealer's up-card. The AUTO/Select key is activated or illuminated.

An example of how each player could activate the CPU 79 to automatically select a "Call 21" game card (for the player), as the possible card value of the dealer's up-card for an upcoming round of twenty-one that is to be dealt from the cards remaining in the deck(s) of the shoe 76 immediately follows. Example. Each player would press the AUTO/Select key (a) (FIG. 14), a toggle key, which will then illuminate. Next, the player would press the 1/Dlr Up-Card key (b) (FIG. 14), followed by the Card/Value key (e) (FIG. 14), and then the Enter Key (h) (FIG. 14) to bet $1.00 that the dealer's up-card for the next round dealt from the shoe will be of the card value selected by the CPU random number generator from the cards the software programs knows to be remaining in the deck(s) carried by the shoe. In the above example, the CPU might give the player a choice to wager that the dealer's up-card for the next round will have a game card value of six (6). If selected, the six (6) will be displayed as the first card of the (C1) card value display (FIG. 14) under "Dealer" in the "Call 21" LED display 97 embedded and positioned in the game table 94 (FIG. 13) adjacent to the seat the player is playing. If the player likes the CPU's selection, he/she will press the Enter key (h) once again to confirm the selection. If the player does not like the CPU's 76 selection, the player will press the Clear/Next key (j) to clear the six (6) selection from the card value display C1 (FIG. 14) and signal the CPU 76 to make another selection using it's random number generator. To start the AUTO/Select process from the beginning, press the Clear/next key (j) once again.

"Call 21" game option (2); the card value of the dealer's up-card. The AUTO/Select key is not activated, or dark.

An example of how each player could manually select a "Call 21" game card (for the player), as the possible card value of the dealer's up-card for an upcoming round of twenty-one that is to be dealt from the cards remaining in the deck(s) of the shoe 76 immediately follows. Example. Each player would press the 1/Dlr Up-Card key (b) (FIG. 14), followed by the Card/value key (e) (FIG. 14), followed by the numeric six (6) key (FIG. 14) then the Enter Key (h) (FIG. 14) to bet $1.00 that the dealer's up-card for the next round dealt from the shoe will be a game card with a card value of six (6). When the card valued at six (6) is selected it will be displayed as the first card of the (C1) card value display (FIG. 14) under "Dealer" in the "Call 21" LED display 97 embedded and positioned in the game table 94 (FIG. 13) adjacent to the seat the player is playing. If the player likes his/her selection, he/she will press the Enter key (h) once again to confirm the selection. If the player does not like the selection, the player will press the Clear/Next key (j) to clear the six (6) selection from the card value display C1 (FIG. 14) and signal the CPU 76 that the player will make a new selection. (the computer knows the card values and suits of all cards remaining in the deck(s) of the shoe to be dealt to the players during any upcoming round. In the event the CPU identifies any card values or suited card values selected for an upcoming round as not being contained in the deck(s) of the shoe 76 to be dealt to the players a message will be super imposed on the LED display (FIGS. 13 & 14) that reads: "Select Another Card")

"Call 21" game option (3); the card value and suit of ithe dealer's up-card. AUTO/Select.

An example of how each player could use the CPU to automatically select the possible card value and suit of the dealer's up-card for an upcoming round of twenty-one that is to be dealt from the cards remaining in the deck(s) of the shoe 76 is as follows. Example. The AUTO/Select is illuminated. The player would press the 1/Dlr Up-Card key (b) (FIG. 14), followed by the Card/value key (e) (FIG. 14), and then any one of the card suit keys (s) (FIG. 14) (Hearts, Clubs, Diamonds, and Spades), and then the Enter Key (h) (FIG. 14) to bet $1.00 that the dealer's up-card for the next round dealt from the shoe will be of the card value and suit selected by the CPUs random number generator from the cards the software programs knows to be remaining in the deck(s) carried by the shoe. In the above example, the CPU might give the player a choice to wager that the dealer's up-card for the next round will possibly have a game card value of six (6) and the suit of the six (6) card will be Hearts. If selected, the six-of-hearts will be displayed as the first card of the (C2) card value and suit display (FIG. 14) under "Dealer" in the "Call 21" LED display 97 positioned and embedded in the game table 94 (FIG. 13) adjacent to the seat the player is playing.

"Call 21" game option (3); the card value and suit of the dealer's up-card. Manual selection.

An example of how each player could manually select the possible card value and suit of the dealer's up-card for an upcoming round of twenty-one that is to be dealt from the cards remaining in the deck(s) of the shoe 76 is as follows. Example. The AUTO/Select is dark. The player would press the 1/Dlr Up-Card key (b) (FIG. 14), followed by the Card/value key (e) (FIG. 14), then the numeric six (6) key, then the Hearts key (s) and then the Enter Key (h) (FIG. 14) to bet $1.00 that the dealer's up-card for the next round dealt from the shoe will be the six-of-hearts. When selected, the six-of-hearts will be displayed as the first card of the (C2) card value and suit display (FIG. 14) under "Dealer" in the "Call 21" LED display 97 positioned and embedded in the game table 94 (FIG. 13) adjacent to the seat the player is playing.

"Call 21" game option (4); the card values of the original two cards dealt to the player as the player's hand. The AUTO/Select. An example of a AUTO/Select selection of the possible card values of the two cards to be dealt as the player's original two-card-hand for an upcoming game round from the shoe 76 is illustrated below. The AUTO/Select key (a) (FIG. 14) is illuminated. Each player would press the 2/Player/Hand key (c) (FIG. 14), followed by the Card/value key (e) (FIG. 14), and then the Enter Key (h) (FIG. 14) to bet $1.00 that two cards to be possibly dealt as the player's original two-card-hand for the next round to be dealt from the shoe will be of the card values selected by the CPU's random number generator from the cards the software programs knows to be remaining in the deck(s) carried by the shoe. In the above example, the CPU might give the player a choice to wager that the two cards dealt to the player as the players original two-card-hand for the upcoming round will possibly be one card having a card value of ten (10) (any ten or picture card) and another card having a card value of nine (9). If selected, the ten (10) card value will be displayed as the second card of the (C1) card value display, and the nine (9) card value will be displayed as the third card of the (C1) card value display (FIG. 14) in the "Call 21" LED display 97 embedded and positioned in the game table 94 (FIG. 13) adjacent to the seat the player is playing. If the player likes the CPU's selections, he/she will press the Enter key (h) once again to confirm the selection. If the player does not like the CPU's 76 selection, the player will press the Clear/Next key (j) to clear the ten (10) and nine (9) card value selections from the card value display (C1) (FIG. 14) and signal the CPU 76 to make another selection using it's random number generator. To start the AUTO/Select process from the beginning, press the Clear/next key (j) once again.

"Call 21" game option (4); the card values of the original two cards dealt to the player as the player's hand. Manual selection.

An example of a manual selection of the possible card values of the two cards to be dealt as the player's original two-card-hand for an upcoming game round from the shoe 76 is illustrated below. Example. The AUTO/Select key (a) (FIG. 14) is dark. Each player would press the 2/Player/Hand key (c) (FIG. 14), followed by the Card/value key (e) (FIG. 14), and then the numeric keys 0/Ten (k) and nine (FIG. 14), and then the Enter Key (h) (FIG. 14) to bet $1.00 that of the two cards to be possibly dealt as the player's original two-card-hand for the next round to be dealt from the shoe one will have a card value often (10) and the other will have a card value of nine (9). When selected, the ten (10) card's value will be displayed as the second card of the (C1) display, and nine (9) card's value will be displayed as the third card of the (C1) card value display (FIG. 14) in the "Call 21" LED display 97 embedded and positioned in the game table 94 (FIG. 13) adjacent to the seat the player is playing. If the player likes his/her selections, he/she will press the Enter key (h) once again to confirm the selection. If the player does not like the selections, the player will press the Clear/Next key (j) to clear the ten (10) and nine (9) card value selections from the card value display (C1) (FIG. 14) and signal the CPU 76 that a new selection is to be make.

"Call 21" game option (5); the card values and suit(s) of the original two cards dealt to the player as the player's hand. AUTO/Select.

An example of a AUTO/Select selection of the possible card values and suit of the two cards to be dealt as the player's original two-card-hand for an upcoming game round from the shoe 76 is illustrated below. Example. The AUTO/Select key (a) (FIG. 14) is illuminated. Each player would press the 2/Player/Hand key (c) (FIG. 14), followed by the Card/Value key (e) (FIG. 14), and then any one of the card suit keys (s) (FIG. 14) (Hearts, Clubs, Diamonds, and Spades), and then the Enter Key (h) (FIG. 14) to bet $1.00 that the possible card values and suits of the two cards to be dealt as the player's original two-card-hand for an upcoming game round from the shoe 76 will possibly be of the card values and suits selected by the CPU's random number generator from the cards the software programs knows to be remaining in the deck(s) carried by the shoe. In the instant example, the CPU might give the player a choice to wager that the two cards dealt to the player as the players original two-card-hand for the upcoming round will possibly be one suited card having a card value of eleven (11), an Ace, i.e. the Ace-of-Spades, and another suited card having a card value often (10) and a card rank of Jack, i.e. the Jack-of-Spades. If selected the Ace-of-Spades will be displayed as the second card of the card value and suit display (C2), and the Jack-of-Spades will be displayed as the third card of the (C2) card value and suit display (FIG. 14) in the "Call 21" LED display 97 embedded and positioned in the game table 94 (FIG. 13) adjacent to the seat the player is playing. If the player likes the CPU's selections, he/she will press the Enter key (h) once again to confirm the selection. If the player does not like the CPU's 76 selection, the player will press the Clear/Next key (j) to clear the Ace-of-Spades and the Jack-of-Spades, card values and suit, selections from the card value and suit display (C2) (FIG. 14) and signal the CPU 76 to make another selection using it's random number generator. To start the AUTO/Select process from the beginning, press the Clear/next key (j) once again.

"Call 21" game option (5); the card values and suit(s) of the original two cards dealt to the player as the player's hand. Manual selection.

An example of a manual selection of the possible card values and suit of the two cards to be dealt as the player's original two-card-hand for an upcoming game round from the shoe 76 is illustrated below. Example. The AUTO/Select key (a) (FIG. 14) is dark. Each player would press the 2/Player/Hand key (c) (FIG. 14), followed by the Card/Value key (e) (FIG. 14), by the 1/Ace key (i), and then the Spades key (s) FIG. 14, and then the Jack key (FIG. 14), and then the Spades key (s) (FIG. 14), and then the Enter Key (h) (FIG. 14) to bet $1.00 that the possible card values and suits of the two cards to be dealt as the player's original two-card-hand for an upcoming game round from the shoe 76 will possibly be the Ace-of-Spades and the Jack-of-Spades. When selected the Ace-of-Spades will be displayed as the second card of the card value and suit display (C2), and the Jack-of-Spades will be displayed as the third card of the (C2) card value and suit display (FIG. 14) in the "Call 21" LED display 97 embedded and positioned in the game table 94 (FIG. 13) adjacent to the seat the player is playing. If the player likes his/her selections, he/she will press the Enter key (h) once again to confirm the selection. If the player does not like the selections, the player will press the Clear/Next key (j) to clear the Ace-of-Spades and the Jack-of-Spades, the card values and suit selections from the card value and suit display (C2) (FIG. 14) and signal the CPU 76 that a new selection is to be made.

"Call 21" game option (6); the card values and delivery sequence of the original two cards dealt to the player as the player's hand. AUTO/Select.

For another type AUTO/Select wager for the upcoming round, the player would press, for example, the 2/Plr/Player/Hand key (c), followed by the Card/Value key (e), followed by the Delivery Sequence key (f) and finally the Enter key (h) to bet $1.00 that of the possible card values and suits and delivery sequence of the two cards to be dealt as the players original two-card-hand selected by the CPU for an upcoming game round from the cards the software programs knows to be remaining in the deck(s) carried by the shoe 76. In the instant example, the CPU might give the player a choice to wager that of two cards dealt to the player as the players original two-card-hand for the upcoming round one card will possibly be a card having a card value often (a ten or picture card), and the other card will have a card value of nine (9). If selected the ten (10) card value will be displayed as the second card of the card value display (C1), and the nine (9) card value will be displayed as the third card of the (C1) card value and suit display (FIG. 14) in the "Call 21" LED display 97 embedded and positioned in the game table 94 (FIG. 13) adjacent to the seat the player is playing. If the player likes the CPU's selections he/she will press the Enter key once again to confirm the selection. If the player does not like the CPU's selections the player will press the Clear/Next key (j) to clear the, Ten (10), (any ten or picture card) and nine (9) card value selections made by the CPU from the (C1) display and signal the CPU 76 to make another selection using the random number generator. To start the selection process from the beginning, press the Clear/Next key (j) once again. If another 2/Player/Hand key (c) selection is made, the cards selected as the second selection will replace the first selections, the Ten (10), (any ten or picture card) and nine (9) card values in the (C1) display, etc.

"Call 21" game option (6); the card values and delivery sequence of the original two cards dealt to the player as the player's hand. Manual selection.

An example of a manual wager and selections for the upcoming round, the player would press, for example, the 2/Plr/Player/Hand key (c), followed by the Card/Value key (e), followed by 0/Ten (k), followed by the numeric nine (9)

key, (FIG. 14), followed by the Delivery Sequence key (f) and finally the Enter key (h) to bet $1.00 that of the possible card values and suits and possible delivery sequence of the two cards to be dealt as the player's original two-card-hand for an upcoming game round from the shoe 76 one card, the first card selected by the player to be dealt from the shoe to the player as the player's first card of the original two cards comprising the hand to be dealt, will possibly be any Ten (10), (any 10 or picture card), and the nine (9) card value, the second card selected by the player to be the second card dealt from the shoe to the player as the player's second card of the original two cards comprising the hand to be dealt from the shoe for the upcoming round. When selected the ten (10) card value will be displayed as the second card of the card value display (C1), and the nine (9) card value will be displayed as the third card of the (C1) card value and suit display (FIG. 14) in the "Call 21" LED display 97 embedded and positioned in the game table 94 (FIG. 13) adjacent to the seat the player is playing. If the player likes his/her selections he/she will press the Enter key once again to confirm the selection. If the player does not like the selections the player will press the Clear/Next key (j) to clear the, Ten (10), (any ten or picture card) and nine (9) card value selections from the display and signal the CPU 76 that a new selection (s) is to be made. To start the selection process from the beginning, press the Clear/Next key (j) once again. If another 2/Player/Hand key (c) selection is made, the cards selected as, the second selection will replace the first selections, the Ten (10), (any ten or picture card) and nine (9) card values in the (C1) display, etc.

"Call 21" game option (6); the card values, suit(s) and delivery sequence of the original two cards dealt to the player as the player's hand. AUTO/Select.

In another example of a AUTO/Select wager and selection for the upcoming round, the player would press, for example, the 2/Player/Hand key (c), followed by the Card/Value key (e), followed by any one of the card suit keys (s) (FIG. 14) (Hearts, Clubs, Diamonds, and Spades), followed by the Delivery Sequence key (f) and finally the Enter key (h) to have the CPU's random number generator select two possible card values and suit(s), and the possible sequence in which these two cards can be dealt to the player as the player's original-two-card hand from the cards the software programs knows to be remaining in the deck(s) carried by the shoe 76. In the instant example, the CPU might give the player a choice to wager that the two cards dealt to the player as the players original two-card-hand for the upcoming round will possibly be a card from the card suit of Spades having a card value of eleven (11), an Ace, i.e. the Ace-of-Spades, and another card from the suit of Spades having a card value often (10) and a card rank of Jack, i.e. the Jack-of-Spades. If selected the Ace-of-Spades will be displayed as the second card of the card value and suit display (C2), and the Jack-of-Spades will be displayed as the third card of the (C2) card value and suit display (FIG. 14) in the "Call 21" LED display 97 embedded and positioned in the game table 94 (FIG. 13) adjacent to the seat the player is playing. If the player likes the CPU's selections he/she will press the Enter key once again to confirm the selection. If the player does not like the CPUs selections the player will press the Clear/Next key (j) to clear the, Ace-of-Spades and the Jack-of-Spades card value and suit selections made by the CPU from the display and signal the CPU 76 to make another selection using the random number generator. To start the selection process from the beginning, press the Clear/Next key (j) once again. If another 2/Player/Hand key (c) selection is made, the cards selected as the second selection will replace the first selections, the Ace-of-Spades and the Jack-of-Spades that are displayed in the (C1) display, etc.

"Call 21" game option (6); the card values, suit(s) and delivery sequence of the original two cards dealt to the player as the player's hand. Manual selection.

In another example of a manual wager and selection for the upcoming round, the player would press, for example, the 2/Player/Hand key (c), followed by the Card/Value key (e), followed by the 1/Ace key (i) followed by any one of the card suit keys (s) (FIG. 14) (Hearts, Clubs, Diamonds, and Spades), followed by the Jack key (FIG. 14), followed by any one of the card suit keys (s) (FIG. 14) (Hearts, Clubs, Diamonds, and Spades), followed by the Delivery Sequence key (f) and finally the Enter key (h) to wager that two possible card values and suit(s), and the possible sequence in which these two cards can be delivered to the player as the player's original two-card-hand from the cards the software programs knows to be remaining in the deck(s) carried by the shoe 76. When selected the Ace-of-Spades will be displayed as the second card of the card value and suit display (C2), and the Jack-of-Spades will be displayed as the third card of the (C2) card value and suit display (FIG. 14) in the "Call 21" LED display 97 embedded and positioned in the game table 94 (FIG. 13) adjacent to the seat the player is playing. If the player likes his/her selections he/she will press the Enter key once again to confirm the selection. If the player does not like the selections the player will press the Clear/Next key (j) to clear the, Ace-of-Spades and the Jack-of-Spades card value and suit selections made by the player from the (C2) display and signal the CPU 76 that a new selection is to be made. To start the selection process from the beginning, press the Clear/Next key (j) once again. If another 2/Player/Hand key (c) selection is made, the cards selected as the second selection will replace the first selections, the Ace-of-Spades and the Jack-of-Spades that are displayed in the (C2) display, etc.

The sequence in which the "Call 21" game cards for the player's hand are always selected (regardless of the selection mode used) for a upcoming round to be dealt from the deck(s) remaining in the shoe 76 is as follows: The first possible card value selected is always displayed as the second card of the (C1) card display (FIG. 14); and the second possible card value selected is always displayed as the third card of the (C1) card display (FIG. 14). The first possible card value and suit selected is always displayed as the second card of the (C2) card display (FIG. 14); and the second possible card value and suit selected is always displayed as the third card of the (C2) card display (FIG. 14). "Call 21" delivery sequence bets are limited to the 2/Player/Hand key (c) selections.

The sequence in which the "Call 21" game cards dealt to each player's hand for the round most recently dealt from the shoe 76 is as follows: The first card value of two card values to be dealt to each player's hand during the course of a round is always displayed as the second card of the (C1) card display (FIG. 14); and the second card value dealt of two card values to be dealt to each player's hand during the course of a round is always displayed as the third card of the (C1) card display (FIG. 14). The first card value and suit of two card values and suit(s) to be dealt to each player's hand during the course of a round is always displayed as the second card of the (C2) card display (FIG. 14); and the second card value and suit of two card values and suit(s) to be dealt to each player's hand during the course of the round most recently dealt from the shoe 76 is always displayed as the third card of the (C2) card display (FIG. 14).

To signal the "Call 21" game program that the player has made his last wager and selection for the round to be dealt from the shoe 76 the player presses the Play key (1). The round for which the wager(s) have been made is subsequently dealt from the shoe 76. When the round is completed and the software proceeds to settle the "Call 21" wagers or selections made by each player or seat for the completed round, the individual seats will be settled in sequence; the first active seat's wagers, if any, will be settled first, and then the next active seat and etc.

When a round is completed, during settlement the "Call 21" game software will compare each "Call 21" the Dealer's Up-card, and each Player's hand total and the cards comprising each player's hand to the Card Values, Card Values and Suit, and the Delivery Sequence selections, (if any) made by each player for the card(s) that could possibly be dealt from the deck(s) contained in the shoe 76 as the dealers up-card, and/or as each "Call 21" player's original two-card-hand during the round of twenty-one most recently dealt from the shoe 76, or the round currently being settled by the "Call 21" game software. During settlement the "Call 21" keyboard's LED 97 display will display the total number of wagers made for the round currently being settled. Each "Call 21" players first wager or selection will be settled first. The player's actual two-card-hand total of the cards dealt to the player for the current round will be super-imposed of the player's projected player hand total for the round display; PHT (FIG. 14), if any, which is displayed directly over the third card value display (C1). The players first game card selections made for the round currently being settled will be super-imposed over the cards dealt for the round most recently dealt from the shoe 76, that are presently displayed in the card value (C1) and card value and suit (C2) displays of each player's "Call 21" LED display 97 positioned adjacent to the seat the player is playing. If only one bet was made by the player for the round being settled, the "Bets" field will be zero (0). In the event the player has made more than one wager, the winning selections, (if any) will be identified and paid as described immediately above in the order in which the wager and card(s) to be dealt selections for the current round being settled were made.

At the beginning of the settlement for a "Call 21" player's game seat when a game round is completed, if three (3) wagers were made for the completed round the "Bets" field will display a three (3). When the first wager is settled the "Bets" field will display a two (2). When the second wager is settled the "Bets" field will display a one (1). When the third wager is settled the "Bets" field will display a zero (0). As each independent wager comes up for settlement, if any of the players "Call 21" game selections match the player hand total display (PHT) (FIG. 14), card value (C1) display, or the card value & suit (C2) display, or the delivery sequence display, of the card dealt as the dealer's Up-Card, or the cards dealt to the player as the player's original two-card-hand, and the sequence in which the cards were delivered to the dealer and the player, the matching display (s) will pulsate momentarily and then the credits won by the player for the matching selections will be posted to the "Win" field and added to the "Credits" field.

If the player wishes to make the same wagers and selections for the next round to be dealt from the shoe 76 the player will press the Repeat key (g). When pressed the Repeat key (g) will illuminate. As long as the Repeat key (g) remains lit the players wagers and selections will be automatically repeated for subsequent rounds to be dealt from the shoe 76 as long as the player has enough credits to cover the wagers. If the player does not want to repeat the wagers for a specific round the player will press the Repeat key (g) and it will go dark. To make the initial wagers and selections on any subsequent round to be dealt from the shoe the player will again press the Repeat key (g). To clear all wagers and selections from the CPU for the wagering seat press the illuminated Repeat key (g) and the Clear/Next key (j) at the same time.

To confirm all the above selections and wagers for any upcoming round the player presses the Play key (1). The Play key (1) will illuminate. If the player changes his mind before the upcoming round begins he/she can press the Play key again to put the wagers on hold. The Play key (1) will go dark. When the Play key (1) is illuminated to clear all selections and wagers from the game software press the Clear/Next (j) key two (2) times.

The selections and wagers made by a player or the CPU will remain in the game software unless they are cleared by the player. If a player has made several game selections and wagers he/she must play all of the game selections for the upcoming round. To make a single selection or wager for the upcoming round, if more than one has previously been made, the player must clear all of the game selections from the game software and reenter a single "Call 21" game selection or wager.

All payouts will be based on the mathematical odds of the dealer's Up-card having a specific card value, or card value and suit being dealt to the dealer for the upcoming round from the cards known by the CPU to be remaining in the deck(s) contained by the shoe from which the cards for the upcoming round will be dealt to the dealer; or the mathematical odds of each player being dealt a two-card-hand with a specific hand total, or each player's hand consisting of two specific card values, or two specific card values and suits, or two cards being dealt to each player in a specific sequence for the upcoming round from the cards known by the CPU to be remaining in the deck(s) contained by the shoe from which the cards for the upcoming round will be dealt to the game players. Traditionally a casino never pays the true odds on any wager. Therefore, the casino using the "Call 21" game software will ultimately determine the specific amounts paid to the players for any winning "Call 21" game selections.

No wagers can be made for any round dealt from the shoe that begins after the deck penetration rule set by the casino has been reached. (i.e. If 75% of the deck(s) has been dealt to the game players in preceding rounds, no ""Call 21"" wagers will be accepted until the entire deck is shuffled and placed in the shoe once again.)

At the beginning of each new round to be dealt from the deck(s) in the shoe each player's last "Call 21" game selections will be displayed on the "Call 21" LED display 97 embedded in the game table 94 and positioned adjacent to the seat the player is playing. To clear the ""Call 21"" selections from the display and call the pre-calculated payout menu for the player's hand total, card values and the card values and suit of the cards remaining in the deck(s) in the shoe 76, or the instruction menu, the player will press the Clear/Next key (j) and the Enter key (h) simultaneously. The payouts for the Dealer Up-Card selection will be displayed first. The player will press the Clear/Next key (j) again to call the payout menus for the winning game selections in the order listed below. When the last payout menu has been cleared by pressing the Clear/Next key (j) the first of the instruction menus will be displayed. To cancel the instruction menus and return to the last ""Call 21"" game selections display, the player will press the Play key (1).

An accounting module contained within the "Call 21" game software will keep track of all credits purchased, or the Buy-In by the game players, the total of all wagers, the handle, made by the ""Call 21"" game players, the total gross payouts, of all ""Call 21"" game payouts made to the game players during the play of the game, the total of all credits cashed out, the Cash Out, by the game players, the net dollars won or loss, Buy-In less Cash Out, and the percentage of the total wagers, handle, made by the players that is won or lost, the hold, (the win divided by the win or loss) by the casino for the ""Call 21"" game. Additionally, when all the game table(s) 94 are coupled via a LAN network, casino personnel may select data reports for an individual game table or for all ""Call 21"" game tables coupled to the LAN. For example, a "Deck Status" report (FIG. 19) may be displayed on the computer monitor or printed if a computer printer is included on the LAN network.

To recap, the seven games that may be played by each player with the "Call 21" software are:

(A)—A player wagering on the total of the player's original two-card-hand has one chance to win:

(1) The total of the two cards dealt to the player as the player's two-card-hand for the round wagered on matches the possible two-card-hand total selected by the player.

(B)—A player wagering on the Card Value of the Dealer's Up-Card has one chance to win when:

(1) The Card Value of the Dealer's Up-Card dealt to the Dealer matches the possible Card Value of the Dealer's Up-Card selected by the player.

(C)—A player wagering on the Card Value and Suit of the Dealer's Up-Card has one chance to win when:

(1) The Card Value and Suit of the Dealer's Up-Card dealt to the Dealer matches the possible Card Value and Suit of the Dealer's Up-Card selected by the player.

(D)—A player wagering on the Card Values of the player's original two-card-hand has two chances to win when:

(1) The Card Value of one game card dealt to the player matches one of the two possible game Card Values selected by the player for the player's original two-card-hand.

(2) The Card Values of two game cards dealt, in any sequence, to the player match two of the two possible game Card Values selected by the player for the player's original two-card-hand.

(E)—A player wagering on the Card Values and Suit of the player's original two-card-hand has two chances to win when:

(1) The Card Value and Suit of one game card dealt to the player matches one of the two possible game Card Values and Suit(s) selected by the player for the player's original two-card-hand.

(2) The Card Value and Suit of two game cards dealt, in any sequence, to the player match two of the two possible game Card Values and Suit(s) selected by the player for the player's original two-card-hand.

(F)—A player wagering on the Delivery Sequence of the Card Values of the player's original two-card-hand has four chances to win when:

(1) The Card Value of one game card dealt, in any sequence, to the player matches one of the two possible Card Values selected by the player for the player's original two-card-hand.

(2) The Card Values of two game cards dealt in any sequence, to the player match two of the two possible Card Values selected by the player for the player's original two-card-hand.

(3) The Card Value of one game card dealt, in the identical delivery sequence selected by the player, to the player matches one of the two possible Card Values selected by the player for the player's original two-card-hand.

(4) The Card Values of two game cards dealt, in the identical delivery sequence selected by the player, to the player matches two of the two possible Card Values selected by the player for the player's original two-card-hand.

(G)—A player wagering on the Delivery Sequence of the Card Values and Suit(s) of the player's original two-card-hand has four chances to win when:

(1) The Card Value and Suit of one game card dealt, in any sequence, to the player matches one of the two possible Card Values and Suit(s) selected by the player for the player's original two-card-hand.

(2) The Card Values and Suit of two game cards dealt, in any sequence, to the player match two of the two possible Card Values and Suit(s) selected by the player for the player's original two-card-hand.

(3) The Card Value and Suit of one game card dealt, in the identical delivery sequence selected by the player, to the player matches one of the two possible Card Values selected by the player for the player's original two-card-hand.

(4) The Card Values and Suit(s) of two game cards dealt, in the identical delivery sequence selected by the player, to the player matches two of the two possible Card Values selected by the player for the player's original two-card-hand.

Software Features when utilizing a LAN Network system

The software of the present invention also has many capabilities if a casino has installed a LAN network system coupling the game tables, where each of the game tables has the Card Dispensing Shoe with Scanner Apparatus and System in use, to a host computer system which will allow casino personnel to monitor and oversee the play of the game at any selected game table. These network features include the following:

1. Calculate and display on one or more remote computer monitors, during real time, the deck penetration that has been achieved at a specific game table, or all game tables for the current shoes or deck being dealt from the shoes;
2. Activate an alert display on a remote computer monitor that a specific deck penetration has been achieved at a particular game table and that the selected card count system's true count for the current shoe or deck being dealt is favorable to the players;
3. Calculate and display simultaneously on one or more remote computer monitors, during real time, the total of the game cards comprising all hand(s) dealt to the players and the dealer, at a particular game table, in sequence, as they are dealt for each game round dealt from the card dispensing shoe with scanner apparatus and system;
4. Calculate and display on one or more remote computer monitors, during real time, for selected game tables, the running and true counts for the card count system selected from one or more card counts systems, that have been programmed into the software running on the CPU associated with that card dispensing shoe with scanner for the current shoe;

(When a specific deck penetration with a threatening true count alert occurs, the computer operator could use the casino's security camera system to call or obtain an independent video display for the game on which the alert has been received. This will allow observation of the players response in order to detect those players implementing a card count system during the course of the play of the game. If a player seated at a Blackjack table is responding to a positive or negative true count at the beginning of a round by increasing or decreasing his bet, the computer personnel may note that fact and pass this information on to the casino game supervisors on the casino floor.)

5. Call and display on one or more remote computer monitors, during real time, for selected game tables, a selected basic strategies' strategy decision indices, or recommended decisions, for playing each hand of twenty-one dealt to the game's players, when the cards comprising a hand of twenty-one or blackjack have a specific total, and the dealer's up-card has a specific game card value, and the players are playing against a specific set of rules;

6. Call and display on one or more remote computer monitors, during real time, for selected game tables, a selected card count system's decision indices, or recommended decisions, that have been programmed into the CPU, for playing each hand of twenty-one dealt to the game's players, when the cards comprising a hand of twenty-one or blackjack have a specific total, and the dealer's up-card has a specific game card value, and the selected card count system's true count for the shoe or the deck being dealt from the shoe has a specific true count value; and the players are playing against a specific set of rules;

7. Display on one or more remote computer monitors, for comparison during real time, at a selected game table, a selected basic strategies' strategy decision indices, or recommended decisions, programmed into the CPU, for playing each hand of twenty-one dealt to the game's players, when the cards comprising a hand of twenty-one or blackjack, for playing each hand of twenty-one dealt to the game's players, when the cards comprising a player's hand of twenty-one or blackjack have a specific total, and the dealer's up-card has a specific game card value, and the player is playing against or with a specific set of rules; and a corresponding information display to represent the decision(s) the player actually makes for each hand played during a game round;

8. Calculate and Display on one or more remote computer monitors, during real time, for selected game tables, a selected card count system's strategy decision indices, or recommended decisions, that have been programmed into the CPU, for playing each hand of twenty-one dealt to the game's players, when the cards comprising a player's hand of twenty-one or blackjack have a specific total, and the dealer's up-card has a specific game card value, and the selected card count system's true count for the shoe or the deck being dealt from the shoe has a specific true count value; and the player is playing against or with a specific set of rules; and display a corresponding information display to represent the decision(s) the player actually makes for each hand played during a game round;

9. Calculate and displays on one or more remote computer monitors, during real time, for selected game tables, each player's strategy proficiency for all basic strategies and card count systems programmed into the software;

10. Select and display on one or more remote computer monitors, during real time, for selected game tables, the basic strategy or card count system, programmed into the software, in which the player(s) have achieved the highest proficiency for the game being played.

The above features of the card dispensing shoe with scanner software on a LAN network system will allow, during real time, all pertinent game data for the game table or tables being evaluated to be displayed on one or more remote computer monitors. The data sent to the remote computer monitor screens will provide casino personnel with detailed information about the game(s) in progress and the skills of the players without actually requiring direct visual observation of the game(s) being played. Those skilled in the art will recognize that these functions could be merged with the casino video and VCR game and security facilities to provide a comprehensive system that will enable the casino supervisors to identify individuals and teams of suspected professional card count system players and suspected "shuffle-trackers" during real time. The casino may then choose to take the appropriate action to protect themselves from such players to prevent unwanted table losses, thus saving the casino substantial amounts of money.

Although the invention has been particularly shown and described with reference to preferred embodiments thereof, it will be understood by those skilled in the art that changes in form and detail may be made therein without departing from the spirit and scope of the invention.

What is claimed is:

1. A card tracking system comprising a card delivery shoe for use in dealing playing cards for the playing of a card game and a computer coupled thereto comprising in combination: a housing having a chute for supporting at least one deck of playing cards for movement toward one end of the housing, said housing having an outlet opening whereby the cards of the deck are removed one-by-one out of the housing during the play of a game;

means for scanning indicia on each of the cards as they move along said chute whereby a signal is generated which represents the values and suits of the cards as they move one-by-one out of the housing;

means for coupling the signal from said scanning means to the computer for processing the signal for determination of trends in the play of the game in accordance with the way in which the cards are played relative to a basic strategy and/or card count system; said computer being programmed to perform the following:

(1) display on at least one display coupled to the shoe, during real time, in numerical sequence, the first active seat first and also individual active seat numbers of all seats being played by players of the card game and a total of each active player's game cards comprising each hand dealt to each active game player and to a dealer, as the game cards are dealt to each active game player for each game round dealt from the shoe;

(2) display on at least one computer monitor during real time, in numerical sequence, the first active seat first and also all active seats being played by players of the card game and a total of each active player's game cards comprising each hand dealt to each active game player and to a dealer, as the game cards are dealt to each active game player for each game round dealt from the shoe;

(3) display on at least one computer monitor, during real time, the deck penetration that has been achieved for the deck(s) being dealt from the shoe;

(4) display on at least one computer monitor, during real time, the running and true counts for the card count system selected from card count systems, that have been programmed into the computer, for the playing cards being dealt from the shoe;

(5) display on at least one computer monitor, during real time, at least one of selected card count system's strategy decision indices and recommended decisions, for playing each hand of twenty-one dealt to each player of the game, when the cards comprising each player's hand have a specific total, and a dealer's up-card has a specific game card value, the selected card count system's true count value for the cards being dealt from the shoe to generate a true count for the playing cards of the deck(s) remaining in the shoe, and an identification that each player is playing against a specific set of rules;

(6) display on at least one computer monitor, during real time, at least one of a selected basic strategy's decision indices and recommended decisions, that have been programmed into the computer, for playing each hand of twenty-one dealt to each player of the game when the cards comprising each player's hand have a specific total, and a dealer's up-card has a specific game card value, and an identification that each player is playing against a specific set of rules;

(7) display on at least one computer monitor, during real time, each active player's strategy proficiency at a selected basic strategy system for the game in progress;

(8) display on at least one computer monitor, during real time, each active player's strategy proficiency at a selected card count system for the game in progress;

(9) display on at least one computer monitor during real time, each active player's betting proficiency relative to the true count of the deck(s) remaining in the shoe to be dealt to the game players for a selected card count system for the game in progress;

(10) display in numerical sequence for each active seat, on at least one computer monitor, during real time, the value of each betting unit bet for each active seat's hand;

(11) display on at least one computer monitor, during real time, each player's strategy proficiency for both all basic strategy systems and card count systems programmed into the computer;

(12) display during real time, on at least one computer monitor the number of the game table where the twenty-one game is being evaluated; the number of active seats being played during the current game round, the number of the inactive seats not being played during the current game round, the number of deck(s) being dealt from the shoe to the game players, the deck penetration that has been achieved for the deck(s) being dealt from the shoe, a selected card count system's running count for the deck(s) being dealt from the shoe, a selected card count system's true count for the deck(s) being dealt from the shoe, the total of the game cards dealt to each player's hand and the total of the game cards dealt as the dealer' hand, when a hand consists of at least two cards, at least one of the selected basic strategy's and the selected card count system's decision index(s), and recommended strategy decisions, that have been programmed into the computer, for at least one of a basic strategy and card count system, for each hand dealt to each of the players during the play of the game, when the dealer's up-card has a specific game card value and the cards comprising a player's hand have a specific total, and the number of rounds and hands played by each player, and each decision each player actually makes on each current hand played, and each player's proficiency at the selected basic strategy when the player's actual decisions for the hands played are compared to the selected basic strategy's decision indices, and each player's proficiency at a selected card count system when the player's actual decisions for the hands played are compared to the selected card count system's true count for the deck's being dealt as compared to recommended decision indices when playing against a specific set of game rules;

(13) identify when the dealer has one of an Ace and a Ten equivalent card as an up-card and inform the dealer if the dealer's hand constitutes a two-card "21";

(14) display, during real time, each game player's basic strategy system advantage for a selected basic strategy when the player is playing against a specific number of deck(s), a specific deck penetration, and a specific set of game rules;

(15) display, during real time, each game player's card count system (CSA) advantage for a selected card count system when the player is playing against a specific number of deck(s), a specific deck penetration, and a specific set of game rules; and

(16) identify the active seats and the dealer's position during the course of the play of the game to provide a signal as to the sequence of the cards delivered from the shoe to the game player's and the dealer and what cards each player position receives for each card dealt to each of the players during each game round and what cards the dealer's position receives during each game around during real time; and

(17) identify the active seats and the dealer's position during the course of the play of the game to provide a signal as to the delivery sequence of the card values and the suit designations of each of the playing cards dealt to the game players and the dealer from the shoe apparatus that comprise each player's and the dealer's hand(s) during each game round during real time.

2. A card delivery and player proficiency evaluation system for playing a card game comprising:

a housing configured to store a plurality of playing cards and configured for dispensing cards to a number of players;

a scanner configured to scan each of the cards dispensed from the housing and to generate a scanner signal representative of the identity of each card dispensed to the players; and a processor coupled to the scanner and configured to process the scanner signal to count each of the cards dispensed to each of the players playing the card game and to determine at least one statistic in the play of the game relative to predetermined criteria to thereby evaluate the proficiency of the players.

3. The card delivery and player proficiency evaluation system of claim 2, wherein:

the identity of each card includes the value and suit of each card.

4. The card delivery and player proficiency evaluation system of claim 2, wherein:

the statistic includes trends.

5. The card delivery and player proficiency evaluation system of claim 2, wherein:

the predetermined criteria includes a predetermined card count system.

6. The card delivery and player proficiency evaluation system of claim 2, wherein:

the scanner includes an optical scanner configured to scan optical indicia on each of the cards to generate an indicia signal and to compare the indicia signal to a number of predetermined signals to generate the scanner signal.

7. The card delivery and player proficiency evaluation system of claim 2, further comprising:

a keyboard coupled to the processor for a dealer to enter game information relative to each player's win or loss.

8. The card delivery and player proficiency evaluation system of claim 2, further comprising:

a player's keyboard for the players to enter actions related to the card game.

9. The card delivery and player proficiency evaluation system of claim 8, wherein:

the player's actions include wager and card actions.

10. The card delivery and player proficiency evaluation system of claim 2, further comprising:

a reader coupled to the processor and configured to read player tracking cards issued by a casino having information regarding the respective players; and wherein the processor is coupled to a casino central processor and configured to transfer information regarding the players to a database coupled to the central processor.

11. The card delivery and player proficiency evaluation system of claim 10, wherein:

the central processor is configured to calculate the overall proficiency of the players and to generate a worth signal representative of the player's true worth.

12. The card delivery and player proficiency evaluation system of claim 11, wherein:

the central processor is configured to calculate a win signal representative of a theoretical win of the player at the casino and a selected comp value.

13. The card delivery and player proficiency evaluation system of claim 2, wherein:

the processor is configured to evaluate the proficiency of the player compared to at least one predetermined strategy.

14. The card delivery and player proficiency evaluation system of claim 13, wherein:

the processor is configured to classify actions of the player into one of the predetermined strategies.

15. The card delivery and player proficiency evaluation system of claim 13, further comprising:

a reader coupled to the processor and configured to read player tracking cards issued by a casino having information regarding the respective players; and wherein the processor is coupled to a casino central processor and configured to transfer information regarding the players to a database coupled to the central processor.

16. The card delivery and player proficiency evaluation system of claim 15, wherein:

the central processor is configured to calculate the overall proficiency of the players and to generate a worth signal representative of the player's true worth.

17. The card delivery and player proficiency evaluation system of claim 16, wherein:

the central processor is configured to calculate a win signal representative of a theoretical win of the player at the casino and a selected comp value.

18. The card delivery and player proficiency evaluation system of claim 2, further comprising:

a keyboard coupled to the processor for a dealer to enter each action by each player.

19. The card delivery and player proficiency evaluation system of claim 18, wherein:

the actions include the set of surrender, insurance, hit, double down, split and sit out.

20. The card delivery and player proficiency evaluation system of claim 18, further comprising:

a player's keyboard for the players to enter actions related to the card game.

21. The card delivery and player proficiency evaluation system of claim 20, wherein:

the player's actions include wager and card actions.

22. The card delivery and player proficiency evaluation system of claim 18, wherein:

the processor is configured to evaluate the proficiency of the player compared to at least one predetermined strategy.

23. The card delivery and player proficiency evaluation system of claim 22, wherein:

the processor is configured to classify actions of the player into one of the predetermined strategies.

24. The card delivery and player proficiency evaluation system of claim 22, further comprising:

a reader coupled to the processor and configured to read player tracking cards issued by a casino having information regarding the respective players; and wherein the processor is coupled to a casino central processor and configured to transfer information regarding the players to a database coupled to the central processor.

25. The card delivery and player proficiency evaluation system of claim 24, wherein:

the central processor is configured to calculate the overall proficiency of the players and to generate a worth signal representative of the player's true worth.

26. The card delivery and player proficiency evaluation system of claim 25, wherein:

the central processor is configured to calculate a win signal representative of a theoretical win of the player at the casino and a selected comp value.

27. The card delivery and player proficiency evaluation system of claim 2, further comprising:

a keyboard coupled to the processor for a dealer to enter an amount of each player's wager.

28. The card delivery and player proficiency evaluation system of claim 27, wherein:

the dealers enters the amount of each player's wager based on a unit bet value; and the processor is configured to calculate the number of units wagered on each hand by the players.

29. The card delivery and player proficiency evaluation system of claim 27, further comprising:

a display coupled to the housing and configured to indicate game-related information to the dealer.

30. The card delivery and player proficiency evaluation system of claim 29, wherein:

the processor is configured to generate an alarm signal when a deck of cards is penetrated; and the display indicates that the cards should be reshuffled in response to the alarm signal.

31. The card delivery and player proficiency evaluation system of claim 27, wherein:

the keyboard is for the dealer to enter each action by each player.

32. The card delivery and player proficiency evaluation system of claim 31, wherein:

the actions include the set of surrender, insurance, hit, double down, split and sit out.

33. The card delivery and player proficiency evaluation system of claim 31, wherein:

the processor is configured to evaluate the proficiency of the player compared to at least one predetermined strategy.

34. The card delivery and player proficiency evaluation system of claim 33, wherein:

the processor is configured to classify actions of the player into one of the predetermined strategies.

35. The card delivery and player proficiency evaluation system of claim 33, further comprising:

a reader coupled to the processor and configured to read player tracking cards issued by a casino having information regarding the respective players; and wherein the processor is coupled to a casino central processor and configured to transfer information regarding the players to a database coupled to the central processor.

36. The card delivery and player proficiency evaluation system of claim 35, wherein:

the central processor is configured to calculate the overall proficiency of the players and to generate a worth signal representative of the player's true worth.

37. The card delivery and player proficiency evaluation system of claim 36, wherein:

the central processor is configured to calculate a win signal representative of a theoretical win of the player at the casino and a selected comp value.

38. The card delivery and player proficiency evaluation system of claim 27, wherein:

the processor is configured to evaluate the proficiency of the player compared to at least one predetermined strategy.

39. The card delivery and player proficiency evaluation system of claim 38, wherein:

the processor is configured to classify actions of the player into one of the predetermined strategies.

40. The card delivery and player proficiency evaluation system of claim 38, further comprising:

a reader coupled to the processor and configured to read player tracking cards issued by a casino having information regarding the respective players; and wherein the processor is coupled to a casino central processor and configured to transfer information regarding the players to a database coupled to the central processor.

41. The card delivery and player proficiency evaluation system of claim 40, wherein:

the central processor is configured to calculate the overall proficiency of the players and to generate a worth signal representative of the player's true worth.

42. The card delivery and player proficiency evaluation system of claim 41, wherein:

the central processor is configured to calculate a win signal representative of a theoretical win of the player at the casino and a selected comp value.

43. The card delivery and player proficiency evaluation system of claim 27, further comprising:

a reader coupled to the processor and configured to read player tracking cards issued by a casino having information regarding the respective players; and wherein the processor is coupled to a casino central processor and configured to transfer information regarding the players to a database coupled to the central processor.

44. The card delivery and player proficiency evaluation system of claim 43, wherein:

the central processor is configured to calculate the overall proficiency of the players and to generate a worth signal representative of the player's true worth.

45. The card delivery and player proficiency evaluation system of claim 44, wherein:

the central processor is configured to calculate a win signal representative of a theoretical win of the player at the casino and a selected comp value.

46. The card delivery and player proficiency evaluation system of claim 2, further comprising:

a keyboard coupled to the processor for a dealer to enter which seats at a table are occupied by a player.

47. The card delivery and player proficiency evaluation system of claim 46, wherein:

the keyboard is for the dealer to enter an amount of each player's wager.

48. The card delivery and player proficiency evaluation system of claim 46, further comprising:

a display coupled to the housing and configured to indicate game-related information to the dealer.

49. The card delivery and player proficiency evaluation system of claim 48, wherein:

the processor is configured to generate an alarm signal when a deck of cards is penetrated; and the display indicates that the cards should be reshuffled in response to the alarm signal.

50. The card delivery and player proficiency evaluation system of claim 46, further comprising:

a player's keyboard for the players to enter actions related to the card game.

51. The card delivery and player proficiency evaluation system of claim 50, wherein:

the player's actions include wager and card actions.

52. The card delivery and player proficiency evaluation system of claim 46, wherein:

the processor is configured to evaluate the proficiency of the player compared to at least one predetermined strategy.

53. The card delivery and player proficiency evaluation system of claim 52, wherein:

the processor is configured to classify actions of the player into one of the predetermined strategies.

54. The card delivery and player proficiency evaluation system of claim 52, further comprising:

a reader coupled to the processor and configured to read player tracking cards issued by a casino having information regarding the respective players; and wherein the processor is coupled to a casino central processor and configured to transfer information regarding the players to a database coupled to the central processor.

55. The card delivery and player proficiency evaluation system of claim 54, wherein:

the central processor is configured to calculate the overall proficiency of the players and to generate a worth signal representative of the player's true worth.

56. The card delivery and player proficiency evaluation system of claim 55, wherein:

the central processor is configured to calculate a win signal representative of a theoretical win of the player at the casino and a selected comp value.

57. A method of card delivery and player proficiency evaluation for playing a card game comprising the steps of:

dispensing cards to a number of players;

scanning each of the cards dispensed from the housing and generating a scanner signal representative of the identity of each card dispensed to the players; and processing the scanner signal to count each of the cards dispensed to each of the players playing the card game and to determine at least one statistic in the play of the game relative to predetermined criteria to thereby evaluate the proficiency of the players.

58. The method of claim 57, wherein:

the identity of each card includes the value and suit of each card.

59. The method of claim 57, wherein:

the statistic includes trends.

60. The method of claim 57, wherein:

the predetermined criteria includes a predetermined card count system.

61. The method of claim 57, wherein:

the scanning step includes scanning optical indicia on each of the cards to generate an indicia signal and comparing the indicia signal to a number of predetermined signals to generate the scanner signal.

62. The method of claim 57, further comprising the step of:

a dealer entering game information relative to each player's win or loss.

63. The method of claim 57, further comprising the step of:

a player entering actions related to the card game via a player's keyboard.

64. The method of claim 57, further comprising the steps of:

reading player tracking cards issued by a casino having information regarding the respective players; and wherein the processing step includes the step of transferring information regarding the players to a database coupled to the central processor.

65. The method of claim 64, further comprising the step of:

the central processor calculating the overall proficiency of the players and generating a worth signal representative of the player's true worth.

66. The method of claim 65, further comprising the step of:

the central processor calculating a win signal representative of a theoretical win of the player at the casino and a selected comp value.

67. The method of claim 57, further comprising the step of:

a dealer entering which seats at a table are occupied by a player via a keyboard.

68. The method of claim 67, further comprising the step of:

a player entering actions related to the card game via a player's keyboard.

69. The method of claim 57, further comprising the step of:

a dealer entering an amount of each player's wager via the keyboard.

70. The method of claim 57, further the step of:

displaying game-related information to the dealer.

71. The method of claim 57, wherein:

the processing step includes the step of evaluating the proficiency of the player compared to at least one predetermined strategy.

72. The method of claim 71, wherein:

the processing step includes the step of classifying actions of the player into one of the predetermined strategies.

73. The method of claim 71, further comprising the steps of:

reading player tracking cards issued by a casino having information regarding the respective players; and wherein the processing step includes the step of transferring information regarding the players to a database coupled to the central processor.

74. The method of claim 73, further comprising the step of:

the central processor calculating the overall proficiency of the players and generating a worth signal representative of the player's true worth.

75. The method of claim 74, further comprising the step of:

the central processor calculating a win signal representative of a theoretical win of the player at the casino and a selected comp value.

76. The method of claim 57, further comprising the step of:

a dealer entering each action by each player via a keyboard.

77. The method of claim 76, further comprising the step of:

a player entering actions related to the card game via a player's keyboard.

78. The method of claim 76, wherein:

the processing step includes the step of evaluating the proficiency of the player compared to at least one predetermined strategy.

79. The method of claim 78, wherein:

the processing step includes the step of classifying actions of the player into one of the predetermined strategies.

80. The method of claim 78, further comprising the steps of:

reading player tracking cards issued by a casino having information regarding the respective players; and wherein the processing step includes the step of transferring information regarding the players to a database coupled to the central processor.

81. The method of claim 80, further comprising the step of:

the central processor calculating the overall proficiency of the players and generating a worth signal representative of the player's true worth.

82. The method of claim 81, further comprising the step of:

the central processor calculating a win signal representative of a theoretical win of the player at the casino and a selected comp value.

83. The method of claim 57, further comprising the step of:

a dealer entering an amount of each player's wager via a keyboard.

84. The method of claim 83, further comprising the steps of:

reading player tracking cards issued by a casino having information regarding the respective players; and wherein the processing step includes the step of transferring information regarding the players to a database coupled to the central processor.

85. The method of claim 84, further comprising the step of:

the central processor calculating the overall proficiency of the players and generating a worth signal representative of the player's true worth.

86. The method of claim 85, further comprising the step of:

the central processor calculating a win signal representative of a theoretical win of the player at the casino and a selected comp value.

87. The method of claim 83, further the step of:

displaying game-related information to the dealer.

88. The method of claim 83, wherein:

the processing step includes the step of evaluating the proficiency of the player compared to at least one predetermined strategy.

89. The method of claim 88, wherein:

the processing step includes the step of classifying actions of the player into one of the predetermined strategies.

90. The method of claim 88, further comprising the steps of:

reading player tracking cards issued by a casino having information regarding the respective players; and wherein the processing step includes the step of transferring information regarding the players to a database coupled to the central processor.

91. The method of claim 90, further comprising the step of:

the central processor calculating the overall proficiency of the players and generating a worth signal representative of the player's true worth.

92. The method of claim 91, further comprising the step of:

the central processor calculating a win signal representative of a theoretical win of the player at the casino and a selected comp value.

93. The method of claim 83, further comprising the step of:

the dealer entering each action by each player via the keyboard.

94. The method of claim 93, wherein:

the processing step includes the step of evaluating the proficiency of the player compared to at least one predetermined strategy.

95. The method of claim 94, wherein:

the processing step includes the step of classifying actions of the player into one of the predetermined strategies.

96. The method of claim 94, further comprising the steps of:

reading player tracking cards issued by a casino having information regarding the respective players; and wherein the processing step includes the step of transferring information regarding the players to a database coupled to the central processor.

97. The method of claim 96, further comprising the step of:

the central processor calculating the overall proficiency of the players and generating a worth signal representative of the player's true worth.

98. The method of claim 97, further comprising the step of:

the central processor calculating a win signal representative of a theoretical win of the player at the casino and a selected comp value.

99. A software structure for use in a card delivery and player proficiency evaluation system for playing a card game including a housing configured to store a plurality of playing cards and configured for dispensing cards to a number of player, a scanner configured to scan each of the cards dispensed to the players from the housing and to generate a scanner signal representative of the identity of each card dispensed to the players, and a processor coupled to the scanner, the structure comprising:

an identification routine configured to process the scanner signal to identify each of the cards;

a count routine coupled to the identification routine and configured to count each card dispensed to the players; and a determination routine coupled to the count routine and configured to determine at least one statistic in the play of the game relative to predetermined criteria to thereby evaluate the proficiency of the players.

* * * * *